US006488365B1

(12) United States Patent
Kudo et al.

(10) Patent No.: US 6,488,365 B1
(45) **Date of Patent: *Dec. 3, 2002**

(54) LIQUID DISCHARGING HEAD

(75) Inventors: Kiyomitsu Kudo; Yutaka Koizumi, both of Yokohama; Sadayuki Sugama, Tsukuba; Kiyomi Aono, Kawasaki; Tsutomu Abe, Isehara; Hiroyuki Ishinaga, Tokyo; Toshio Kashino, Chigasaki; Seiichiro Karita, Yokohama; Takeshi Okazaki, Sagamihara; Kouichi Omata, Kawasaki; Masahiko Kubota, Tokyo; Hiroki Tajima; Aya Yoshihira, both of Yokohama; Yoshie Asakawa, Hotaka-machi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/871,376

(22) Filed: Jun. 9, 1997

(30) Foreign Application Priority Data

| | | |
|---|---|---|
| Jun. 7, 1996 | (JP) | 8-145687 |
| Jun. 7, 1996 | (JP) | 8-146198 |
| Jul. 12, 1996 | (JP) | 8-183035 |
| Jul. 12, 1996 | (JP) | 8-183574 |

(51) Int. Cl.[7] ..... B41J 2/05
(52) U.S. Cl. ..... 347/65
(58) Field of Search ..... 347/65, 63

(56) References Cited

U.S. PATENT DOCUMENTS

| | | | | |
|---|---|---|---|---|
| 4,480,259 A | | 10/1984 | Kruger et al. | 347/63 |
| 4,723,129 A | | 2/1988 | Endo et al. | 347/56 |
| 5,278,585 A | | 1/1994 | Karz et al. | 347/65 |
| 5,821,962 A | * | 10/1998 | Kudo | 347/65 |

FOREIGN PATENT DOCUMENTS

| | | |
|---|---|---|
| EP | 0 436 047 | 7/1991 |
| EP | 0 655 337 | 5/1995 |
| EP | 0 721 841 | 7/1996 |
| JP | 55-81172 | 6/1980 |
| JP | 61-69467 | 4/1986 |
| JP | 63-199972 | 8/1988 |

* cited by examiner

*Primary Examiner*—Sandra Brase
(74) *Attorney, Agent, or Firm*—Fitzpatrick, Cella, Harper & Scinto

(57) ABSTRACT

A liquid discharging head includes a discharge port for discharging liquid, a liquid passage communicated with the discharge port, a bubble generating area for generating a bubble in the liquid in the liquid passage, the bubble generating area including a heater for heating the liquid in the liquid passage, and a movable member disposed in a confronting relation to the bubble generating area in the liquid passage and adapted to be shifted by pressure caused by generating the bubble at the bubble generating area to direct the pressure toward the discharge port and to be returned to its initial position by negative pressure due to contraction of the bubble, and wherein resistance of the movable member against the liquid in the liquid passage when it is shifted is smaller than that when it is returned.

18 Claims, 60 Drawing Sheets

PEELING / REVERSING

LIQUID DISCHARGING HEAD

BACKGROUND OF THE INVENTION

1. Field of the Invention

The present invention relates to a liquid discharging head for discharging desired liquid by generating a bubble formed by applying thermal energy to the liquid, and more particularly, it relates to a liquid discharging head having a movable member displaced by generating a bubble, a head cartridge having such a liquid discharging head, and a liquid discharging apparatus.

The present invention is applicable to recording apparatuses such as printers for effecting the recording on a recording medium such as a paper sheet, a thread sheet, a fiber sheet, a cloth, a leather sheet, a metal sheet, a plastic sheet, glass, wood, ceramic sheet and the like, copying machines, facsimiles having a communication system, and word processors having a printer portion, and to industrial recording apparatuses combined with various processing devices.

Incidentally, in this specification and claims, a term "recording" means not only application of a significant image such as a character or a figure onto a recording medium but also application of a meaningless image such as a pattern onto a recording medium.

2. Related Background Art

It is already known to provide an ink jet recording method, i.e., so-called bubble jet recording method in which change in state of ink including abrupt change in volume (generation of a bubble) is caused by applying energy such as heat to the ink and the ink is discharged from a discharge port by an acting force based on the change in state to adhere the ink onto a recording medium, thereby forming an image on the recording medium. As disclosed in U.S. Pat. No. 4,723,129, a recording apparatus using such a bubble jet recording method generally includes discharge ports for discharging ink, ink passages communicated with the discharge ports, and electrothermal converters as energy generating means disposed in the liquid passages and adapted to generate energy for discharging the ink.

According to such a recording method, a high quality image can be recorded at a high speed with less noise, and, in a head carrying out this method, since the discharge ports for discharging the ink can be arranged with high density, a recorded image having high resolving power and a color image can easily be obtained by a compact recording apparatus. Thus, recently, the bubble jet recording method has been applied to many office equipments such as printers, copying machines, facsimiles and the like, and is also applied to industrial systems such as print apparatuses.

As the application of the bubble jet technique to various field is increased, the following various requirements have recently been desired.

For example, regarding the requirement of improvement in energy efficiency, a heat generating element has been optimized by adjusting a thickness of a protection film. This method is effective in the point that transfer efficiency of generated heat to liquid is enhanced.

Further, in order to obtain a high quality image, there has been proposed a driving condition for providing a liquid discharging method capable of discharging the ink effectively at high speed due to stable bubble formation, and, in view of high speed recording, there has also been proposed the improvement in a liquid passage design to obtain a liquid discharging head in which liquid corresponding to discharged liquid can be refilled to the liquid passages quickly.

Among various liquid passage designs, a liquid passage structure as shown in FIGS. 44A and 44B is disclosed in the Japanese Patent Application Laid-Open No. 63-199972. The liquid passage structure and a head manufacturing method disclosed in the above Japanese Patent Application Laid-Open No. 63-199972 are inventions based on a back-wave (pressure directing toward a direction opposite to a direction to the discharge port, i.e., pressure directing toward a liquid chamber 12) generated due to bubble generation. The back-wave is known as loss energy, since it is not directed toward the discharge port.

The invention shown in FIGS. 44A and 44B includes valves 10 spaced apart from bubble generating areas of heat generating elements 2 and disposed opposite to discharge ports 11 with respect to the heat generating elements 2.

In FIG. 44B, the valve 10 has an initial position where a leaf of the valve is contacted with a ceiling of a liquid passage 3, and, when the bubble is generated, the leaf of the valve is suspended into the liquid passage 3. In this technique, the energy loss is suppressed by controlling a part of the back-wave by means of the valves 10.

However, with the above-mentioned arrangement, as can be understood from the observation of the case where the bubble is generated in the liquid passage 3 containing the liquid to be discharged, suppression of the part of the back-wave is not practical to the discharging of the liquid.

As mentioned above, the back-wave itself does not relate to the liquid discharging directly. At the time when the back-wave is generated in the liquid passage 3, as shown in FIG. 44A, a part of pressure of the bubble which directly relates to the liquid discharging already establishes a condition that the liquid can be discharged from the liquid passage 3. Accordingly, it is apparent that, even when the part of the back-wave is suppressed, the suppression does not influence upon the liquid discharging greatly.

On the other hand, in the bubble jet recording method, since the heating of the heat generating element contacted with ink is repeated, ink deposit is accumulated on a surface of the heat generating element due to overheat of ink. Depending upon the kind of ink, a large amount of deposit is accumulated on the heat generating element, with the result that the generation of the bubble becomes unstable, thereby causing the poor ink discharging. Further, when the liquid to be discharged is easily deteriorated by heat or when liquid in which an adequate bubble is hard to be formed is used, it has been desired that the liquid to be discharged is not deteriorated and good liquid discharging is achieved.

In view of the above problems, there has been proposed a liquid discharging method wherein liquid (bubble liquid) in which a bubble is formed by heat is different from liquid (discharge liquid) which is to be discharged and the liquid is discharged by transmitting pressure generated by bubble formation to the discharge liquid, as disclosed in the Japanese Patent Application Laid-Open Nos. 61-69467 and 55-81172, and U.S. Pat. No. 4,480,259. In such a method, the discharge liquid (ink) is completely isolated from the bubble liquid by a flexible diaphragm made of silicone rubber and the like to prevent the discharge liquid from directly contacting with the heat generating elements and the pressure generated by the bubble formed in the bubble liquid is transmitted to the discharge liquid by deformation of the flexible diaphragm. With this arrangement, the deposit can be prevented from being accumulated on the heat generating elements and degree of freedom of selection of the discharge liquid can be increased.

However, in the arrangement in which the discharge liquid is completely isolated from the bubble liquid, since the pressure due to the formation of the bubble is transmitted to the discharge liquid by expansion/contraction deformation of the flexible diaphragm, the pressure of the bubble is greatly absorbed by flexible diaphragm. Further, since a deformation amount of the flexible diaphragm is not so great, although the advantage of separation between the discharge liquid and the bubble liquid can be obtained, energy efficiency and/or discharging ability may be worsened.

The present invention premises that fundamental discharging feature of a conventional method for discharging liquid by forming a bubble (particularly, bubble formed by film-boiling) in a liquid passage is improved to the extent that could not be considered by conventional techniques from the point of view which could not be supposed conventionally.

The premise is obtained by first technical analysis based on operation of a movable member in the liquid passage for analyzing the principle of a moving mechanism of the in the liquid passage to provide a new liquid discharging method utilizing a bubble (which could not be obtained in the conventional techniques) and a head used in such a method on the basis of the principle of the liquid discharging, second technical analysis based on the principle of the liquid discharging due to the formation of the bubble, and third analysis based on a bubble forming area of a bubble forming heat generating element.

On the basis of these analyses, by providing a positional relation between a fulcrum of the movable member and a free end of the movable member in such a manner that the free end is positioned near the discharge port, i.e., at a downstream side of the fulcrum, and by arranging the movable member in a confronting relation to the heat generating element or the bubble forming area, a new technique for positively controlling the bubble is obtained.

In this new technique, it is most important that a downstream side growth portion of the bubble is considered in view of energy (which can be applied from the bubble itself to the liquid discharge) in order to improve the discharging feature or ability remarkably. That is to say, the discharging efficiency and discharging speed can greatly be improved by directing the downstream side growth portion of the bubble toward the discharging direction efficiently. The inventors proposed a high technical level (greatly higher than the conventional technical levels) in which the downstream side growth portion of the bubble is positively shifted toward the free end of the movable member. In the high technical level, it was found that it is preferable to consider structural factors of the movable member and the liquid passage associated with the growth of the bubble at a downstream side of the heat generating area for forming the bubble (for example, at a downstream side of a center line passing through a center of area of the electrothermal converter in the liquid flowing direction) or at a downstream side of a center of area of a surface for controlling the bubble formation, and that a refilling speed can greatly be increased by considering the arrangement of the movable member and the structure of the liquid supply passage.

Particularly, the present invention aims to utilize the above-mentioned discharging principle more effectively and provides more stable discharging feature by improving the construction or arrangement of the movable member.

SUMMARY OF THE INVENTION

A first object of the present invention is to provide a liquid discharging head which can suppress side loss of bubble pressure caused by displacement of a movable member due to formation of a bubble and improve discharging efficiency and a discharging force more effectively.

A second object of the present invention is to provide a liquid discharging head which enhances orientation of the growth of a bubble and improves discharging efficiency and a discharging force more effectively.

A third object of the present invention is to provide a liquid discharging head which can surely prevent bubble liquid from mixing with discharge liquid and perform good liquid discharging.

In addition, a fourth object of the present invention is to provide new liquid discharging principle by fundamentally controlling a bubble generated.

A fifth object of the present invention is to provide a liquid discharging head which can greatly reduce accumulation of heat in liquid on a heat generating element and reduce pressure of a residual bubble remaining on the heat generating element, thereby achieving good liquid discharging, while improving discharging efficiency and a discharging force.

A sixth object of the present invention is to provide a liquid discharging head which can prevent an inertia force of a back-wave from acting toward a direction opposite to a liquid supplying direction and increase refill frequency by reducing a retard amount of meniscus by utilizing a valve function of a movable member, thereby increasing a recording speed.

A seventh object of the present invention is to provide a liquid discharging head which can reduce deposit on a heat generating element, can widen application range of discharge liquid, and can enhance discharging efficiency and a discharging force.

An eighth object of the present invention is to provide a liquid discharging head which can increase degree of freedom of selection of liquid to be discharged.

A ninth object of the present invention is to provide a liquid discharging head which can be manufactured easily and cheaply by reducing the number of parts constituting liquid introduction passages for supplying a plurality of liquids and can be made compact.

To achieve the above objects, the typical aspects of the present invention are as follow.

Namely, the resistance to the liquid in the flow passage when the movable member is displaced is smaller than the resistance for returning the movable member to the initial position.

Additionally, the movable member has a recessed shape at the side (the second liquid flow passage) faced to the bubble generating area when the movable member is displaced due to the bubble. According to this arrangement, the movable member has a portion for enclosing the bubble at a surface directly receiving the pressure due to the generation of the bubble. More particularly, accoring to the present invention, there is provided a liquid discharging head comprising a discharge port for discharging liquid, a bubble generating area for generating a bubble in the liquid, a movable member disposed in a confronting relation to the bubble generating area and shiftable between a first position and a second position more spaced apart from the bubble generating area than the first position, and side members integrally formed with at least parts of the movable member on its both sides and shiftable together with the movable member and adapted to cover sides of a bubble generated, and wherein the movable member is shifted from the first position to the second position by pressure due to generation of the bubble in the bubble generating area, and the bubble is more expanded downstream than upstream of a direction toward the discharge port by the shifting of the movable member.

Alternatively, the present invention may provide a liquid discharging head comprising a discharge port for discharging liquid, a liquid passage including a heat generating element for generating a bubble in the liquid by applying heat to the liquid and a supply passage for supplying the liquid onto the heat generating element from an upstream side of the heat generating element along the heat generating element, a movable member disposed in a confronting relation to the heat generating element and having a free end near the discharge port and adapted to displace the free end by pressure generated by generation of the bubble, thereby directing the pressure toward the discharge port, and side members integrally formed with at least parts of the movable member on its both sides and shiftable together with the movable member and adapted to cover sides of a bubble generated.

Alternatively, the present invention may provide a liquid discharging head comprising a discharge port for discharging liquid, a heat generating element for generating a bubble in the liquid by applying heat to the liquid, a movable member disposed in a confronting relation to the heat generating element and having a free end near the discharge port and adapted to displace the free end by pressure generated by generation of the bubble, thereby directing the pressure toward the discharge port, and side members shiftable together with the movable member and adapted to cover sides of a bubble generated, and a supply passage for supplying the liquid onto the heat generating element from upstream of a surface of the movable member near the heat generating element.

Alternatively, the present invention may provide a liquid discharging head comprising a first liquid passage communicated with a discharge port, a second liquid passage including a bubble generating area for generating a bubble in the liquid by applying heat to the liquid, a movable member disposed between the first liquid passage and the bubble generating area and having a free end near the discharge port and adapted to displace the free end toward the first liquid passage by pressure generated by generation of the bubble in the bubble generating area, thereby directing the pressure toward the discharge port of the first liquid passage, and side members integrally formed with at least parts of the movable member on its both sides and shiftable together with the movable member and adapted to cover sides of a bubble generated.

Alternatively, the present invention may provide a liquid discharging head comprising a grooved member including a plurality of discharge ports for discharging liquid, a plurality of grooves for forming a plurality of first liquid passages directly communicated with the respective discharge ports, and a recess forming a first liquid chamber for supplying the liquid to the plurality of first liquid passages; an element substrate on which a plurality of heat generating elements for generating a bubble in the liquid by applying heat to the liquid are disposed; and a separation wall disposed between the grooved member and the element substrate and adapted to constitute a part of wall of second liquid passages corresponding to the heat generating elements and having a movable member shiftable toward the first liquid passages by pressure caused by generating a bubble at a position confronting to the heat generating element; and wherein the movable member is provided at least parts of its both sides with side members shifted together with the movable member and adapted to cover both sides of the bubble generated.

Alternatively, the present invention may provide a liquid discharging apparatus for discharging recording liquid by generating a bubble, comprising the above-mentioned liquid discharging head, and a drive signal supplying means for supplying a drive signal for discharging the liquid from the liquid discharging head.

Alternatively, the present invention may provide a liquid discharging head comprising an element substrate on which a plurality of discharge energy generating elements for generating a bubble for discharging liquid are disposed, a plurality of discharge ports provided in correspondence to the plurality of discharge energy generating elements and each directly communicated with a common liquid chamber to which the liquid is supplied, a bubble generating area for generating a bubble in the liquid, and a movable wall disposed in a confronting relation to the bubble generating area and shiftable between a first position and a second position more spaced apart from the bubble generating area than the first position, and wherein the movable wall has a free end downstream of a liquid flowing direction and further wherein the movable wall is shifted from the first position to the second position by pressure caused by generating the bubble in the liquid by means of the discharge energy generating means to direct the pressure toward the discharge port, thereby discharging the liquid from the discharge port.

Alternatively, the present invention may provide a liquid discharging method performed in a liquid discharging head including an element substrate on which a plurality of discharge energy generating elements for generating a bubble for discharging liquid are disposed, and a plurality of discharge ports provided in correspondence to the plurality of discharge energy generating elements and each directly communicated with a common liquid chamber to which the liquid is supplied, comprising the steps of providing a movable wall disposed in a confronting relation to a bubble generating area for generating a bubble in the liquid and shiftable between a first position and a second position more spaced apart from the bubble generating area than the first position, and shifting the movable wall from the first position to the second position by pressure caused by generating the bubble in the liquid by means of the discharge energy generating means to direct the pressure toward the discharge port, thereby discharging the liquid from the discharge port.

Alternatively, the present invention may provide a liquid discharging head comprising a discharge port for discharging liquid, a liquid passage including a heat generating element for generating a bubble in the liquid by applying heat to the liquid and a supply passage for supplying the liquid onto the heat generating element from upstream side of the heat generating element along the heat generating element, and a movable member disposed in a confronting relation to the heat generating element and having a free end near the discharge port and a fulcrum disposed at an upstream side of the free end and including a recess having a width smaller than a maximum diameter of the discharge port at at least free end of the movable member confronting to the heat generating element and adapted to shift the free end by generation of the bubble to direct pressure caused by the generation of the bubble toward the discharge port.

Alternatively, the present invention may provide a liquid discharging head comprising a discharge port for discharging liquid, a heat generating element for generating a bubble in the liquid by applying heat to the liquid, a movable member disposed in a confronting relation to the heat generating element and having a free end near the discharge port and a fulcrum disposed upstream of the free end and including a recess having a width smaller than a maximum diameter of the discharge port at at least free end of the movable member confronting to the heat generating element and adapted to shift the free end by generation of the bubble to direct pressure caused by the generation of the bubble toward the discharge port, and a supply passage for supplying the liquid onto the heat generating element from upstream of the movable member along a surface of the movable member near the heat generating element.

Alternatively, the present invention may provide a liquid discharging head comprising a discharge port for discharging liquid, a first liquid passage communicated with the discharge port, a second liquid passage including a bubble generating area for generating a bubble in the liquid by applying heat tot he liquid, and a movable member disposed in a confronting relation to the bubble generating area between the first liquid passage and the bubble generating area and having a free end near the discharge port and a fulcrum disposed at an upstream side of the free end and including a recess having a width smaller than a maximum diameter of the discharge port at at least free end of the movable member confronting to the heat generating element and adapted to shift the free end toward the first liquid passage by generation of the bubble to direct pressure caused by the generation of the bubble toward the discharge port of the first liquid passage.

Alternatively, the present invention may provide a liquid discharging head comprising a grooved member including a plurality of discharge ports for discharging liquid, a plurality of grooves for forming a plurality of first liquid passages directly communicated with the respective discharge ports, and a recess forming a first liquid chamber for supplying the liquid to the plurality of first liquid passages; an element substrate on which a plurality of heat generating elements for generating a bubble in the liquid by applying heat to the liquid are disposed; and a movable member disposed in a confronting relation to the element substrate between the grooved member and the element substrate and adapted to constitute a part of wall of second liquid passages corresponding to the heat generation elements and having a free end near the discharge port and a fulcrum disposed upstream of the free end and including a recess having a width smaller than a maximum diameter of the discharge port at at least free end of the movable member confronting to the heat generating element and adapted to shift the free end toward the first liquid passage by generation of the bubble to direct pressure caused by the generation of the bubble toward the discharge port of the first liquid passage.

Alternatively, the present invention may provide a head cartridge comprising the above-mentioned liquid discharging head and a liquid container for holding the liquid supplied to the liquid discharging head.

Alternatively, the present invention may provide a liquid discharging apparatus comprising the above-mentioned liquid discharging head, and a drive signal supplying means for supplying a drive signal for discharging the liquid from the liquid discharging head.

Alternatively, the present invention may provide a liquid discharging head comprising a discharge port for discharging liquid, a liquid passage communicated with the discharge port, a bubble generating area for generating a bubble in the liquid in the liquid passage, and a movable member disposed in a confronting relation to the bubble generating area in the liquid passage and adapted to be shifted by pressure caused by generating the bubble at the bubble generating area to direct the pressure toward the discharge port and to be returned to its initial position by negative pressure due to contraction of the bubble, and wherein resistance of the movable member against the liquid in the liquid passage when it is shifted is smaller than that when it is returned.

Alternatively, the present invention may provide a liquid discharging head comprising a discharge port for discharging liquid, a first liquid passage communicated with the discharge port, a second liquid passage including a bubble generating area for generating a bubble in the liquid by applying heat, and a movable member disposed between the first liquid passage and the bubble generating area and adapted to be shifted toward the first liquid passage by pressure caused by generating the bubble at the bubble generating area to direct the pressure toward the discharge port and to be returned to its initial position by negative pressure due to contraction of the bubble, and wherein resistance of the movable member against the liquid in the first liquid passage when it is shifted is smaller than that when it is returned.

Alternatively, the present invention may provide a liquid discharging head comprising grooved member including a plurality of discharge port for discharging liquid, a plurality of grooves for forming a plurality of first liquid passages directly communicated with the respective discharge ports, and a recess forming a first liquid chamber for supplying the liquid to the plurality of first liquid passages; an element substrate on which a plurality of heat generating elements for generating a bubble in the liquid by applying heat to the liquid are disposed; and a movable member disposed between the grooved member and the element substrate and adapted to constitute a part of wall of second liquid passages corresponding to the heat generating elements and adapted to be shifted toward the first liquid passage by pressure caused by generating the bubble at the heat generating element to direct the pressure toward the discharge port and to be returned to its initial position by negative pressure due to contraction of the bubble, and wherein resistance of the movable member against the liquid in the first liquid passage when it is shifted is smaller than that when it is returned.

Alternatively, the present invention may provide a head cartridge comprising the above-mentioned liquid discharging head, and a liquid container for containing the liquid to be supplied to the liquid discharging head.

Alternatively, the present invention may provide a liquid discharging apparatus comprising the above-mentioned liquid discharging head, and a drive signal supplying means for supplying a drive signal for discharging the liquid from the liquid discharging head.

Alternatively, the present invention may provide a liquid discharging apparatus comprising them above-mentioned liquid discharging head, and a recording medium conveying means for conveying a recording medium onto which the liquid discharged from the liquid discharging head is to be adhered.

As mentioned above, according to the liquid discharging head of the present invention based on the new discharging principle, since the sides of the generated bubble are covered by the side members, the pressure directing to the directions transverse to the liquid flowing direction is also directed toward the liquid flowing direction. And, the bubble growing direction itself is also oriented toward the downstream side, with the result that the growth of the downstream bubble portion becomes greater than the growth of the upstream bubble portion. Consequently, since the liquid near the discharge port can efficiently be discharged toward the discharge port, the discharging efficiency can be improved in comparison with the conventional techniques. For example, in a most preferable embodiment of the present invention, the discharging efficiency could be improved by twice or more in comparison with the conventional techniques.

Particularly, when the movable member has a flexible diaphragm including expansion/contraction portions constituting both sides of the movable member and the expansion/contraction portions are utilized as the side members, the displaced amount of the movable member is regulated by the expansion/contraction portions. As a result, since the degree of opening of the liquid passage near the discharge port caused by the displacement of the movable member becomes constant and bubble pressure acting toward the discharge port also becomes constant, the stable discharging can be achieved.

According to the characteristic arrangement of the present invention, even if the head is placed under a low temperature condition and/or a low humidity condition for a long time. The poor discharging can be prevented. If the poor discharging occurs, merely by effecting a recovery treatment such as preliminary discharge and/or suction recovery, the normal condition can easily be restored.

Specifically, even under a long term placement condition wherein many conventional bubble jet heads having 64 discharge ports occur the poor discharging, in the head of the present invention, only about a half or less of the discharge ports cause the poor discharging. Further, when such head is restored by the preliminary discharge, it was found that, in the conventional head, about 1000 preliminary discharges must be effected for each discharge port; whereas, in the head of the present invention, the head can be restored merely by about 100 preliminary discharges. This means that the recovery time and the liquid loss during the recovery operation can be reduced and the running cost can be reduced greatly.

Further, according to the arrangement of the present invention in which the refilling feature is improved, the response in the continuous liquid discharging, stable growth of the bubble and stability of liquid droplets can be improved, thereby permitting high speed recording due to high speed liquid discharging and high quality image recording.

The other advantages of the present invention will be apparent from the detailed explanation of respective embodiments of the present invention.

Incidentally, in the specification and claims, the terms "upstream" and "downstream" are referred to regarding the liquid flowing direction from the liquid supply source through the bubble generating area (or movable member) to the discharge port, or the constructional direction.

Further, the term "downstream side" regarding the bubble itself mainly means a discharge port side portion of the bubble directly relating the liquid discharging. More particularly, it means a bubble portion generated at a downstream of a center of the bubble in the liquid flowing direction or the constructural direction or at downstream of a center of the area of the heat generating element.

Further, in the specification and claims, the term "substantially closed" or "substantially sealed" means a condition that, when the bubble is growing, before the movable member is shifted, the bubble cannot escape through a gap (slit) at a downstream side of the movable member.

In addition, the term "separation wall" means a wall (which may include the movable member) disposed to separate the bubble generating area from an area directly communicated with the discharge port in a broader sense, and means a wall for distinguishing the liquid passage including the bubble generating area from the liquid passage directly communicated with the discharge port and for preventing the mixing of the liquid in both liquid passages in a narrower sense.

DETAILED DESCRIPTION OF THE PREFERRED EMBODIMENTS (First Embodiment)

Now, a first embodiment of the present invention will be fully described with reference to the accompanying drawings.

First of all, in this embodiment, an example that a discharging force and discharging efficiency are improved by controlling a transmission direction of pressure caused by formation of a bubble and a growing direction of the bubble in order to discharge liquid will be explained.

Figure 1A:
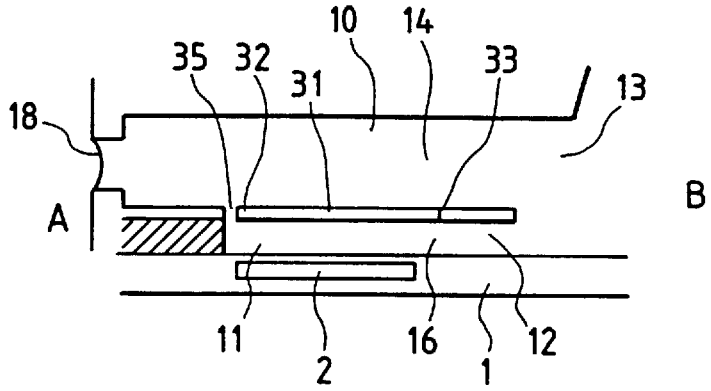
FIG. 1A PRIOR ART
FIGS. 1A, 1B, 1C and 1D are schematic sectional views showing an example of a liquid discharging head according to the present invention.
Figure 1B:
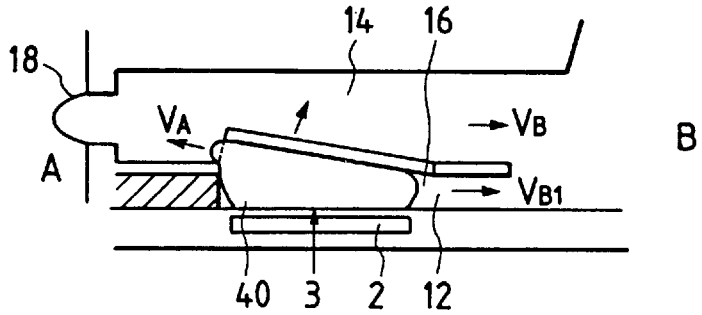
FIG. 1B PRIOR ART
Figure 1C:
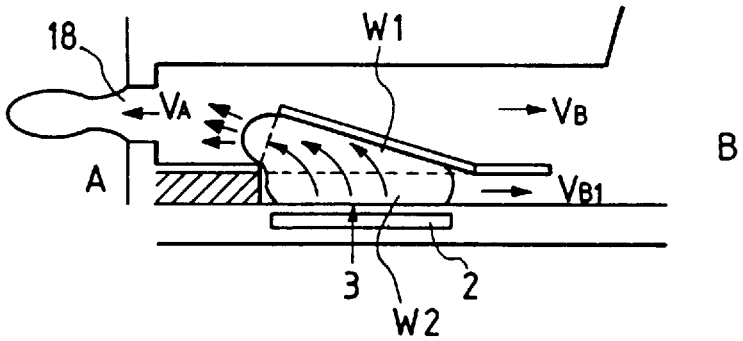
FIG. 1C PRIOR ART
Figure 1D:
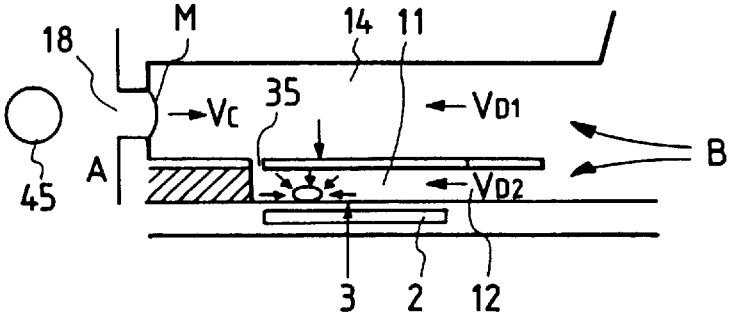
FIG. 1D PRIOR ART
Figure 2:
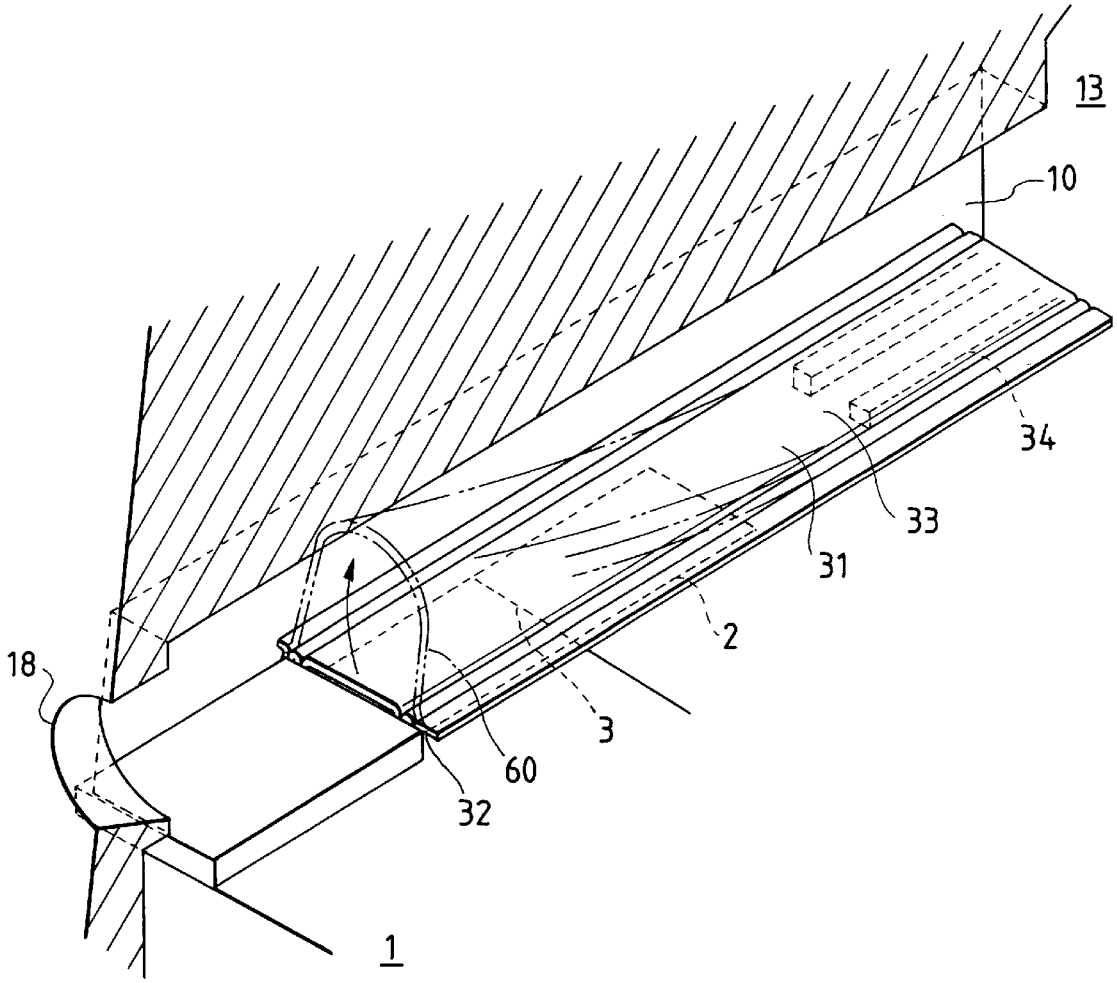
FIG. 2 is a partial fragmental perspective view of the liquid discharging head according to the present invention.
Figure 3A:
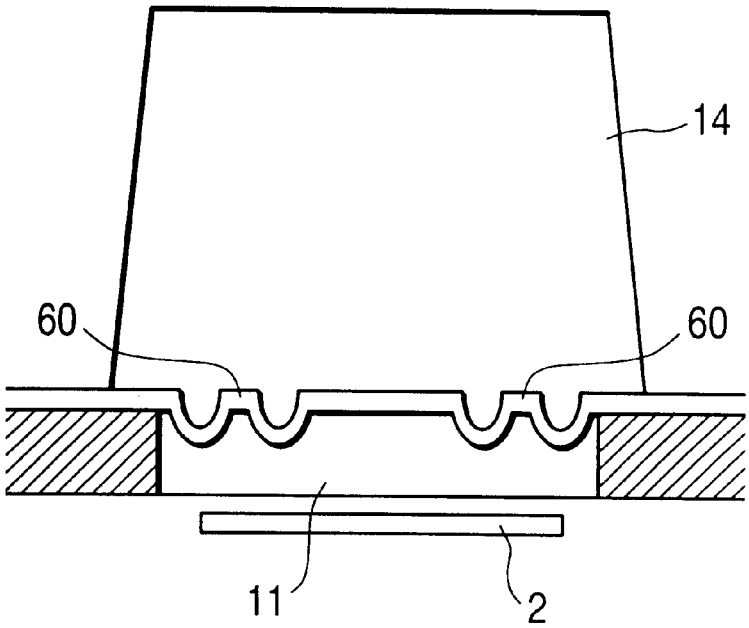
FIGS. 3A and 3B are schematic sectional views of the liquid discharging head according to the present invention, looked at from a discharge port side.
Figure 3B:
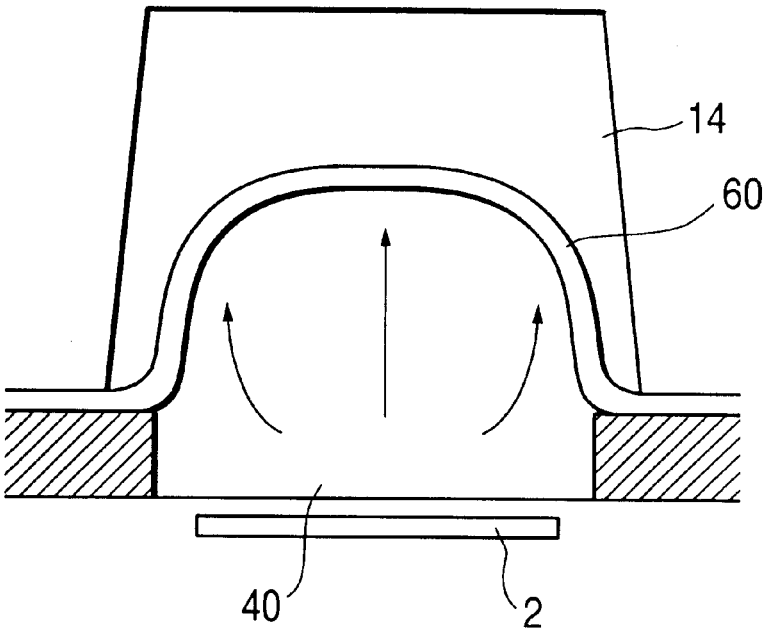

FIGS. 1A, 1B, 1C and 1D are sectional views of a liquid passage of a liquid discharging head according to the first embodiment, and FIG. 2 is a partial fragmental perspective view of the liquid discharging head. FIGS. 3A and 3B are schematic sectional views of the liquid discharging head according to the first embodiment, looked at from a discharge port side.

The liquid discharging head according to the illustrated embodiment includes an element substrate 1 on which a heat generating element 2 (heat generating resistance member having a dimension of 40 $\mu$m×105 $\mu$m, in the illustrated embodiment) for acting thermal energy on liquid (as discharge energy generating element for generating energy for discharging the liquid) is arranged, and a liquid passage 10 is formed above the element substrate 1 in correspondence to the heat generating element 2. The liquid passage 10 communicates with a discharge port 18 and also communicated with a common liquid chamber 13 for supplying the liquid to a plurality of liquid passages 10, and receives the liquid corresponding to the discharged liquid from the common liquid chamber 13.

Within the liquid passage 10, above the element substrate 1, there is provided a movable member 31 formed from a flexible thin diaphragm made of resin and the like. The movable member is provided at its both sides with the expansion/contraction portion 60 and has a flat upper surface. One end of the movable member 31 and the expansion/contraction portions 60 are secured to a base (support member) 34 formed by patterning photosensitive resin on a wall of the liquid passage 10 and on the element substrate 1. As a result, the movable member 31 is held in such a manner that the upper surface of the member can be displaced around a fulcrum (support portion) 33 at its one end as the expansion/contraction portions 60 are expanded and contracted.

The movable member 31 has the fulcrum 33 positioned at an upstream side of large flow of liquid flowing from the common liquid chamber 13 through the movable member 31 to the discharge port 18 and is opened at a downstream side of the fulcrum 33 to form the expansion/contraction portions 60 on its both sides and a free end (free end portion) 32 at its distal end and is disposed in a confronting relation to the heat generating element 2 to cover the heat generating element 2 and is spaced apart from the heat generating element 5 by about 15 $\mu$m. A bubble generating area 11 is defined between the heat generating element 2 and the movable member 31.

Figure 4A:
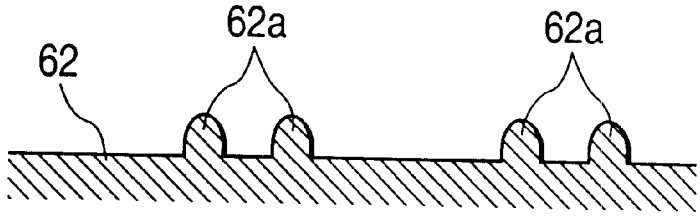
FIGS. 4A, 4B and 4C are explanatory views showing an example of a method for manufacturing expansion/contraction portions of the liquid discharging head according to the present invention.
Figure 4B:
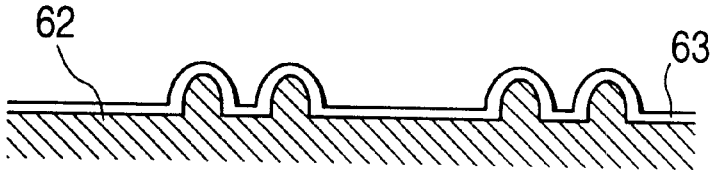
Figure 4C:
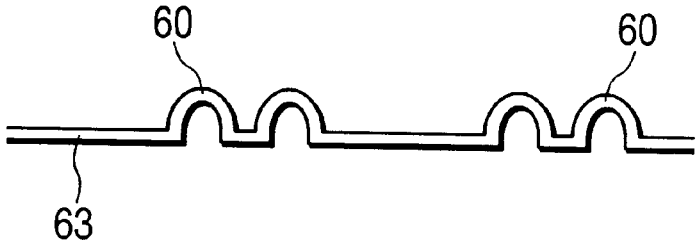

An example of a method for manufacturing the thin diaphragm having the expansion/contraction portions 60 will be explained with reference to FIGS. 4A, 4B and 4C. Here, an electroforming method will be described. First of all, a master mold 62 having projections 62*a* corresponding to the expansion/contraction portions 60 as shown in FIG. 4A is prepared. Heights, configurations and number of the projections 62*a* are determined to achieve a desired displacement amount in accordance with material and thickness of resin from which the thin diaphragm is formed. Then, as shown in FIG. 4B, resin such as polyimide as this diaphragm material 63 is coated on a surface of the master mold 62 on which the projections 62*a* are formed. Then, the thin diaphragm material 63 is peeled from the master mold 62, thereby obtaining the thin diaphragm having the expansion/contraction portions 60 as shown in FIG. 4C.

Kinds, configurations and dispositions of the heat generating element 2 and the movable member 31 are not limited to the above-mentioned ones, but, the heat generating element and the movable member may be configured and disposed to control the growth of the bubble and transmission of the pressure, which will be described later. Incidentally, for the explanation of a liquid flow which will be described later, the liquid passage 10 is explained to have a first liquid passage 14 (at one side of the movable member 31) directly communicated with the discharge port 18 and a second liquid passage 16 (at the other side of the movable member) including the bubble generating area 11 and a liquid supply passage 12.

Heat is applied to the liquid in the bubble generating area 11 between the movable member 31 and the heat generating element 2 by heating the heat generating element 2, and a bubble is formed in the liquid by a film-boiling phenomenon as disclosed in U.S. Pat. No. 4,723,129. Pressure caused by the formation of the bubble, and the bubble act on the movable member 31 preferentially to expand the expansion/contraction portions 60, with the result that the movable member 31 is displaced around the fulcrum 33 to be greatly opened toward the discharge port 18, as shown in FIGS. 1B and 1C or FIG. 2. By the displacement or a displaced condition of the movable member 31, a transmitting direction of the pressure caused by the formation of the bubble and a growing direction of the bubble itself are oriented toward the discharge port 18.

Now, one of fundamental discharging principles of the present invention will be explained. The most important principle of the present invention is to displace or shift the movable member 31 (disposed in a confronting relation to the bubble) from a first positon (normal condition) to a second position (displaced condition) by the pressure of the bubble or the bubble itself, so that the pressure caused by the formation of the bubble and the bubble itself are oriented to a downstream side in which the discharge port 18 is disposed, by the displaced movable member 31.

Figure 5:
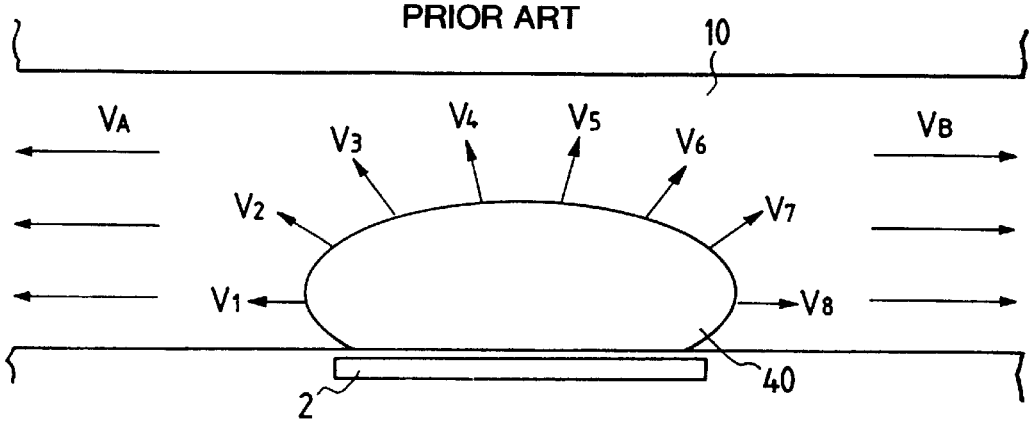
FIG. 5 PRIOR ART
FIG. 5 is a schematic view showing pressure transmission from a bubble in a conventional head.
Figure 6:
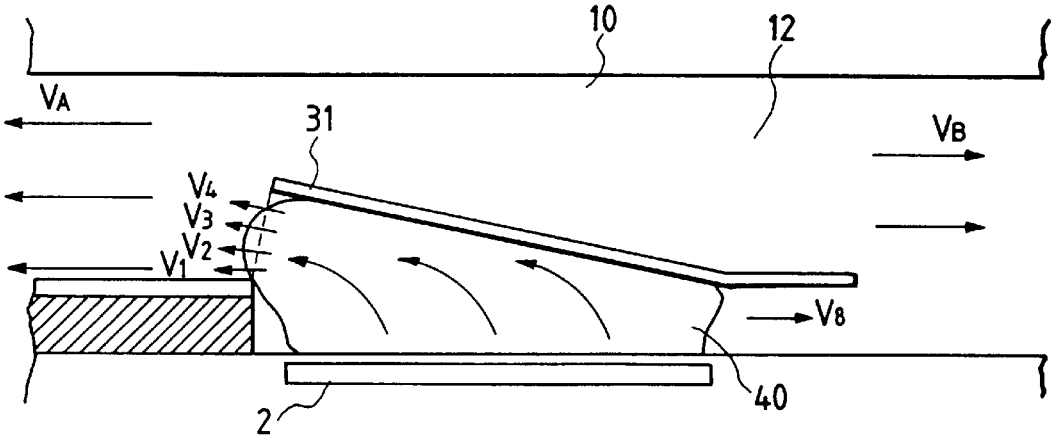
FIG. 6 is a schematic view showing pressure transmission from a bubble in the head of the present invention.

This principle will be fully explained while comparing FIG. 5 (schematically showing a structure of a conventional liquid passage not having the movable member 31) and FIG. 6 (showing the present invention). Incidentally, here, the pressure transmitting direction toward the discharge port is shown by the arrows VA and a pressure transmitting direction toward the upstream side is shown by the arrows VB.

In the conventional head as shown in FIG. 5, there is no means for regulating a transmitting direction of the pressure caused by formation of a bubble 40. Thus, the pressure of the bubble 40 is transmitted toward various directions as shown by the arrows V1–V8 perpendicular to a surface of the bubble. Among them, the pressure transmitting directions V1–V4 have components directing toward the direction VA which is most effective to the liquid discharging, and the pressure transmitting directions V1–V4 are positioned on a left half of the bubble near the discharge port and contribute to the liquid discharging efficiency, liquid discharging force and liquid discharging speed. Further, since the pressure transmitting direction V1 is directed to the discharging direction VA, it is most effective; whereas, the pressure transmitting direction V4 has smallest component directing toward the discharging direction VA.

To the contrary, in the present invention shown in FIG. 6, the pressure transmitting directions V1–V4 which are directed to various directions in FIG. 5 are oriented toward the downstream side (i.e., toward the discharge port) by the movable member 31 (i.e., various pressure transmitting directions is converted to the downstream direction), with the result that the pressure of the bubble 40 contributes to the liquid discharging directly and effectively. Further, as shown in FIG. 3B, since both sides of the bubble 40 is covered or regulated by the expansion/contraction portions 60, the pressure directing laterally of the liquid passage 10 can also be oriented toward the discharge port 18 by the expansion/contraction portions 60 of the movable member 31. Similar to the pressure transmitting directions V1–V4, the growing direction of the bubble is directed toward the downstream side, with the result that the bubble is grown more greatly at the downstream side than at the upstream side. By controlling the growing direction of the bubble 40 itself and the pressure transmitting direction of the bubble 40 by means of the movable member 31, the discharging efficiency, discharging force and discharging speed can be improved.

Next, a discharging operation of the liquid discharging head according to the illustrated embodiment will be fully described with reference to FIGS. 1A, 1B, 1C and 1D.

FIG. 1A shows a condition before energy such as electrical energy is applied to the heat generating element 2, i.e., before heat is generated from the heat generating element 2. It is important that the movable member 31 is disposed in a confronting relation to at least a downstream portion of the bubble 40 which will be formed by the heat from the heat generating element 2. That is to say, the movable member 31 extends up to at least a position downstream of center 3 of an area of the heat generating element in the liquid passage (i.e., downstream of a line passing through the center 3 of the area of the heat generating element and extending perpendicular to the length of the liquid passage) so that the movable member 31 acts on the downstream portion of the bubble 40.

FIG. 1B shows a condition that the heat generating element 2 is heated by applying the electrical energy to the heat generating element 2 and the bubble 40 is formed by the film-boiling caused by heating a portion of the liquid contained in the bubble generating area 11 by utilizing the heat from the heat generating element.

In this case, the movable member 31 is displaced or shifted by the pressure caused by the formation of the bubble 40 from the first position to the second position to direct the pressure transmitting direction of the bubble 40 toward the discharge port. Further, at the same time, the expansion/contraction portion 60 are expanded so that the movable member 31 forms a liquid path directing from the upstream side (side of the common liquid chamber 13) to the downstream side (side of the discharge port 18). Here, it is important that, as mentioned above, the free end 32 of the movable member 31 is disposed at the downstream side and the sides of the movable member are constituted by the expansion/contraction portions 60 so that the movable member is opened only toward the discharge port, and the fulcrum 33 is disposed at the upstream side and at least a portion of the movable member 31 is faced to the downstream portion of the heat generating element 2 (i.e., downstream portion of the bubble 40).

FIG. 1C shows a condition that the bubble 40 is further growing and the movable member 31 is further displaced by the pressure caused by the growth of the bubble 40. The generated bubble 40 is grown more greatly at the downstream side than at the upstream side, and the bubble is greatly grown to exceed the first position (shown by the dot and chain line) of the movable member 31.

In the present invention, as shown in FIGS. 2, 3A and 3B, the movable member 31 is formed from the thin diaphragm having the expansion/contraction portions 60, and, since the fulcrum 33 and the both sides of the movable member are integrally secured to the element substrate 1 and the movable member is opened only toward the discharge port 18, when the movable member 31 is gradually displaced as the bubble 40 is growing, the pressure transmitting direction of the bubble 40 is regulated to a direction toward which the pressure transmitting direction is apt to be oriented (i.e., to the free end opened toward the discharge port), with the result that the growing direction of the bubble 40 is uniformly oriented toward the discharge port 18, thereby improving the discharging efficiency. When the growing direction of the bubble 40 and the pressure transmitting direction are oriented toward the discharge port, the movable member does not resist against such orientation, with the result that the pressure transmitting direction and the growing direction of the bubble 40 can be controlled efficiently in accordance with the magnitude of the pressure to be transmitted. Further, since the displacement amount of the movable member 31 is regulated by the expansion/contraction portions 60 so that the degree of opening of the free end 32 of the movable member 31 during the displacement of the movable member becomes always constant, the bubble pressure acting on the first liquid passage 14 also becomes constant, thereby achieving the stable liquid discharging.

FIG. 1D shows a condition that the bubble 40 is contracted to be disappeared by reduction of pressure in the bubble (after the film-boiling).

The movable member 31 which was displaced to the second position is returned to an initial position shown in FIG. 1A (first position) by negative pressure due to contraction of the bubble 40, elasticity of the movable member 31 itself and restoring ability of the expansion/contraction portions 60. Further, when the bubble is disappeared, in order to compensate the contracted volume of the bubble 40 at the bubble generating area 11 and to compensate the volume of the discharged liquid, the liquid flows into the bubble generating area from the upstream side (B), i.e., from the common liquid chamber 13 as shown by the arrows $V_{D1}$, $V_{D2}$ and from the discharge port 18 as shown by the arrow $V_C$.

While the operation of the movable member 31 in response to the formation of the bubble 40 and the liquid discharging were explained, now, refilling of the liquid in the liquid discharging head of the present invention will be fully explained.

The liquid supplying mechanism in the present invention will be fully described with reference to FIGS. 1A, 1B, 1C and 1D.

After the condition shown in FIG. 1C, when the bubble 40 is being contracted from the maximum volume condition, the liquid compensating the reduced bubble volume flows into the bubble generating area 11 from the discharge port 18 of the first liquid passage 14 and from the common liquid chamber 13 associated with the second liquid passage 16. In the conventional liquid passage design not having the movable member 31, an amount of liquid flowing toward the discharge port into the reduced bubble position and an amount of liquid flowing toward the common liquid chamber into the reduced bubble position depend upon flow resistance between the bubble generating area and the discharge port, and flow resistance between the bubble generating area and the common liquid chamber (i.e., depend upon resistance of the liquid passages and inertia of the liquid).

Thus, when the flow resistance between the bubble generating area and the discharge port is smaller than the flow resistance between the bubble generating area and the common liquid chamber, the greater amount of liquid flow into the reduced bubble position, thereby increasing a retard amount of meniscus M. In particular, the smaller the flow resistance between the bubble generating area and the discharge port (to enhance the discharging efficiency), the greater the retard amount of the meniscus M, thereby increasing the refilling time to affect a bad influence upon the high speed recording.

To the contrary, in the illustrated embodiment, since the movable member 31 is provided, when it is assumed that a volume portion (above the first position) of the volume W of the bubble is W1 and a volume portion (below the first position, i.e., toward the bubble generating area 11) of the volume W of the bubble is W2, the retard of the meniscus M is stopped at the time when the movable member 31 is returned to its initial position during the reduction of the bubble. And, the liquid corresponding to the remaining volume W2 is mainly supplied from the liquid flow $V_{D2}$ in the second liquid passage 16. In this way, the retard amount of the meniscus M can be suppressed to about a half of the volume portion W1; incidentally, in the conventional techniques, the retard amount of the meniscus M was about a half of the entire volume W of the bubble.

Further, since the liquid corresponding to the volume portion W2 can forcibly be supplied mainly from the upstream side ($V_{D2}$) along the surface of the movable member 31 facing to the heat generating element 2 by utilizing the negative pressure during the disappearance of the bubble, the refilling time can be shortened.

When the refill is effected by utilizing the negative pressure during the disappearance of the bubble in the conventional head, the fluctuation of the meniscus becomes great to cause the deterioration of the image quality. To the contrary, in the high speed refill according to the illustrated embodiment, since the flowing of the liquid in the first liquid passage near the discharge port into the bubble generating area 11 near the discharge port 18 is suppressed by the movable member 31, the fluctuation of the meniscus M can be minimized.

In this way, according to the present invention, since the high speed refill is achieved by the forcible refill of the liquid into the bubble generating area 11 from the liquid supply passage 12 of the second liquid passage 16 and suppression of the retard or fluctuation of the meniscus, the stable liquid discharging and high speed repeat discharging can be realized, and, when applied to the recording field, the high quality image and high speed recording can be realized.

In the arrangement according to the present invention, there is also provided the following effective function. That is to say, the transmission of the pressure caused by the formation of the bubble to the upstream side (back-wave) can be suppressed. The pressure of the bubble portion (near the common liquid chamber 13 (upstream side)) of the bubble 40 generated on the heat generating element 2 tends to push the liquid back to the upstream side (to cause the back-wave). The back-wave creates upstream pressure, upstream movement of the liquid and an inertia force due to the liquid movement, which resist the refill of the liquid into the liquid passage, thereby affecting a bad influence upon the high speed recording. In the present invention, since such upstream pressure, upstream liquid movement and inertia force can be suppressed by the movable member 31, the refill ability can be further improved.

Next, a further characteristic construction and advantage therefor in the illustrated embodiment will be described.

The second liquid passage 16 according to the illustrated embodiment has the liquid supply passage 12 having an inner wall flatly contiguous to (i.e., flush with) the heat generating element 2 at the upstream side of the heat generating element 2. In such a case, the supply of the liquid to the bubble generating area 11 and the surface of the heat generating element 2 is effected along the surface of the movable member 31 facing to the bubble generating area 11 (as flow $V_{D2}$). Thus, stagnation of liquid on the heat generating element 2 is prevented, with the result that gas included in the liquid and the residual bubble can easily be removed and excessive accumulation of heat in the liquid can be avoided. Accordingly, more stable formation of bubble can be repeated at a high speed. Incidentally, in the illustrated embodiment, while an example that the liquid supply passage 12 has a substantially flat inner wall was explained, the inner wall of the liquid supply passage is not limited to such an example, but may have a gentle slope or other shape smoothly contiguous to the surface of the heat generating element to prevent the stagnation of liquid on the heat generating element and disturbance of the supplied liquid.

Figure 7:
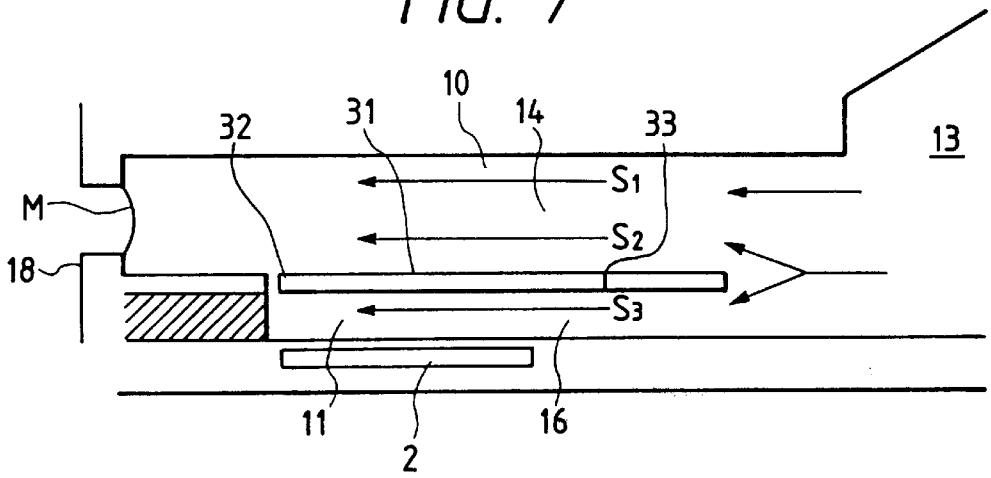
FIG. 7 is a schematic view for explaining the flowing of liquid in the present invention.

By the way, regarding the positions of the free end 32 and the fulcrum 33 of the movable member 31, for example, as shown in FIG. 7, the free end 32 is disposed at a downstream side of the fulcrum 33. With this arrangement, when the bubble is being formed, the pressure transmitting direction and the growing direction of the bubble 40 can be oriented or directed toward the discharge port 18 effectively. Further, this positional relation not only contributes the improvement of the discharging efficiency or ability but also reduces flow resistance of the liquid flowing through the liquid passage 10 during the supply of liquid, thereby achieving the high speed refill. The reason is that, as shown in FIG. 7, when the meniscus M retarded due to the liquid discharging is restored toward the discharge port 18 by a capillary phenomenon and/or when the liquid is supplied to compensate the disappeared bubble, the free end 32 and the fulcrum 33 are arranged not to resist against the liquid flows S1, S2, S3 flowing in the liquid passage 10 (including the first and second liquid passages 14, 16).

Further, in FIGS. 1A, 1B, 1C and 1D, as mentioned above, regarding the heat generating element 2, the free end 32 of the movable member 31 extends up to the position downstream of the center 3 of the area of the heat generating element 2 (i.e., downstream of the line passing through the center of the area of the heat generating element and extending perpendicular to the length of the liquid passage 10). Thus, the pressure and the downstream portion of the bubble 40 which are generated at the downstream side of the center 3 of the area of the heat generating element and greatly contribute to the liquid discharging are supported by the movable member 31, with the result that the pressure and the bubble portion 40 are directed toward the discharge port 18, thereby improving the discharging efficiency and discharging force.

In addition, by utilizing the upstream portion of the bubble, various advantages can be achieved.

Further, in the illustrated embodiment, the momentary mechanical displacement of the free end 32 of the movable member 31 also contributes to the improvement of the liquid discharging.

(Second Embodiment)

Figure 8:
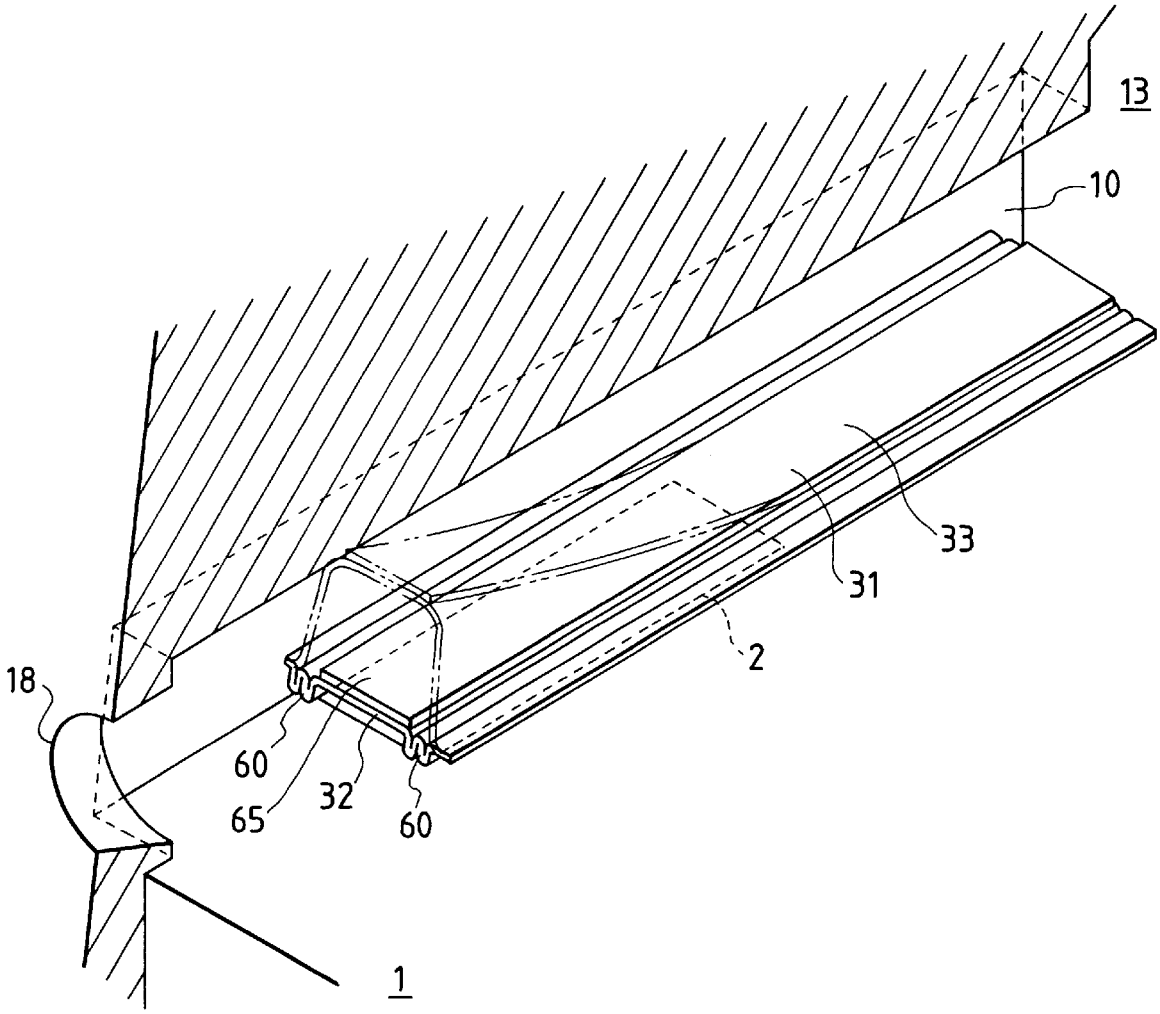
FIG. 8 is a partial fragmental perspective view of a liquid discharging head according to a second embodiment of the present invention.
Figure 9A:
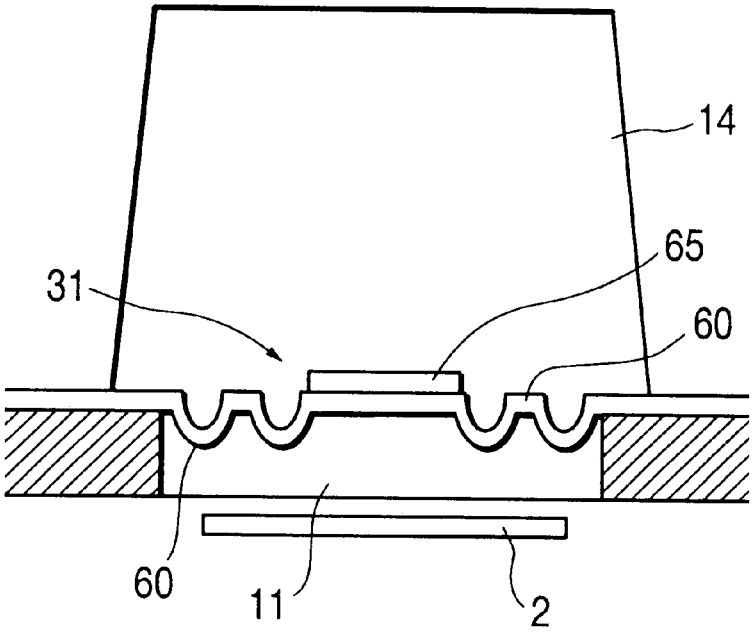
FIGS. 9A and 9B are schematic sectional views of the liquid discharging head of FIG. 8, looked at from a discharge port side.
Figure 9B:
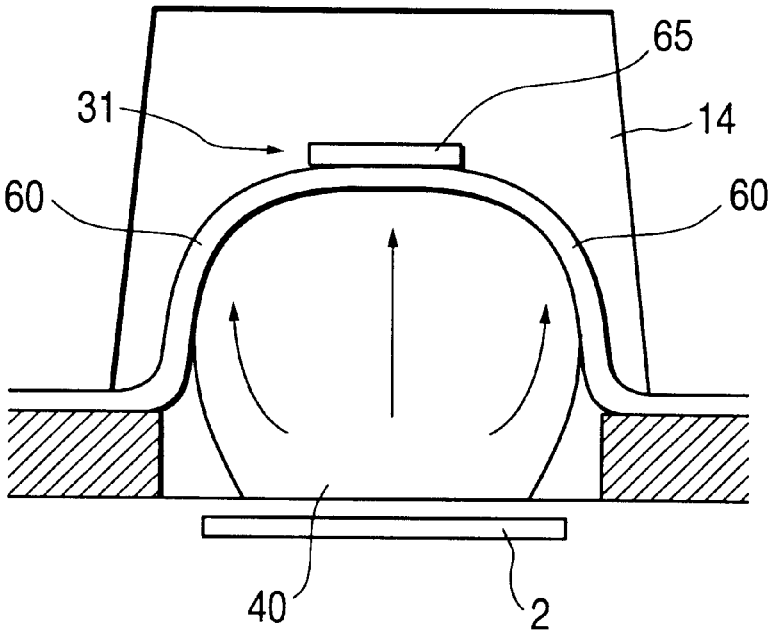

FIG. 8 is a partial fragmental perspective view of a liquid discharging head according to a second embodiment of the present invention. FIGS. 9A and 9B are schematic sectional views of the liquid discharging head of FIG. 8, looked at from a discharge port side.

In this second embodiment, as is in the first embodiment, a movable member 31 is constituted by a thin diaphragm having expansion/contraction portions 60 at its both sides and opened toward a discharge port 18, and a cantilever portion 65 secured to an upper surface of the thin diaphragm (a zone of the diaphragm between the expansion/contraction portions 60) and having an upstream fulcrum 33 and a downstream free end 32. The cantilever portion 65 is formed from a plate member made of material (for example, metal) having elasticity. The movable member 31 constituted by the thin diaphragm and the cantilever portion 65 is disposed in a confronting relation to a heat generating element 2 to cover the heat generating element 2 and is spaced apart from the heat generating element 2 by about 15 $\mu$m.

With the arrangement as mentioned above, the free end 32 of the cantilever portion 65 is gradually displaced as a bubble 40 is growing, with the result that the expansion/contraction portions 60 of the thin diaphragm is gradually expanded. In this case, as shown in FIG. 9B, since the both sides of the cantilever portion 65 are covered by the diaphragm having the expansion/contraction portions 60, the pressure transmitting direction and the growing direction of the bubble 40 is directed toward the free end 32 of the cantilever portion 65 and the opening of the diaphragm having the expansion/contraction portions 60. Further, by using the cantilever portion 65, the direction control and the shape restoring can be effected more effectively.

(Third Embodiment)

Figure 10:
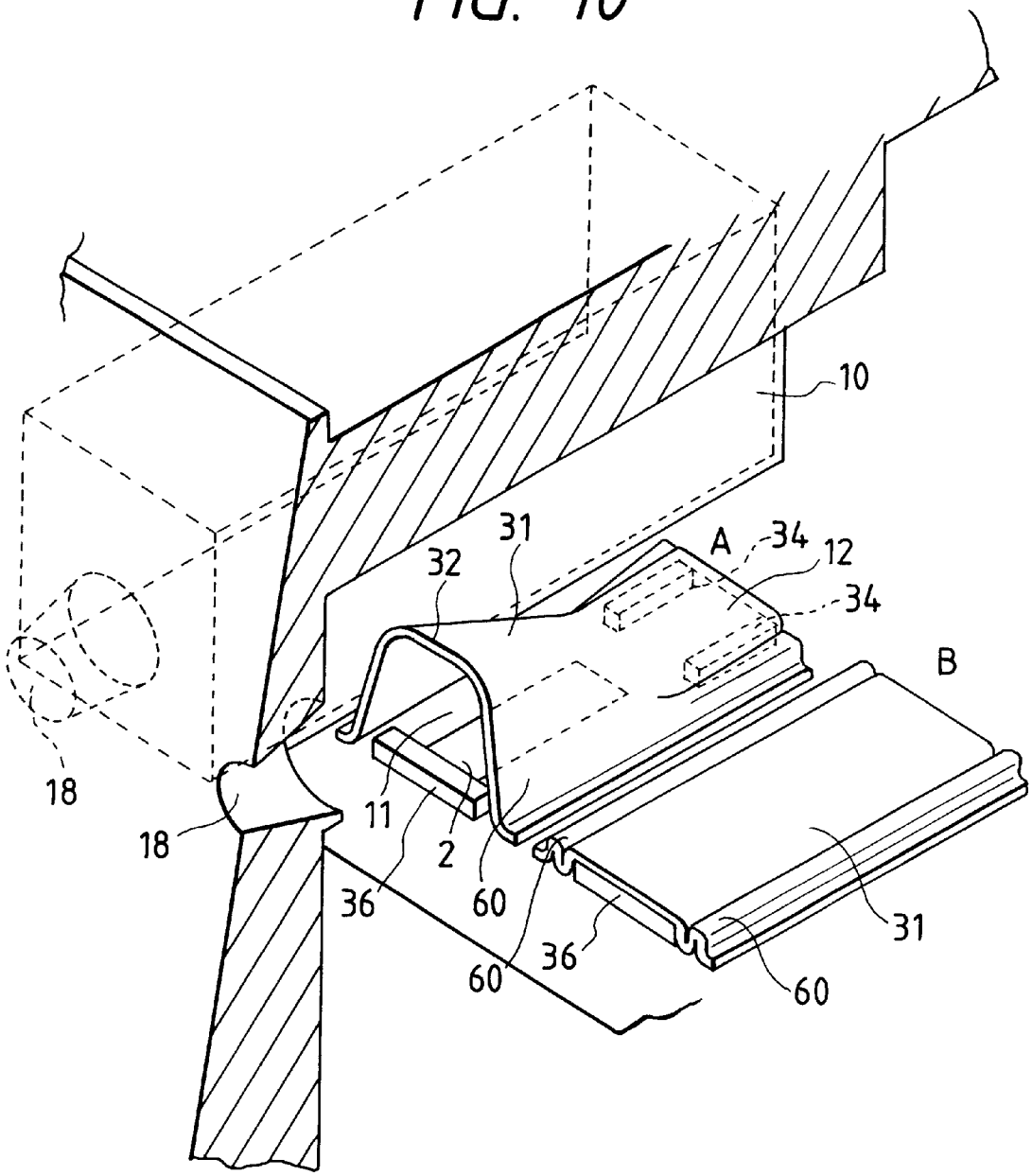
FIG. 10 is a partial fragmental perspective view of a liquid discharging head according to a third embodiment of the present invention.

FIG. 10 shows a third embodiment of the present invention. In FIG. 10, "A" shows a condition that a movable member 31 is displaced (a bubble is not shown), and "B" shows a condition that the movable member 31 is positioned in an initial position (first position). In the condition B, a bubble generating area 11 is substantially closed or sealed with respect to a discharge port 18. (Although not shown, there is a liquid passage wall between A and B to separate liquid passages from each other.)

The movable member 31 shown in FIG. 10 has two bases 34 and a liquid supply passage 12 between the bases. With the arrangement, the liquid can be supplied along a surface of the movable member 31 facing to a heat generating element 2 from a liquid supply passage 12 having an inner surface flush with or smoothly contiguous to a surface of the heat generating element 2.

In the initial position (first position) of the movable member 31, the movable member 31 is adjacent to or closely contacted with a downstream wall 36 of the heat generating element disposed at a downstream end of the heat generating element 2, and an end (toward the discharge port 18) of a bubble generating area 11 is substantially sealed by the downstream wall 36 of the heat generating element and expansion/contraction portions 60 of the movable member 31. Thus, pressure of a bubble (particularly, downstream pressure of the bubble) can be concentrated and oriented toward a free end 32 of the movable member 31 without loss of the downstream portion of the bubble.

Further, when the bubble is disappeared, the movable member 31 is returned to the first position, and, when the liquid is supplied to compensate the disappeared bubble, since the side (near the discharge port 18) of the bubble generating area 11 is substantially sealed, the suppression of the retard of the meniscus and the like can be achieved, as is in the former embodiment.

Further, in the illustrated embodiment, as shown in FIGS. 2 and 10, the bases 34 for supporting and securing the movable member 31 are spaced apart from the heat generating element 2 and disposed at the upstream side of the heat generating element, and widths of the bases 34 are smaller than a width of the liquid passage 10 to permit the supply of liquid to a liquid supply passage 12. Further, the configuration of each base 34 is not limited to the illustrated one, but may be selected to perform the refill smoothly.

Incidentally, in the illustrated embodiment, while the distance between the movable member 31 and the heat generating element 2 was selected to about 15 $\mu$m, such a distance may be selected within a range in which the pressure caused by the formation of the bubble can be sufficiently transmitted to the movable member 31.

(Fourth Embodiment)

Figure 11:
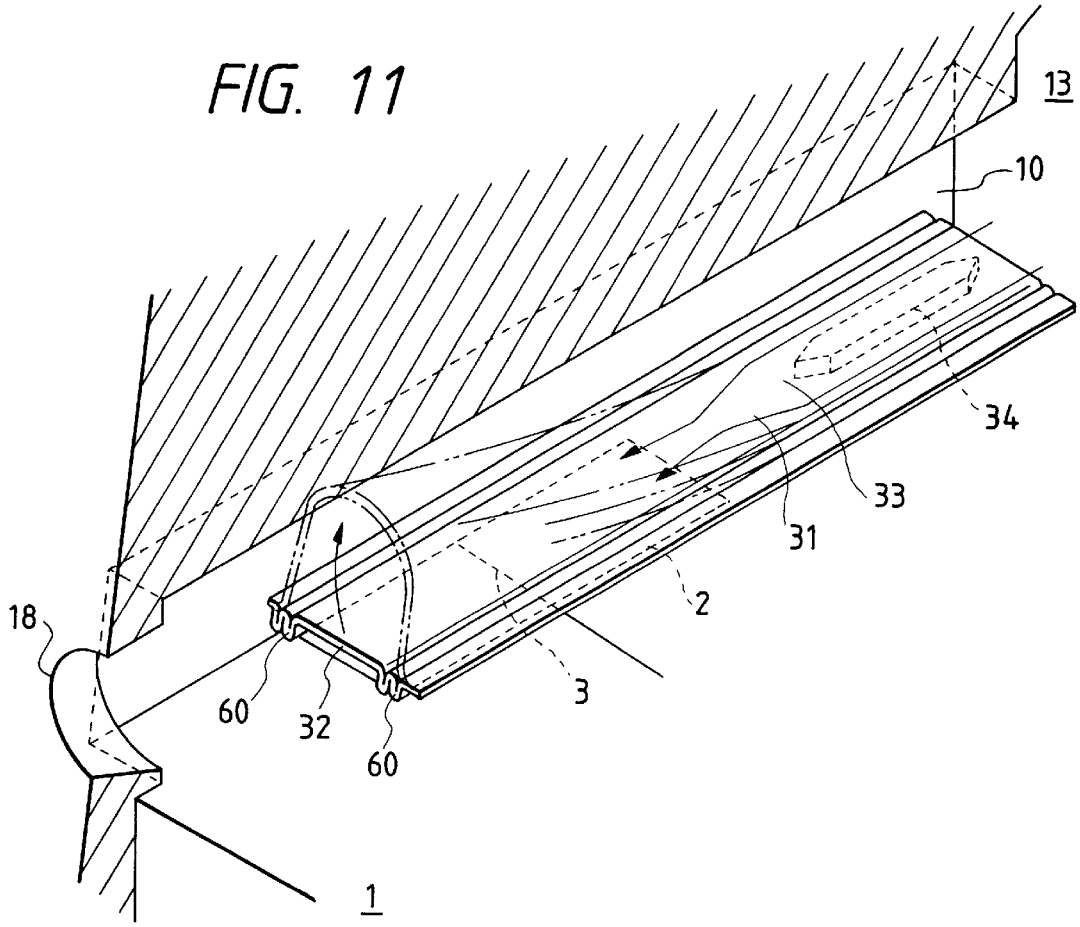
FIG. 11 is a partial fragmental perspective view of a liquid discharging head according to a fourth embodiment of the present invention.

FIG. 11 shows one of fundamental conceptions of the present invention associated with a fourth embodiment of the present invention. FIG. 11 shows a positional relation between a bubble generating area in a liquid passage, a bubble generated in the area and a movable member, and shows an embodiment in which the liquid discharging method and the refilling method in the liquid discharging head of the present invention can easily be understood.

In the former embodiments, the prompt displacement of the movable member and the movement of the bubble are concentrated to the discharge port by concentrating the pressure of the generated bubble to the free end of the movable member. To the contrary, in this fourth embodiment, the downstream portion of the bubble near the discharge port (directly associated with the liquid discharging) is regulated by the free end of the movable member, while permitting free growth of the bubble.

In FIG. 11, comparing with FIG. 2 (first embodiment), in this fourth embodiment, there is no protruded portion or barrier (shown by the hatched area in FIGS. 1A, 1B, 1C and 1D) disposed at a downstream side of the bubble generating area on the element substrate 1 shown in FIG. 2. That is to say, the free end of the movable member 31 is opened not to substantially cloth or seal the bubble generating area with respect to the discharge port.

In this embodiment, since the growth of a downstream tip end portion of the downstream bubble portion which is directly associated with the liquid discharging is permitted, the pressure component of the tip end bubble portion can be used for the liquid discharging effectively. In addition, since the free end 32 of the movable member 31 causes the pressure directing upwardly of the downstream bubble portion (components of forces V2, V3, V4 in FIG. 5) to help the growth of the downstream bubble portion, the discharging efficiency can be improved, as is in the former embodiments. In this embodiment, the response to the energization of the heat generating element is superior to those in the former embodiments.

Further, in this embodiment, since the construction is simple, the manufacture of the head can be facilitated.

The fulcrum 33 of the movable member 31 in this embodiment is secured to a single base 34 having a width smaller than that of the movable member 31. Accordingly, during the disappearance of the bubble, the liquid is supplied through both sides of the base 34 (as shown by the arrows). The base 34 may have any configuration so long as the liquid can be supplied.

In the illustrated embodiment, since the liquid flow from the above into the bubble generating area 11 during the disappearance of the bubble is controlled by the presence of the movable member 31, the refill of the liquid is superior to the refill in the conventional bubble generating structure only having a heat generating element. Of course, with the arrangement as mentioned above, the retard amount of the meniscus can be reduced. Further, since both sides of the free end 32 of the movable member 31 is substantially sealed by the expansion/contraction portions 60 with respect to the bubble generating area 11, as mentioned above, the pressure direction laterally of the movable member 31 can be oriented to help the growth of the bubble, thereby further improving the discharging efficiency.

(Fifth Embodiment)

Figure 12:
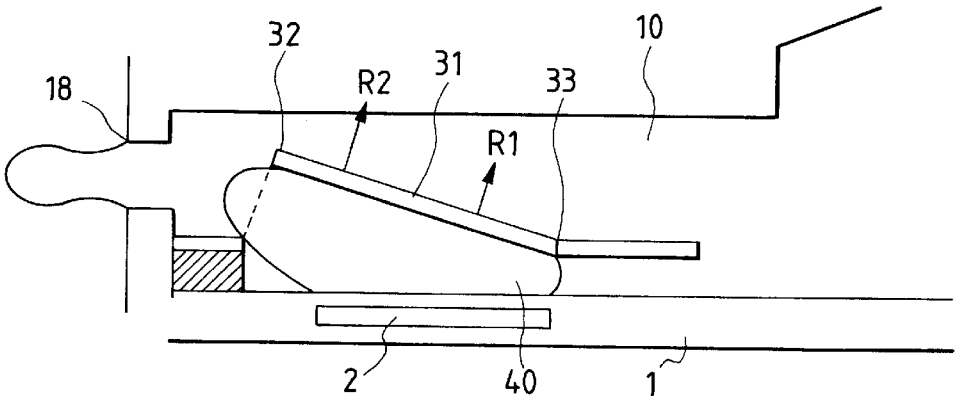
FIG. 12 is a sectional view of a liquid discharging head according to a fifth embodiment of the present invention.

A fifth embodiment of the present invention shows an example that the liquid discharging force obtained by the mechanical displacement is further improved. FIG. 12 is a sectional view of a liquid discharging head according to the fifth embodiment. In FIG. 12, the movable member 31 extends so that the free end 32 of the movable member 31 is positioned at a downstream side of the heat generating element 2. With this arrangement, a displacement speed of the movable member 31 at the free end 32 can be increased, and the formation of the discharging force can be further improved by the displacement of the movable member 31.

Further, since the free end 32 is positioned nearer to the discharge port 18 than the former embodiments, the growth of the bubble 40 can be concentrated to a more stable direction, thereby obtaining the good discharging.

Further, in response to a bubble growing speed of a center of the pressure of the bubble 40, the movable member 31 is displaced at a displacement speed of R1, and, the free end 32 remote from this position with respect to the fulcrum 33 is displaced at a displacement speed of R2 faster than the speed R1. Thus, the high speed liquid flow acts on the free end to cause the movement of liquid, thereby improving the discharging efficiency.

In addition, since the free end 32 has a configuration perpendicular to the liquid flow as is in FIG. 11, the pressure of the bubble and the mechanical action of the movable member 31 contribute to the liquid discharging efficiently.

(Sixth Embodiment)

Figure 13A:
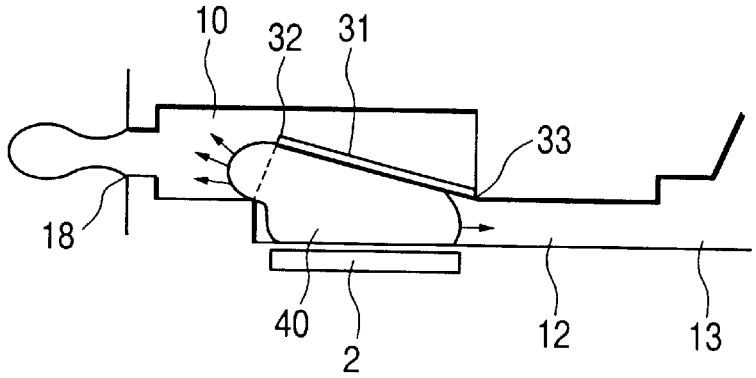
FIGS. 13A, 13B and 13C are schematic sectional views of a liquid discharging head according to a sixth embodiment of the present invention.
Figure 13B:
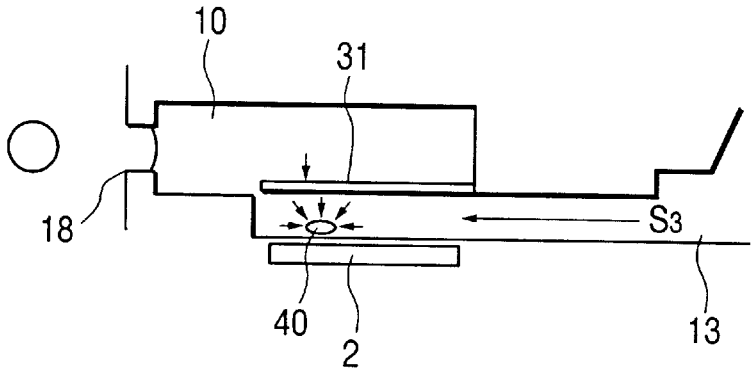
Figure 13C:
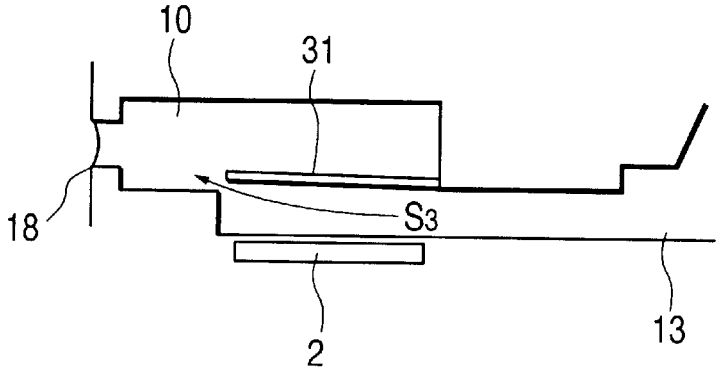

FIGS. 13A, 13B and 13C show a sixth embodiment of the present invention.

Unlike to the former embodiments, in the sixth embodiment, the area directly communicated with the discharge port 18 is not communicated with the common liquid chamber 13, thereby facilitating a structure.

The liquid is supplied only through the liquid supply passage 12 along the surface of the movable member 31 facing to the bubble generating area 11. The positional relation between the free end 32 and the fulcrum 33 of the movable member 31 and the discharge port 18, and the structure of the movable member facing to the heat generating element 2 are the same as the previous embodiments.

In this embodiment, although the above-mentioned advantages such as improvement of discharging efficiency and liquid supplying ability can be obtained, particularly, the retard of the meniscus is suppressed, and the forcible refill is performed by the liquid from the common liquid chamber by utilizing negative pressure during the disappearance of the bubble.

FIG. 13A shows a condition that the bubble is formed in the liquid by the heat generating element 2, and FIG. 13B shows a condition that the bubble is being disappeared. In this condition, the movable member 31 is being returned to its initial position and the forcible refill as shown by the arrow S3 is performed.

FIG. 13C shows a condition that minute retard of the meniscus caused when the movable member 31 is returned to its initial position is compensated by the liquid near the discharge port 18 by a capillary phenomenon after the bubble is disappeared.

(Seventh Embodiment)

In a seventh embodiment of the present invention, the liquid passage has a multi-passage structure so that the liquid in which the bubble is formed by applying the heat (bubble liquid) can be isolated from the liquid to be discharged (discharge liquid).

Figure 14:
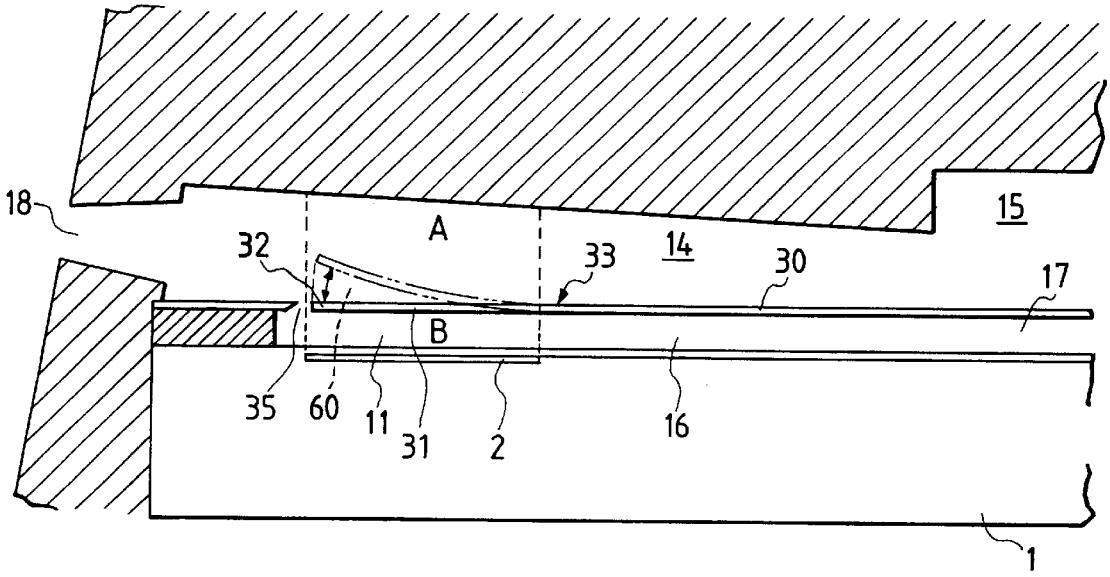
FIG. 14 is a sectional view of a liquid discharging head (two liquid passages) according to a seventh embodiment of the present invention.

FIG. 14 is a schematic sectional view of a liquid passage of a liquid discharging head according to the seventh embodiment.

The liquid discharging head according to this embodiment includes an element substrate 1 on which a heat generating element 2 for applying thermal energy for forming a bubble in the liquid is arranged, a second liquid passage 16 for the bubble liquid disposed on the element substrate 1, and a first liquid passage 14 for the discharge liquid directly communicated with the discharge port 18 and disposed above the second liquid passage.

An upstream side portion of the first liquid passage 14 is communicated with a first common liquid chamber 15 for supplying the discharge liquid to a plurality of first liquid passages 14, and an upstream side portion of the second liquid passage 16 is communicated with a second common liquid chamber 17 for supplying the bubble liquid to a plurality of second liquid passages 16. However, when the same liquid is used both as the bubble liquid and as the discharge liquid, a single common liquid chamber may be used.

A separation wall 31 is disposed between the first liquid passage 14 and the second liquid passage 16 to isolate the first liquid passage 14 from the second liquid passage 16. Incidentally, when the mixing between the bubble liquid and the discharge liquid is desired to prevent as much as possible, the liquid in the first liquid passage 14 is isolated from the liquid in the second liquid passage 16 by the separation wall 30 as much as possible; whereas, when the bubble liquid and the discharge liquid may be mixed to some extent, the separation wall 30 may not have the perfect separation function.

A portion of the separation wall 30 positioned in an upper projection space regarding the heat generating element 2 (referred to as "discharge pressure generating area" hereinafter; an area A and area B of the bubble generating area 11 in FIG. 14) constitutes a movable member 31 having a free end 32 opened toward the discharge port 18 (i.e., toward a downstream side in the liquid flowing direction) through a slit 35, side expansion/contraction portions 60, and a fulcrum 33 disposed at the common liquid chamber (15, 17) side. Since the movable member 31 is disposed in a confronting relation to the bubble generating area 11 (B), the movable member is moved (as shown by the arrow) by the bubble in the bubble liquid to be opened toward the discharge port 18 in the first liquid passage 14.

The positional relation between the fulcrum 33 and the free end 32 of the movable member 31 and the heat generating element 2 are the same as the former embodiments.

Further, while the structural relation between the liquid supply passage 12 and the heat generating element 2 was explained in the previous embodiments, also in this embodiment, a structural relation between the second liquid passage and the heat generating element 2 is the same as the above-mentioned structural relation.

Next, an operation of the liquid discharging head according to this embodiment will be explained with reference to FIGS. 15A and 15B.

Regarding the operation of the head, as the discharge liquid supplied to the first liquid passage 14 and the bubble liquid supplied to the second liquid passage 16, the same water-base ink is used.

When the bubble liquid in the bubble generating area 11 in the second liquid passage 16 is subjected to the heat from the heat generating element 2, as is in the former embodiments, a bubble 40 is formed in the bubble liquid by film-boiling phenomenon as disclosed in U.S. Pat. No. 4,723,129.

Figure 15A:
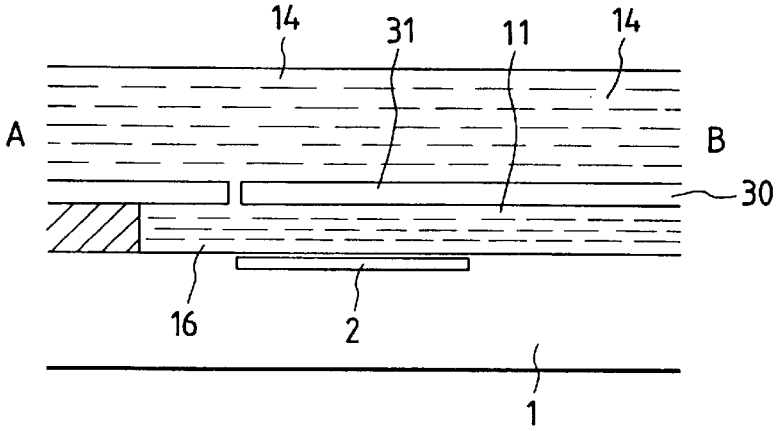
FIGS. 15A and 15B are views showing an operation of a movable member in the seventh embodiment of the present invention.
Figure 15B:
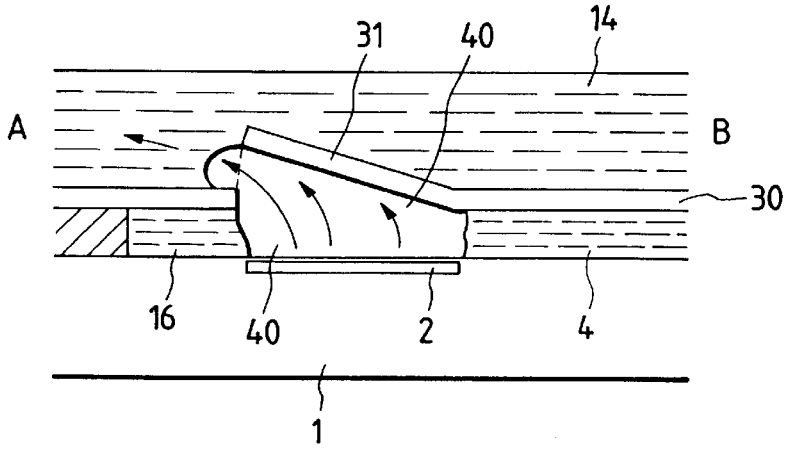

In this embodiment, since the bubble pressure cannot escape except through the upstream side of the bubble generating area 11, the pressure caused by the formation of the bubble is concentrated and transmitted toward the movable member 31, so that, as the bubble 40 is growing, the movable member 31 is displaced from a condition shown in FIG. 15A to a condition shown in FIG. 15B toward the first liquid passage 14. This movement of the movable member 31 causes the second liquid passage 16 to greatly communicate with the first liquid passage 14, with the result that the pressure of the bubble 40 is transmitted to a direction toward the discharge port in the first liquid passage 14 (i.e., direction A). The liquid is discharged from the discharge port 18 by such transmission of the pressure and the mechanical displacement of the movable member 31.

Then, as the bubble 40 is being disappeared, the movable member 31 is returned to condition shown in FIG. 15A, and, in the first liquid passage 14, the discharge liquid corresponding to an amount of the discharged liquid is supplied from the common liquid chamber 15. Also in this embodiment, since the supply of the discharge liquid is effected toward a direction for closing the movable member 31 as is in the former embodiments, the refill of the discharge liquid is not prevented by the movable member 31.

While function and advantage regarding the transmission of the bubble pressure due to the displacement of the movable member 31, the growing direction of the bubble 40 and the prevention of the back-wave in this embodiment are the same as the first embodiment, the two-liquid passage structure of this embodiment further provides the following advantages.

That is to say, according to the arrangement of this embodiment, since the discharge liquid and the bubble liquid are isolated from each other, the discharge liquid can be discharged by the pressure of the bubble formed in the bubble liquid. Thus, even when high-viscous liquid in which a bubble is not adequately formed and provides only poor discharging force is used, by supplying such high-viscous liquid in the first liquid passage 14 and by supplying liquid in which a bubble can easily be formed in the second liquid passage 16, the good discharging can be achieved.

Further, by selecting liquid in which deposit due to heat is not accumulated on the surface of the heat generating element 2 as the bubble liquid, the formation of the bubble can be stabilized and good discharging can be achieved.

In addition, since the head according to this embodiment provides the advantages same as the former embodiments, the liquid such as high-viscous liquid can be discharged with high discharging efficiency and high discharging force.

Further, even when liquid having poor resistance to heat is used, by supplying such liquid in the first liquid passage 14 and by supplying liquid having good resistance to heat and facilitating the formation of the bubble in the second liquid passage 16, the liquid can be discharged with high discharging efficiency and high discharging force and without thermal damage of the liquid.

(Eighth Embodiment)

In the former embodiments, while an example that both sides of the movable member is constituted by the expansion/contraction portions formed from the flexible thin diaphragm was explained, the expansion/contraction portions are not limited to the bellows-type thin diaphragm, but may be formed from plate-shaped walls. Now, an example that a movable member having plate-shaped side members is used will be explained with reference to FIGS. 16, 17A, 17B, 18A and 18B.

Figure 16:
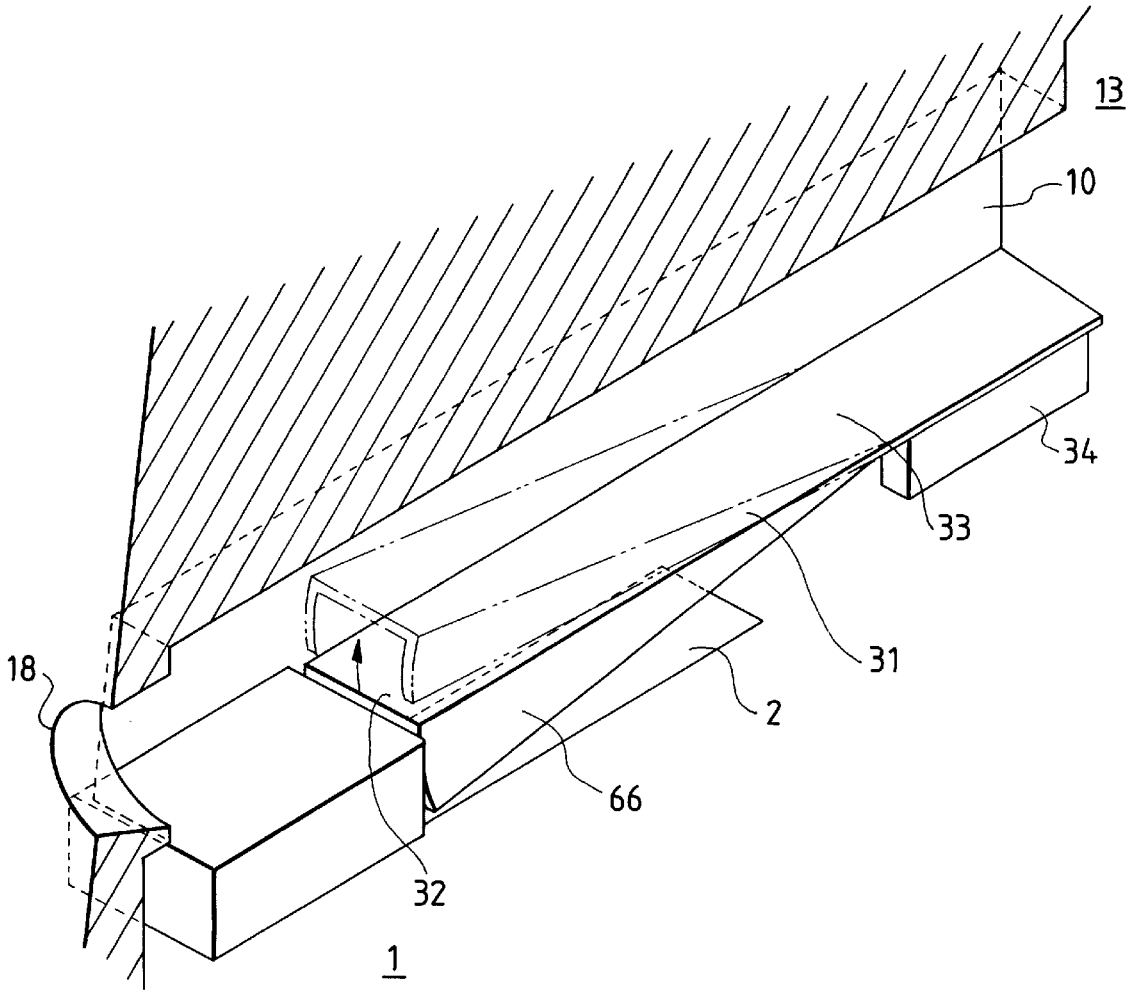
FIG. 16 is a partial fragmental perspective view of a liquid discharging head according to an eighth embodiment of the present invention.
Figure 17A:
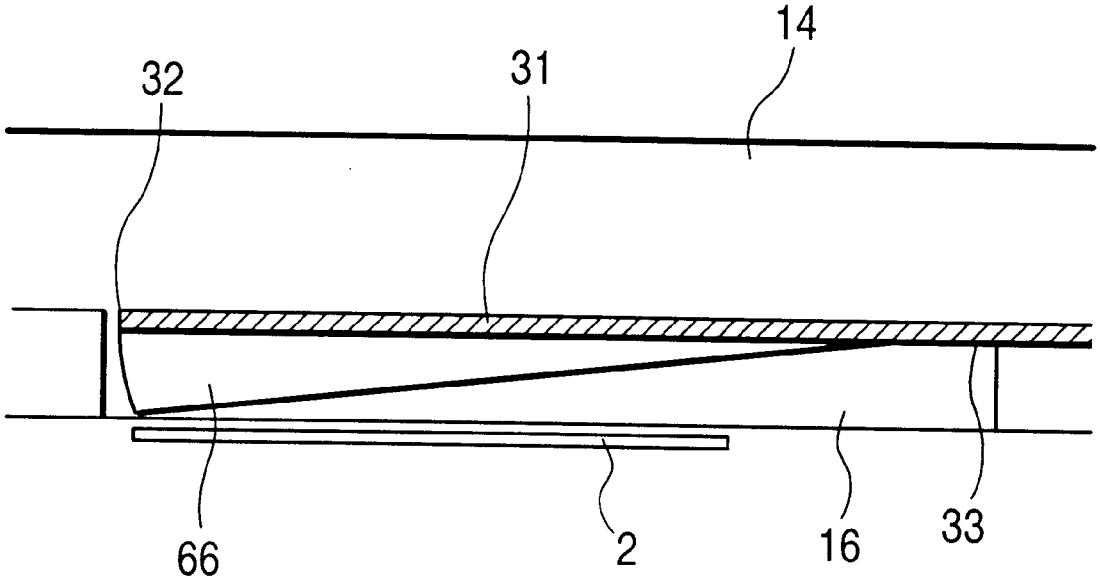
FIGS. 17A and 17B are schematic sectional views of a liquid passage of the liquid discharging head of FIG. 16.
Figure 17B:
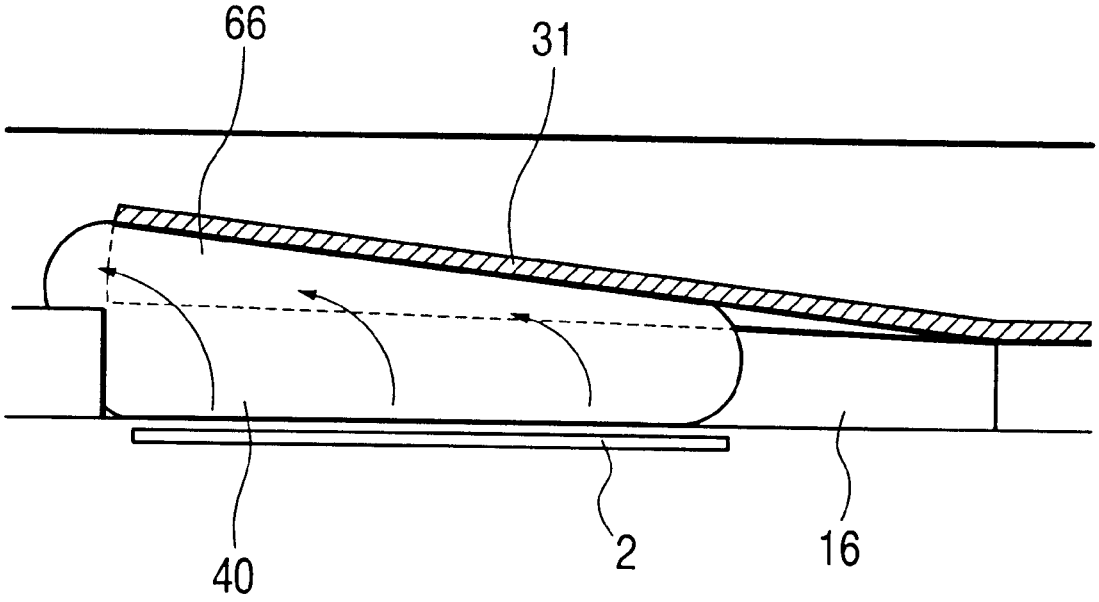
Figure 18A:
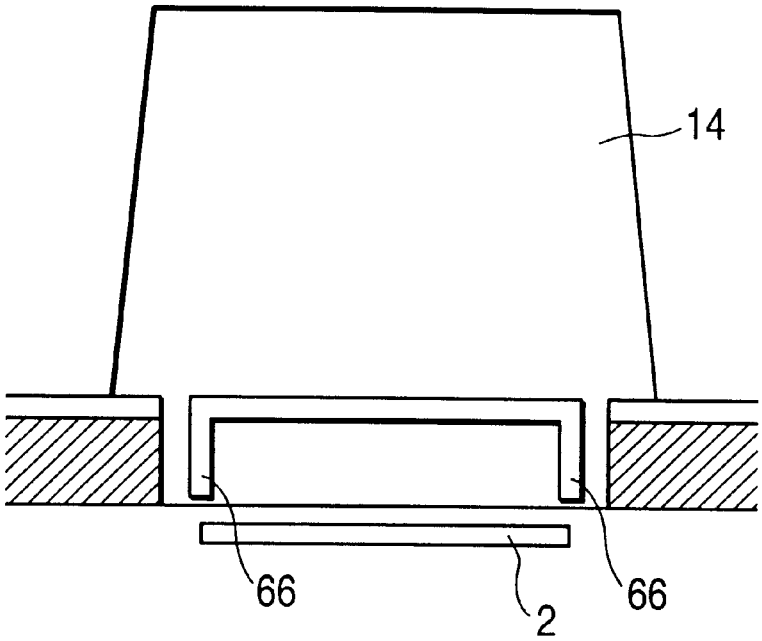
FIGS. 18A and 18B are schematic sectional views of the liquid discharging head of FIG. 16, looked at from a discharge port side.
Figure 18B:
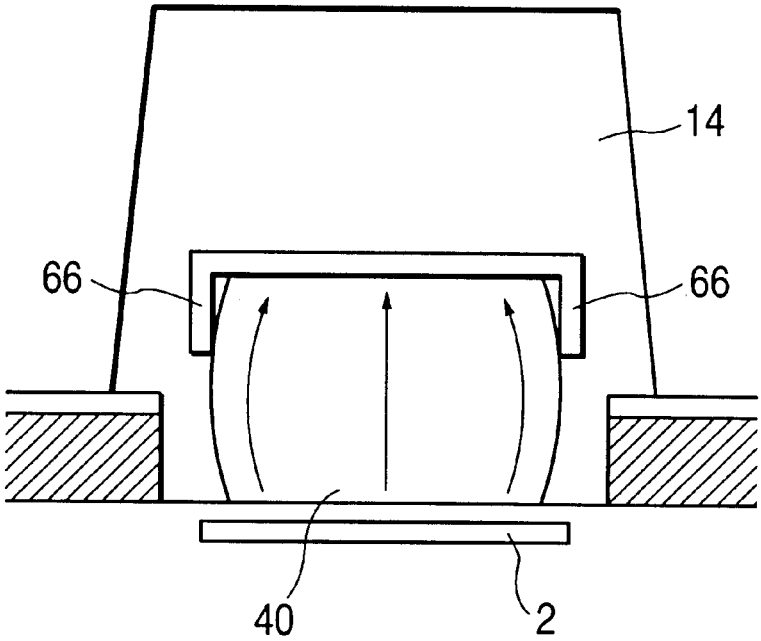

FIG. 16 is a partial fragmental perspective view of a liquid discharging head according to an eighth embodiment of the present invention. Further, FIGS. 17A and 17B are schematic sectional views of a liquid passage structure of the liquid discharging head of FIG. 16, and FIGS. 18A and 18B are schematic sectional views of the liquid discharging head of FIG. 16, looked at from a discharge port side.

A movable member 31 formed from material having elasticity such as metal is provided on an element substrate 1 of a liquid passage 10 in a cantilever fashion and in a confronting relation to a heat generating element 2. The movable member 31 has a flat upper surface, and plate-shaped side walls 66 are protruded from both sides of the upper surface toward the element substrate 1. One end of the movable member 31 is secured to bases 34 formed by patterning photosensitive resin on the wall of the liquid passage and the element substrate 1. With this arrangement, the movable member 31 is held and has a fulcrum 33. The movable member 31 is disposed above the heat generating element 2 by a predetermined distance and in a confronting relation to the heat generating element 2 to cover the heat generating element 2 so that the fulcrum 33 of the movable member is disposed at an upstream side in great liquid flow (caused by the liquid discharging) flowing from a common liquid chamber 13 through the movable member 31 to a discharge port 18 and the free end is disposed at a downstream side of the fulcrum 33. Further, a height of each side wall 66 is smaller than a height of the second liquid passage 16, and, in a condition that the movable member 31 is not displaced, a bottom wall of the first liquid passage 14 including the upper surface of the movable member 31 is smooth.

Figure 23A:
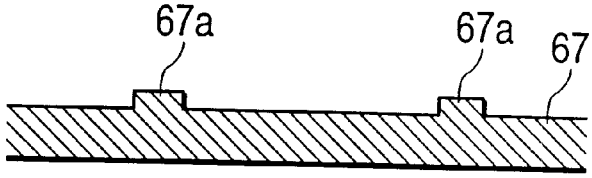
FIGS. 23A, 23B, 23C, 23D and 23E are schematic sectional views of a liquid passage of the liquid discharging head of FIGS. 22A and 22B.
Figure 23B:
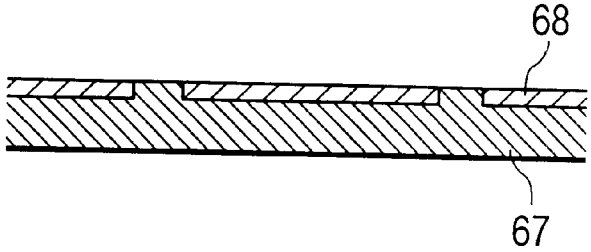
Figure 23C:
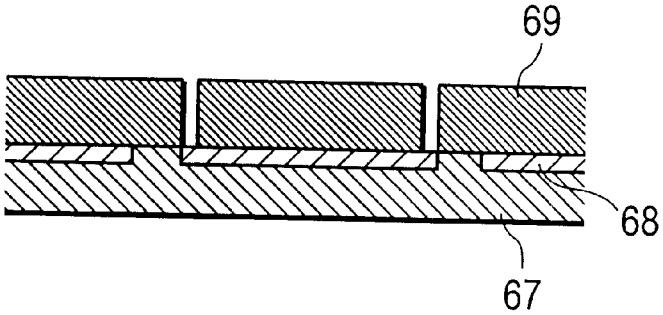
Figure 23D:
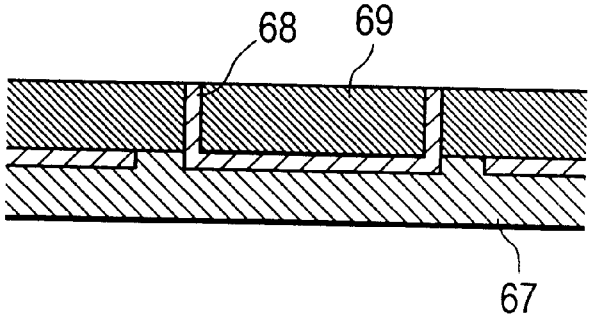
Figure 23E:
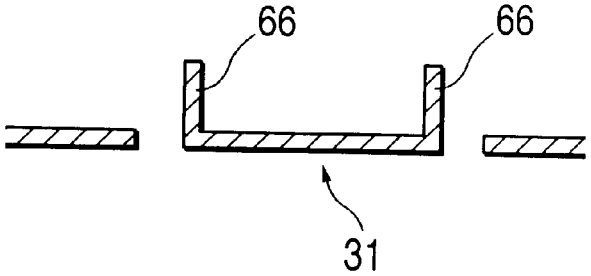

Now, an example of a method for manufacturing the movable member 31 having the side walls 66 will be described with reference to FIGS. 23A, 23B, 23C, 23D and 23E. Here, an electroforming method will be explained. First of all, as shown in FIG. 23A, a master mold 67 having projections 67*a* each having a height equal to a thickness of the movable member 31 and spaced apart from each other by a distance corresponding to a width of the upper surface of the movable member 31 is prepared. Then, as shown in FIG. 23B, the master mold 67 is subjected to electro-plating to form nickel layers 68 on the master mold 67. A thickness of each nickel layer 68 is equal to the height of each projection 67*a* of the master mold 67. Then, as shown in FIG. 23C, regist 69 is patterned on the master mold 67 on which the nickel layers 68 were formed, except portions corresponding to the side walls 66. A thickness of the regist 69 is equal to a height of each side wall 66 of the movable member 31. Then, the electro-plating is effected again to grow the nickel layer 68 as shown in FIG. 23D. Thereafter, the regist 69 is removed and the nickel layers 68 are peeled from the master mold 67, thereby obtaining the movable member 31 having the side walls 66.

With the arrangement according to this embodiment, as the bubble 40 is growing, the free end 32 of the movable member 31 is gradually displaced. In this case, as shown in FIGS. 17B and 18B, since both sides of the bubble 40 is covered by the side walls 66, the pressure transmitting direction of the bubble 40 and the growing direction of the bubble are regulated to a direction toward the free end 32, i.e., toward the discharge port 18. Particularly, by providing side walls 66 having rigidity against the pressure of the bubble 40, the release of pressure other than the direction toward the discharge port is suppressed during the displacement of the movable member 31, with the result that, since the bubble pressure can be oriented toward the discharge port more effectively, the pressure of the bubble 40 contributes to the liquid discharging more efficiently. Further, since the transmission of pressure in the lateral direction is suppressed by the side walls 66, the side walls 66 can serve as separation walls for isolating adjacent first liquid passages 14, thereby eliminating the additional separation walls. Thus, the liquid discharging head can be simplified and can be made cheaper.

(Ninth Embodiment)

Figure 19:
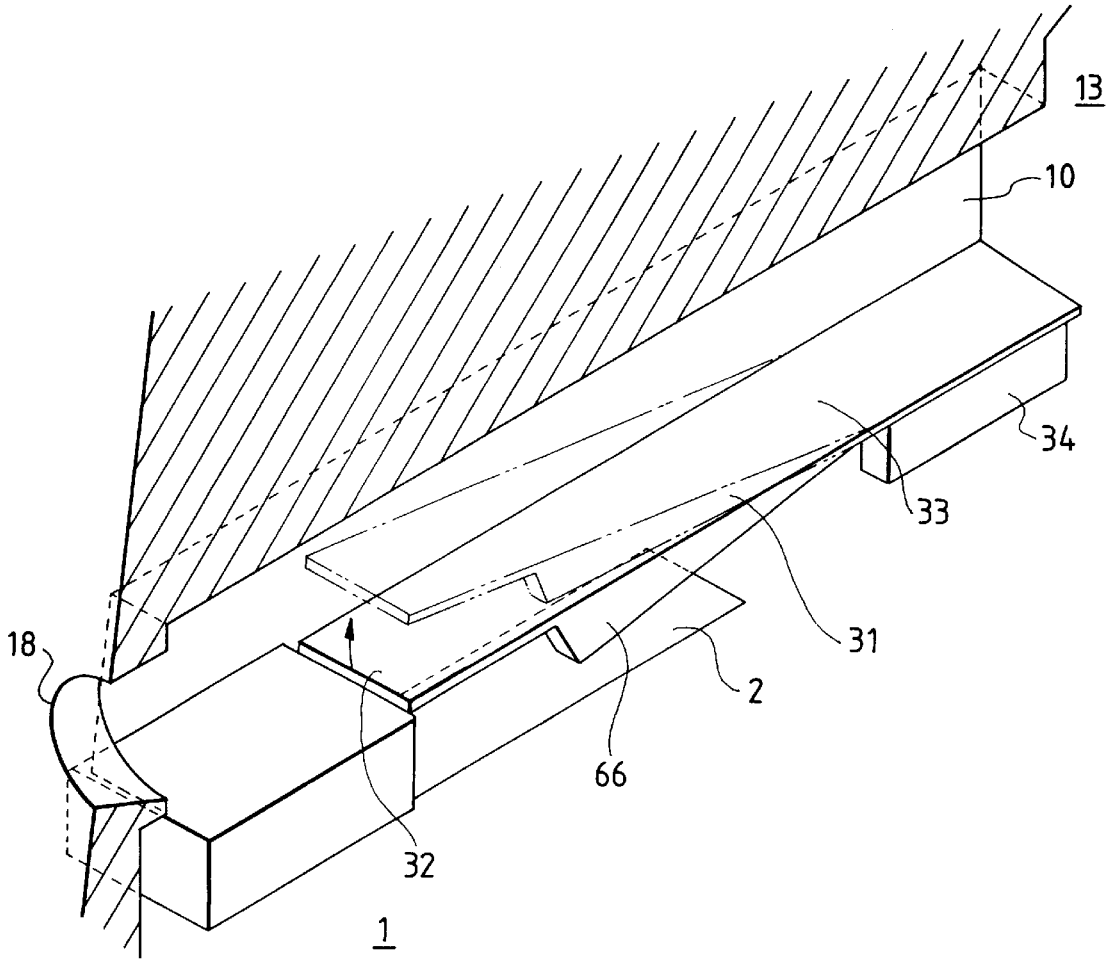
FIG. 19 is an explanatory view showing an example of a method for manufacturing a movable member of the liquid discharging head of FIG. 16.
Figure 20A:
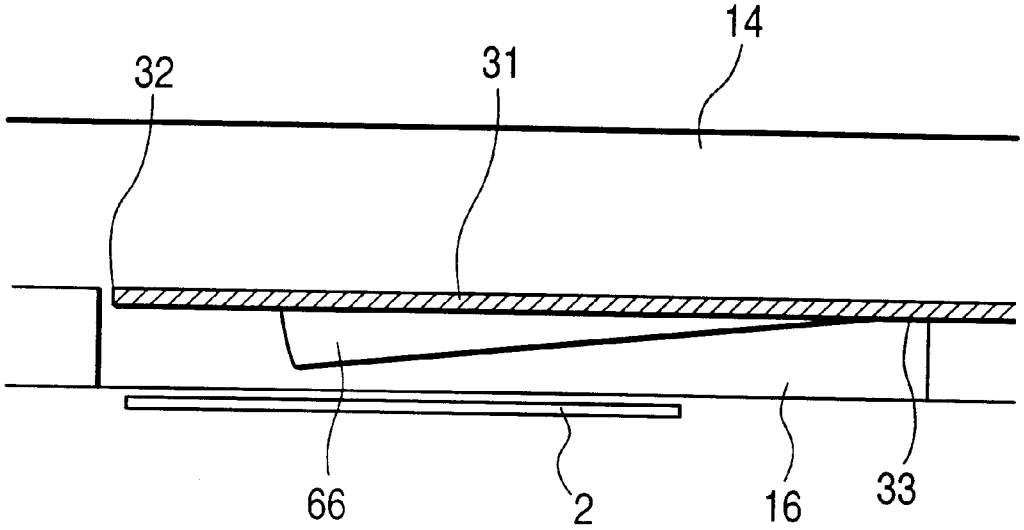
FIGS. 20A and 20B are partial fragmental perspective views of a liquid discharging head according to a ninth embodiment of the present invention.
Figure 20B:
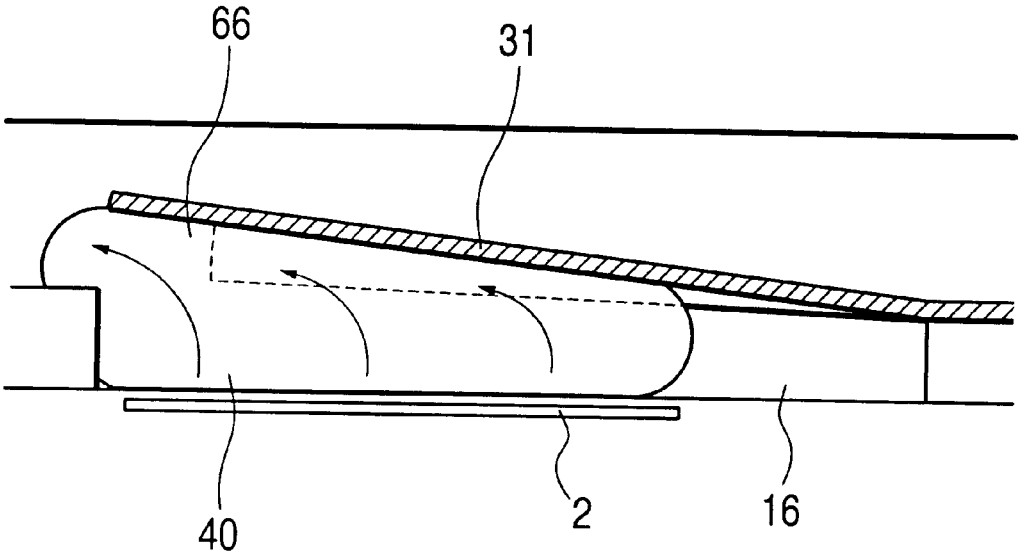

FIG. 19 is a partial fragmental perspective views of a liquid discharging head according to a ninth embodiment of the present invention. FIGS. 20A and 20B are schematic sectional view of a liquid passage structure of the liquid discharging head of FIG. 19.

As is in the eighth embodiment, also in this embodiment, although side members are constituted by plate-shaped side walls 66, the side walls 66 are disposed on both sides of the movable member 31 near the fulcrum 33, except for side portions near the free end 32. Since the other construction is the same as that of the eighth embodiment, explanation thereof will be omitted. With the above-mentioned arrangement, since a center of gravity of the movable member 31 more approaches to the fulcrum 33, the displacement of the movable member 31 can be more facilitated. Further, the bubble pressure loss at a downstream side of the heat generating element 2 can be suppressed.

(Tenth Embodiment)

Figure 21:
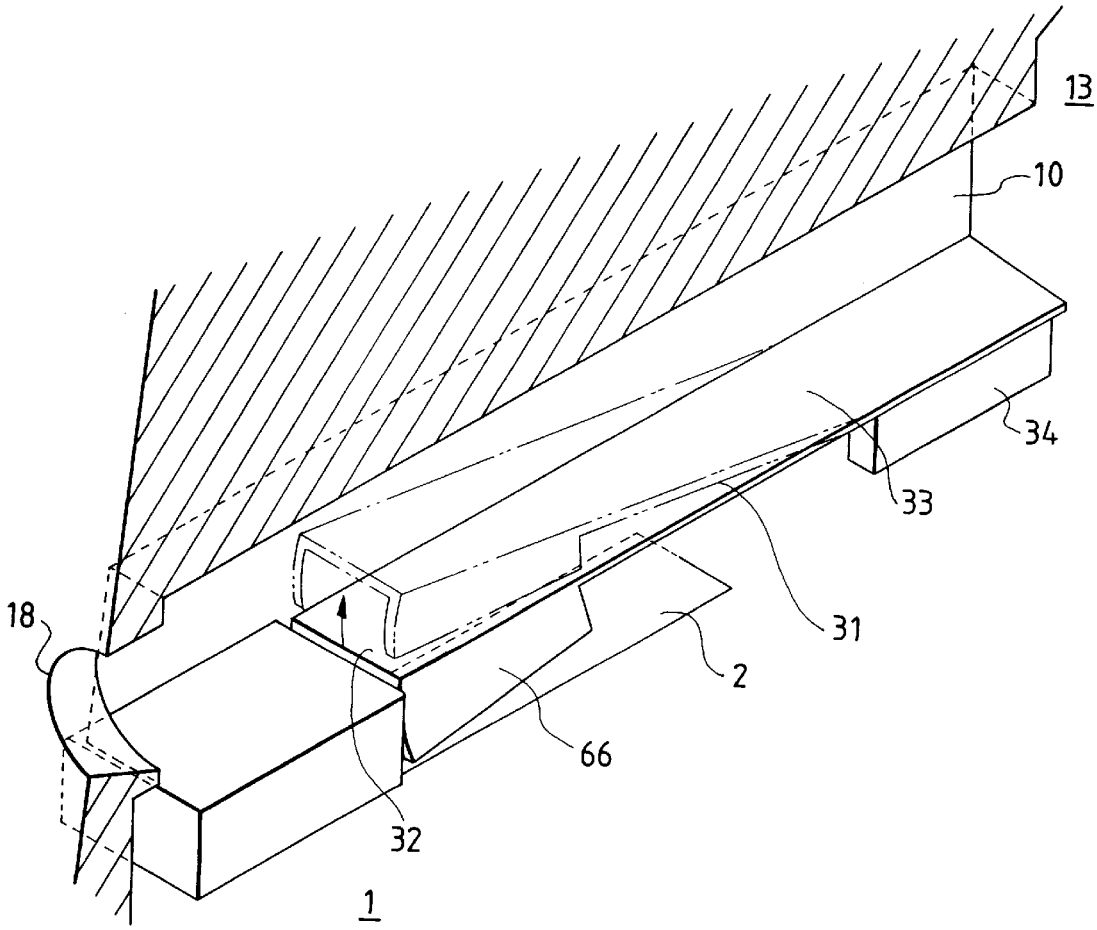
FIG. 21 is a schematic sectional view of a liquid passage of the liquid discharging head of FIGS. 20A and 20B.
Figure 22A:
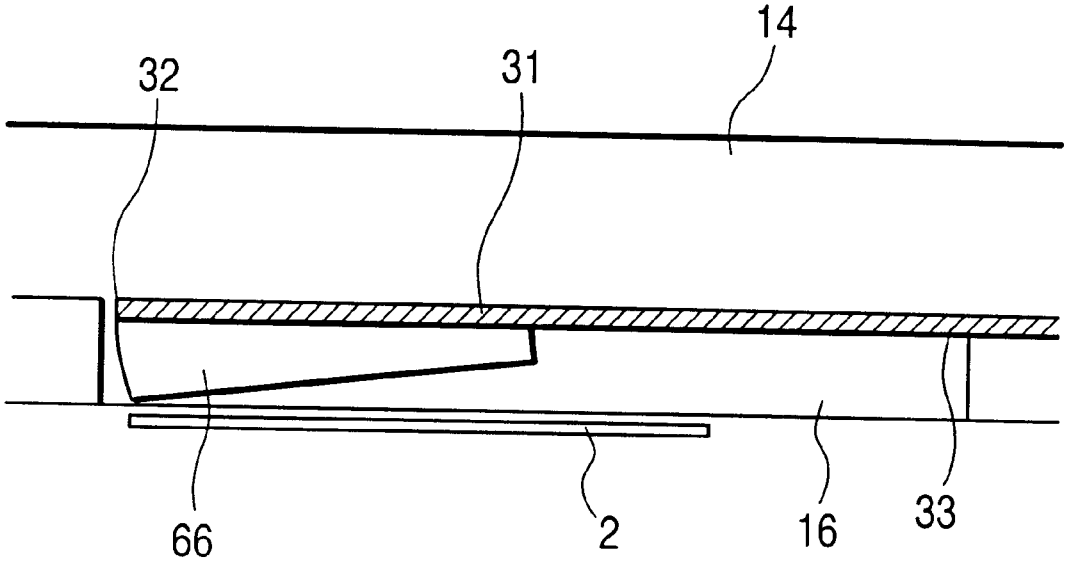
FIGS. 22A and 22B are partial fragmental perspective views of a liquid discharging head according to a tenth embodiment of the present invention.
Figure 22B:
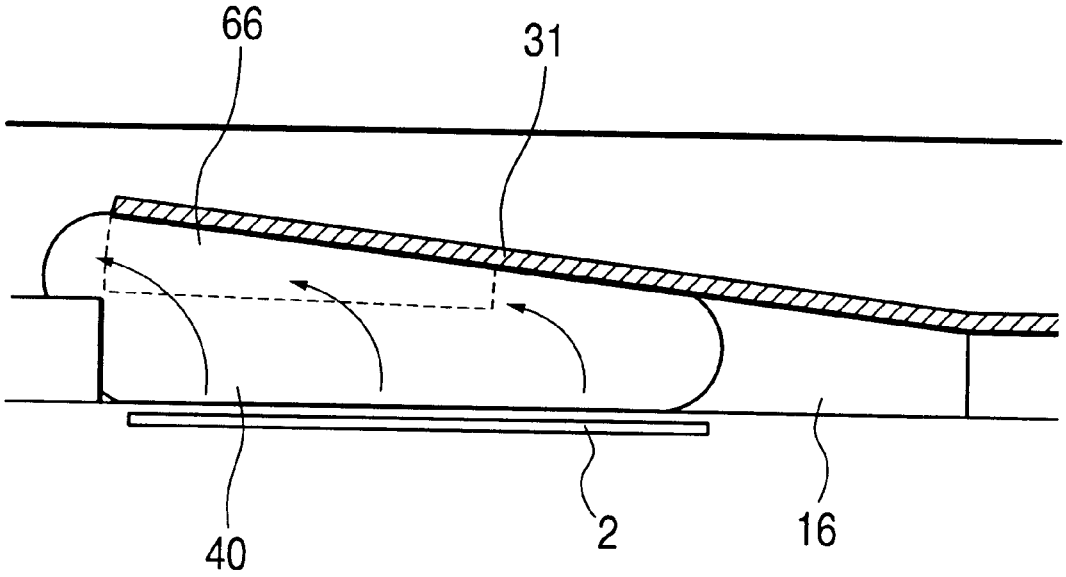

FIG. 21 is a partial fragmental perspective views of a liquid discharging head according to a tenth embodiment of the present invention. FIGS. 22A and 22B are schematic sectional views of a liquid passage structure of the liquid discharging head of FIG. 21.

As is in the eighth embodiment, also in this embodiment, although side members are constituted by plate-shaped side walls 66, the side walls 66 are disposed on both sides of the movable member 31 near the free end 32, except for side portions near the fulcrum 33. Since the other construction is the same as that of the eighth embodiment, explanation thereof will be omitted. With the above-mentioned arrangement, the refill of the liquid from the both sides of the movable member 31 can be improved, while directing the pressure transmitting direction of the bubble and the growing direction of the bubble toward the discharge port 18.

(Eleventh Embodiment)

Now, an eleventh embodiment of the present invention will be explained with reference to the accompanying drawings. This embodiment shows an example that a nozzle structure is used to improve the refill ability.

Figure 45:
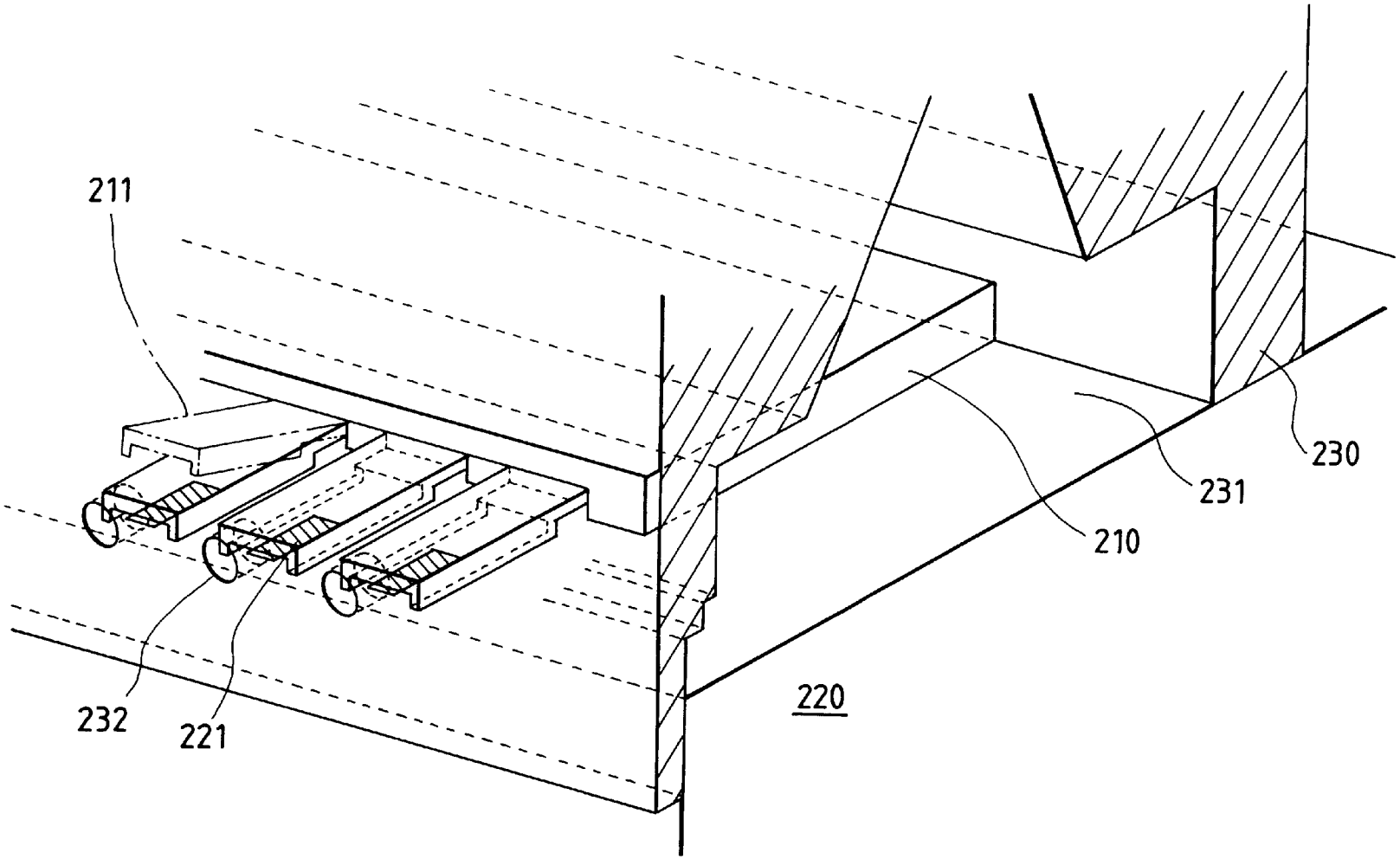
FIG. 45 is a schematic perspective view of a liquid discharging head according to an eleventh embodiment of the present invention.

FIG. 45 schematically shows a liquid discharging head according to the eleventh embodiment. In FIG. 45, a movable wall support member 210 and movable walls 211 supported by the movable wall support member are joined to an element substrate 220 on which discharge energy generating elements 221 (heat generating resistance bodies having a dimension of 40 $\mu$m×105 $\mu$m, for example, in the illustrated embodiment) for generating discharge energy for discharging the liquid is disposed, thereby forming liquid passages corresponding to the discharge energy generating elements 221.

Figure 46A:
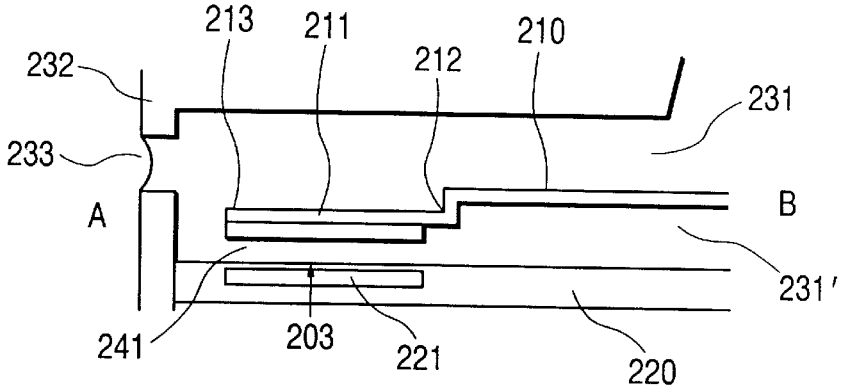
FIGS. 46A, 46B, 46C and 46D are schematic sectional views of a liquid passage of the liquid discharging head of FIG. 45.
Figure 46B:
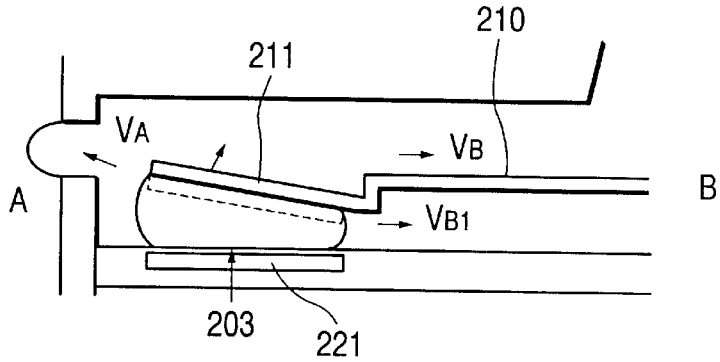
Figure 46C:
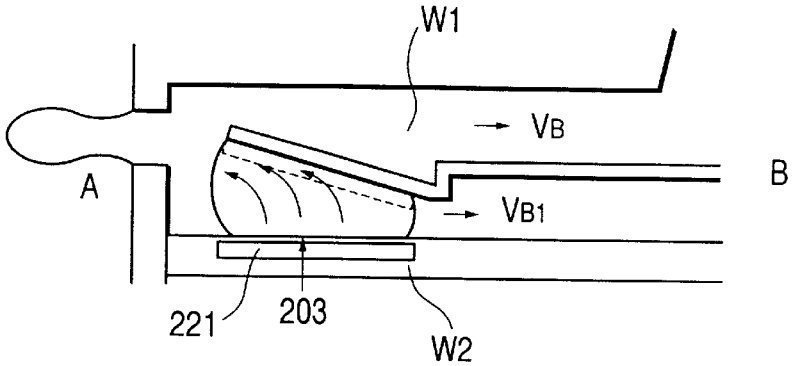
Figure 46D:
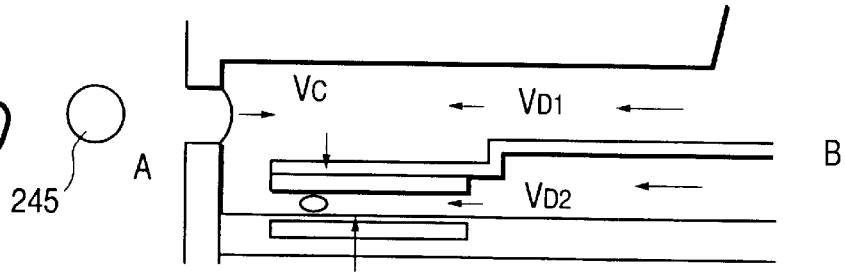
Figure 47:
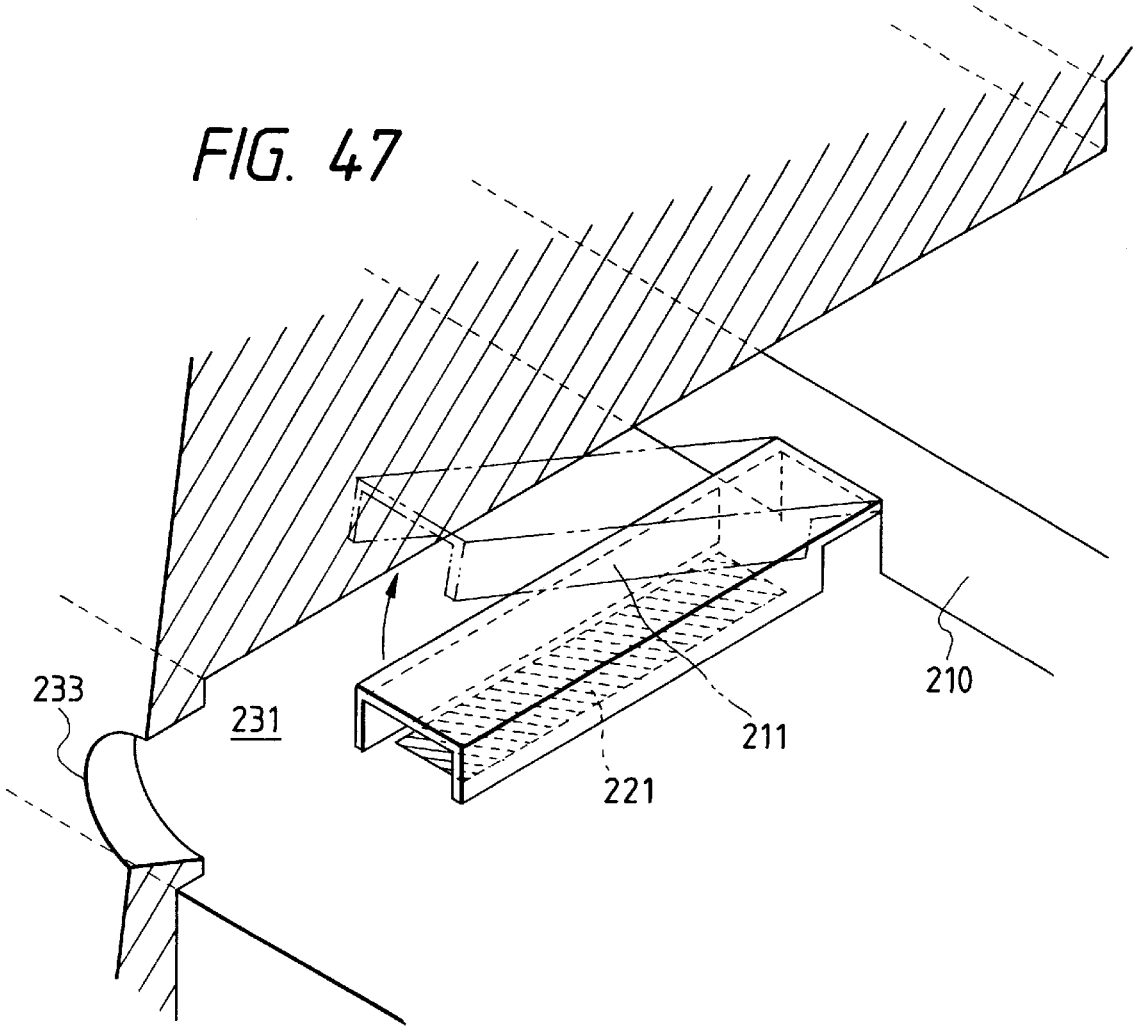
FIG. 47 is a partial fragmental perspective view of the liquid discharging head of FIG. 45.

Each movable wall 211 is disposed in a confronting relation to the corresponding discharge energy generating element 221 and has a supported one end and the other end constituting a free end. The free end is displaced by pressure caused by a bubble generated by the discharge energy generating element 221. The movable wall 211 is made of material having elasticity such as metal and has an inverted U-shaped cross-section to form a discharge liquid passage to cover the discharge energy generating element 221. In the illustrated embodiment, the liquid passage includes a liquid chamber (231' in FIG. 46A) defined by a part of the movable wall support member 210, and a bubble liquid passage communicated with the liquid chamber and defined by the movable wall 211, thereby providing a nozzle structure wherein, only when the bubble is formed by the discharge energy generating element 221, the free end of the movable wall 211 is displaced to communicat with the discharge port, i.e., a structure wherein the discharge port is directly communicated with the common liquid chamber. Here, the sentence "directly communicated with the common liquid chamber" refers to a condition that the displacement areas of the movable walls are not completely isolated by walls for separating the liquid passages from each other, i.e., a condition that areas corresponding to the liquid passages are directly communicated with each other laterally to form a common liquid chamber. Incidentally, with this arrangement, the refill of liquid can be effected very quickly.

A top plate 230 is also joined to the element substrate 220 to cover the movable walls, thereby providing a liquid chamber 231. The liquid chamber 231 is communicated with orifices 232 forming the discharge ports formed in the top plate 230, and, liquid corresponding to an amount of the discharged liquid is supplied from a tank disposed externally of the head, for example. Each orifice 232 is disposed in association with the corresponding discharge energy generating element 221. The liquid chamber 231 is isolated from the liquid chamber (231' in FIG. 46A) defined by the portion of the movable wall support member 210.

(Twelfth Embodiment)

Figure 49:
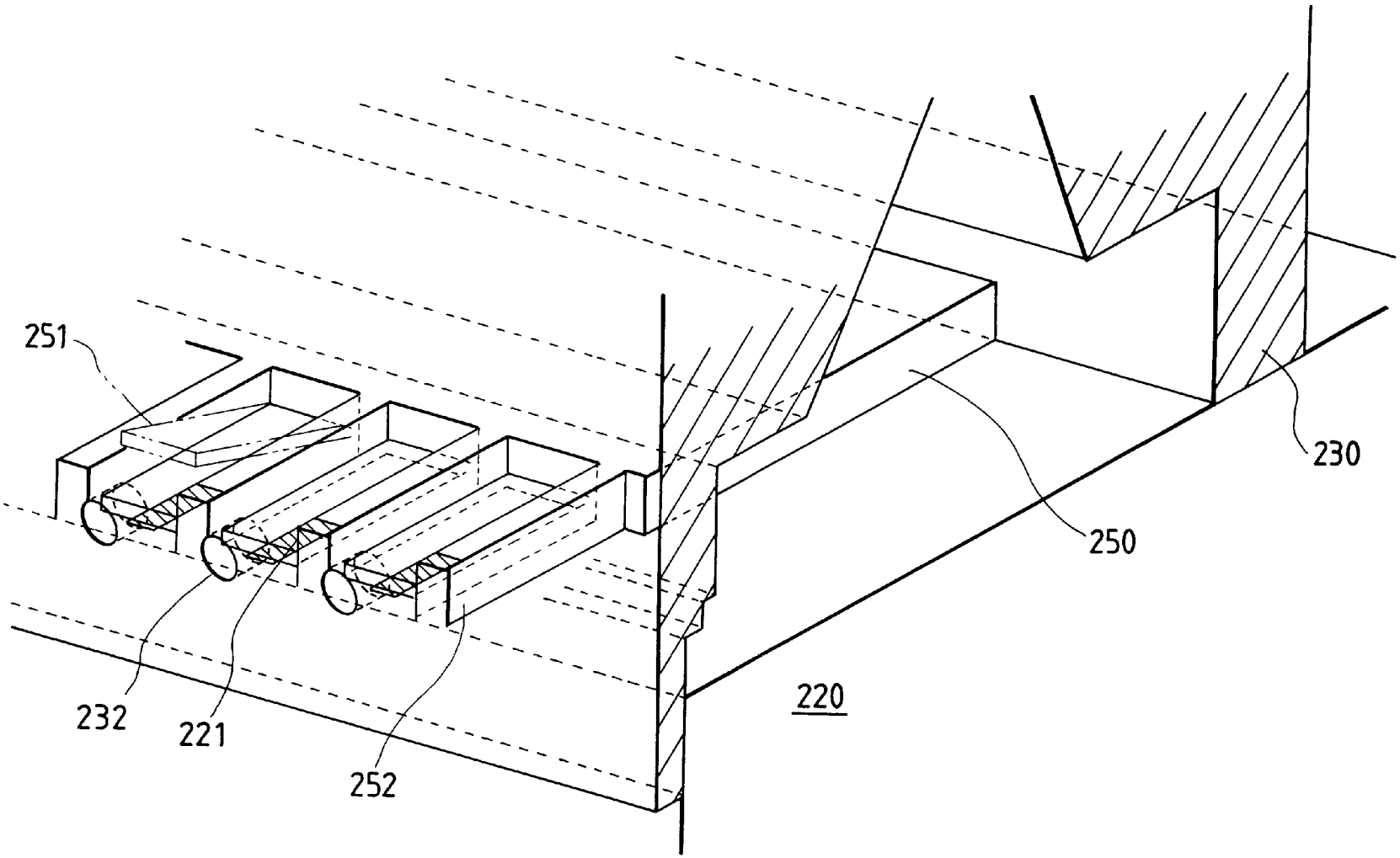
FIG. 49 is a schematic perspective view of a liquid discharging head according to a twelfth embodiment of the present invention.

FIG. 49 schematically shows a liquid discharging head according to a twelfth embodiment of the present invention. In FIG. 49, the same elements as those of the liquid discharging head shown in FIG. 45 are designated by the same reference numerals.

The liquid discharging head according to this embodiment is the same as the eleventh embodiment, except for the movable member.

The movable member is constituted by a movable wall support member 250, movable walls 251 and movable wall side walls 252, and is joined to an element substrate 220 on which discharge energy generating elements 221 for generating discharge energy for discharging the liquid, thereby forming liquid passages corresponding to the discharge energy generating elements 221.

Each movable wall 251 is disposed in a confronting relation to the corresponding discharge energy generating element 221 and has one end supported by the movable wall support member 250 and the other end constituting a free end. The free end is displaced by pressure caused by a bubble generated by the discharge energy generating element 221. The movable wall side walls 252 are integrally formed with the movable wall support member 250 and cooperate with the movable walls 251 to define liquid passages corresponding to the discharge energy generating elements 221. Each movable wall 251 constitutes a ceiling of the corresponding liquid passage and the movable wall side walls 252 constitute side walls of the liquid passage. The liquid passage constituted by the movable wall 251 and the movable wall side walls 252 is communicated with a liquid chamber (231' in FIG. 46A) defined by the movable wall side walls 252. Further, the movable wall 251 and the movable wall side walls 252 are disposed adjacent to each other to cover the corresponding discharge energy generating element 221 and to constitute a bubble liquid passage. With this arrangement, the bubble pressure (particularly, the pressure of the downstream side portion of the bubble) is concentrated to the free end of the movable wall 251 without escaping. Also in this embodiment, as is in the seventh embodiment, only when the bubble is formed by the discharge energy generating element 221, the free end of the movable wall 251 is displaced to communicate with the discharge port.

A height H of the movable wall side all 252 corresponds to about a second position (where the free end is displaced at the maximum during the liquid discharging operation), i.e., a position of the free end of the movable wall 251 after displacement. With this arrangement, the bubble pressure can be directed to the discharge port effectively. In addition, since flow resistance between an area of the liquid chamber 231 near the discharge port and the liquid is great, the routing of the liquid from the liquid chamber 231 to the liquid passage can be prevented. Thus, as the bubble is disappearing, the movable wall 251 is returned to its first position, and, during the disappearance of the bubble, regarding the supply of the liquid to the discharge energy generating element 221, the discharge port side of the bubble generating area is substantially sealed, thereby providing the above-mentioned various advantages such as prevention of retard of meniscus. Further, the advantage regarding the refill same as that in the former embodiment can be expected.

(Thirteenth Embodiment)

Figure 50:
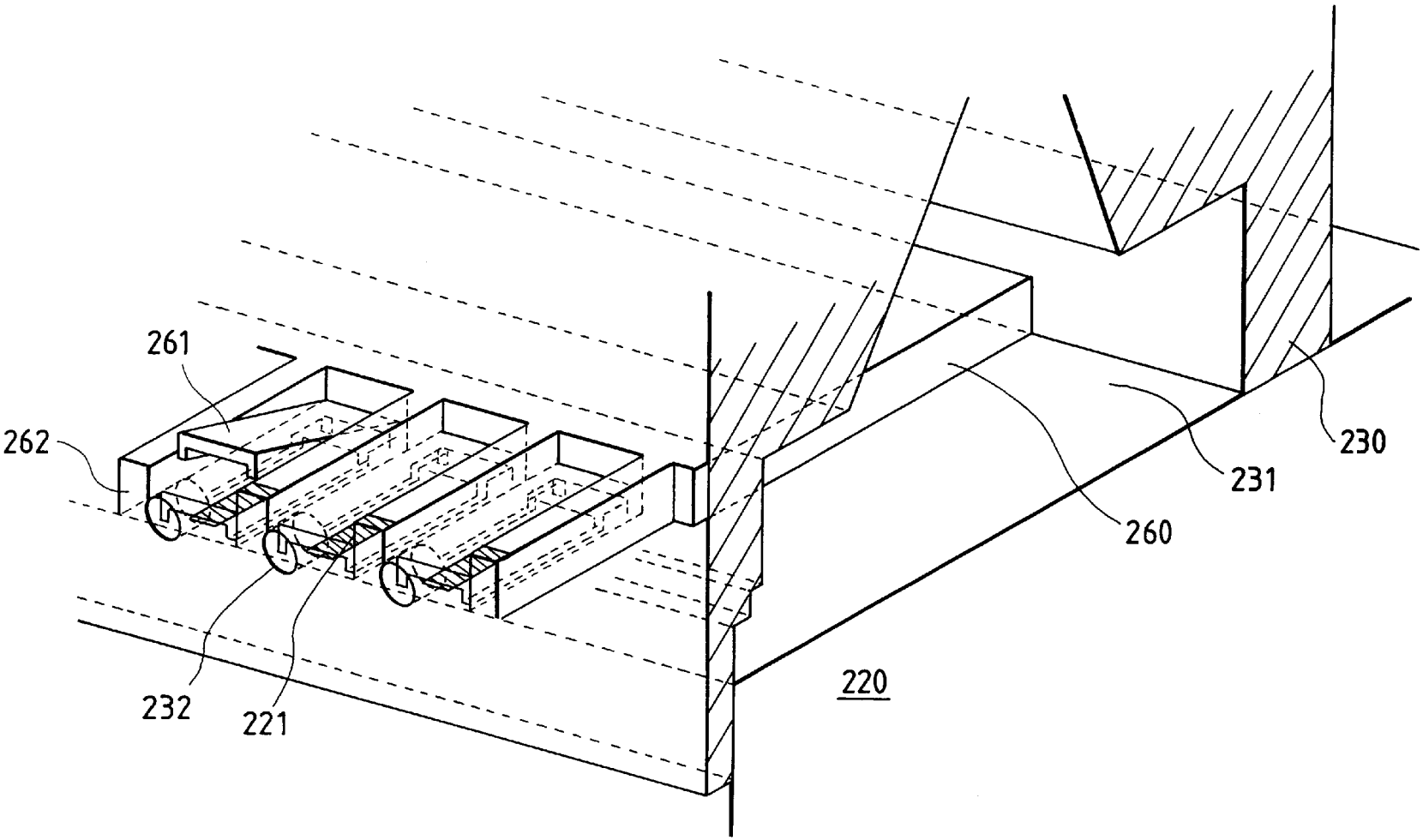
FIG. 50 is a schematic perspective view of a liquid discharging head according to a thirteenth embodiment of the present invention.

FIG. 50 schematically shows a liquid discharging head according to a thirteenth embodiment of the present invention. In FIG. 50, the same elements as those of the liquid discharging head shown in FIGS. 45 and 49 are designated by the same reference numerals.

The liquid discharging head according to this embodiment has the movable walls shown in FIG. 45 and the movable walls shown in FIG. 49.

The liquid discharging head according to this embodiment has a movable wall support member 260, movable walls 261 having the same construction as the movable walls 251 shown in FIG. 45, and movable wall side walls 262 (having the same construction as the movable wall side walls 252 shown in FIG. 49) for helping to direct the bubble pressure to the discharge port without escaping in the second position (where the movable wall is displaced at the maximum during the liquid discharging operation), i.e., a position of the movable wall 261 after displacement.

Each movable wall 261 and the movable wall side walls 262 are disposed adjacent to each other, and a height H of the movable wall side wall 262 corresponds to about a second position (where the free end is displaced at the maximum during the liquid discharging operation), i.e., a position of the free end of the movable wall 261 after displacement. With this arrangement, the bubble pressure at the maximum displacement can be directed to the discharge port effectively. Also in this embodiment, as is in the seventh embodiment, only when the bubble is formed by the discharge energy generating element 221, the free end of the movable wall 261 is displaced to communicate with the discharge port.

According to the above-mentioned arrangement, since flow resistance between an area of the liquid chamber 231 near the discharge port and the liquid is great, the routing of the liquid from the liquid chamber 231 to the bubble generating area defined by the movable wall and the movable wall side walls can be prevented. Thus, as the bubble is disappearing, the movable wall 261 is returned to its first position, and, during the disappearance of the bubble, regarding the supply of the liquid to the discharge energy generating element, the discharge port side of the bubble generating area is substantially sealed, thereby providing the above-mentioned various advantages such as prevention of retard of meniscus. Further, the advantage regarding the refill same as that in the former embodiments can be expected.

Figure 48:
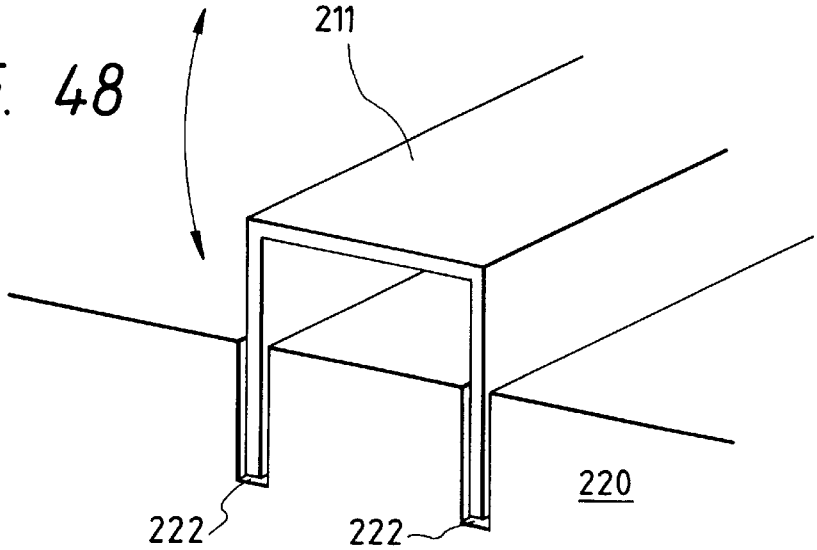
FIG. 48 is a schematic perspective view showing an example of a liquid passage structure of the head according to the present invention.

Further, also in this embodiment, as is in the seventh embodiment, as shown in FIG. 48, by forming grooves 222 for housing side wall portions of each movable wall 261 in the element substrate 220, the bubble generating area can effectively be substantially sealed by the movable wall.

(Fourteenth Embodiment)

In the above-mentioned eleventh to thirteenth embodiments, while an example that the liquid passage for supplying the liquid to the bubble generating area is separated from the liquid chamber 231 for supplying the liquid to the discharge port, that is to say, two kinds of liquids, i.e., the liquid to be discharged (discharge liquid) and the liquid in which the bubble is generated (bubble liquid) are used (however, these liquids may be the same) was explained, only the discharge liquid may be used (one liquid type). Now, an example of a head of one liquid type will be explained.

Figure 51:
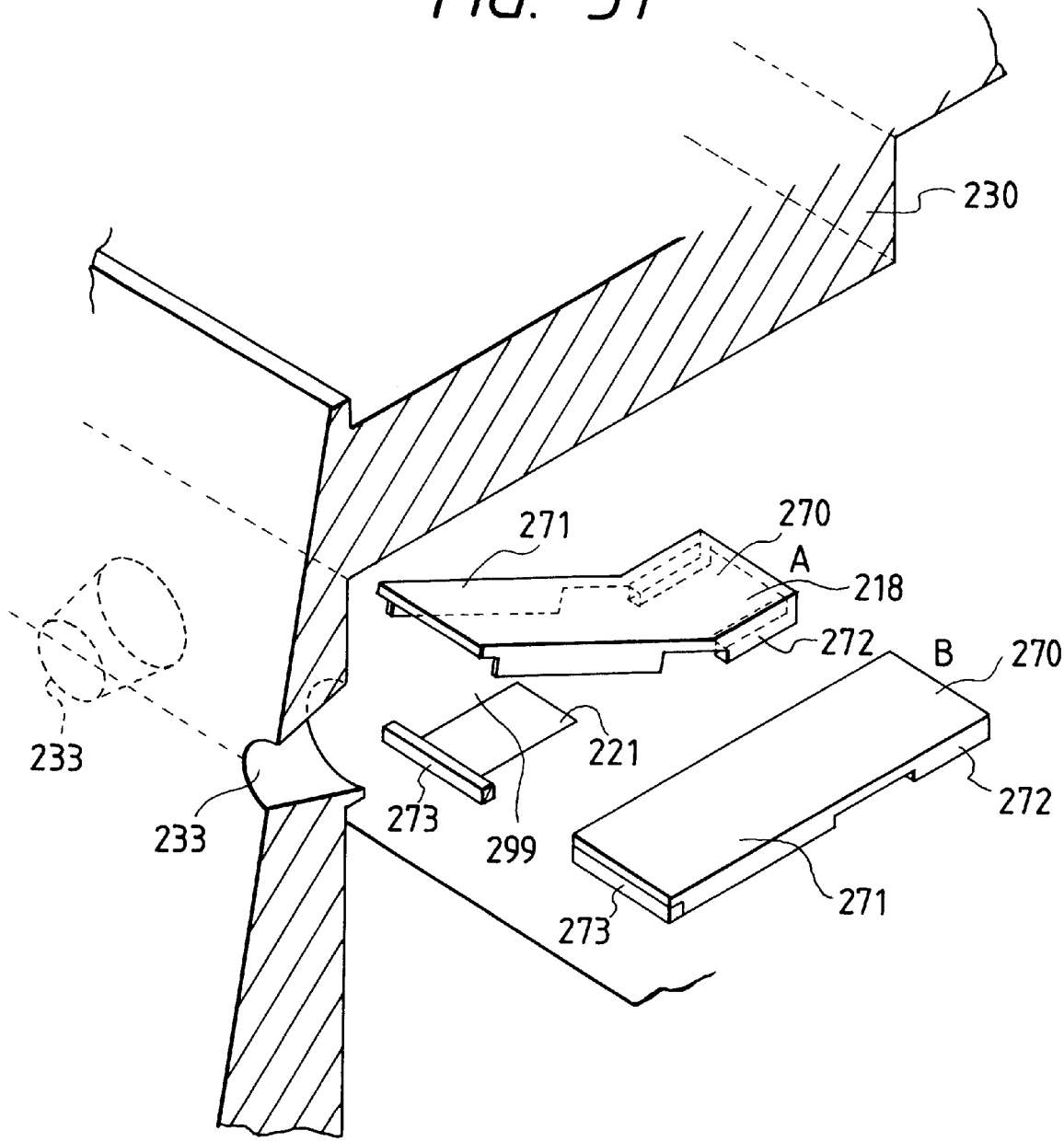
FIG. 51 is a schematic perspective view of a liquid discharging head according to a fourteenth embodiment of the present invention.

FIG. 51 schematically shows a liquid discharging head of one liquid type according to a fourteenth embodiment of the present invention. In FIG. 51, "A" shows a condition that a movable member is displaced (a bubble is not shown) and "B" shows a condition that the movable member is in an initial position (first position). In the condition B, a bubble generating area 299 is substantially closed or sealed with respect to a discharge port 233. Incidentally, in FIG. 51, the same elements as those shown in FIG. 45 are designated by the same reference numerals.

In FIG. 51, the liquid discharging head according to this embodiment has a movable wall support member 270 provided at its both sides with bases 272. The bases 272 of the movable wall support member are joined to an element substrate 220 to define a liquid supply passage 218. Further, a movable wall 271 is disposed in a confronting relation to the corresponding discharge energy generating element 221 and has one end supported by the movable wall support member 270 and the other end constituting a free end. The free end is displaced by pressure caused by a bubble generated by the discharge energy generating element 221. The movable wall has an inverted U-shaped cross-section. In the condition B, the movable wall 271 is closely contacted with a fixed wall 273 disposed along a discharge port side edge of the discharge energy generating element 221 on the element substrate 220 (i.e., a downstream edge of the discharge energy generating element in a liquid passage defined by the movable wall support member 270), thereby substantially sealing the bubble generating area with respect to the discharge port 233.

With the arrangement according to this embodiment, the liquid can be supplied to the bubble generating area from a liquid supply passage 218 having a surface flush with or smoothly connected to the surface of the discharge energy generating element 221 along an inner surface of the movable wall 271.

In the initial position (first position) of the movable wall 271, the movable wall 271 is closely contacted with the fixed wall 273 disposed at the downstream side of the discharge energy generating element 221, with the result that, since the discharge port side portion of the bubble generating area is substantially closed, the bubble pressure (particularly, the pressure of the downstream side portion of the bubble) is concentrated to the free end of the movable wall without escaping.

Further, as the bubble is disappearing, the movable wall 271 is returned to its first position, and, during the disappearance of the bubble, regarding the supply of the liquid to the discharge energy generating element, the discharge port 233 side of the bubble generating area is substantially sealed, thereby providing the above-mentioned various advantages such as prevention of retard of meniscus. Further, the advantage regarding the refill same as that in the former embodiments can be expected.

Further, in this embodiment, the bases 272 for supporting the movable wall 271 are disposed at the upstream side remote from the discharge energy generating element 221, and the liquid supply passage 218 is defined between the bases 272 having the small width, and the liquid is supplied to the liquid supply passage 218 from the liquid chamber 231. The configuration of the bases 272 is not limited to the illustrated one, but, the bases may have any configuration so long as the refill can be performed smoothly.

Incidentally, in this embodiment, while a distance between the movable wall 271 and the discharge energy generating element 221 was selected to about 15 $\mu$m, such distance may be selected within a range in which the bubble pressure can be sufficiently transmitted to the movable member.

(Fifteenth Embodiment)

Now, a fifteenth embodiment of the present invention will be explained with reference to the accompanying drawings.

In this embodiment, an example that a movable member for facilitating the improvement of the discharging efficiency is used.

Figure 52A:
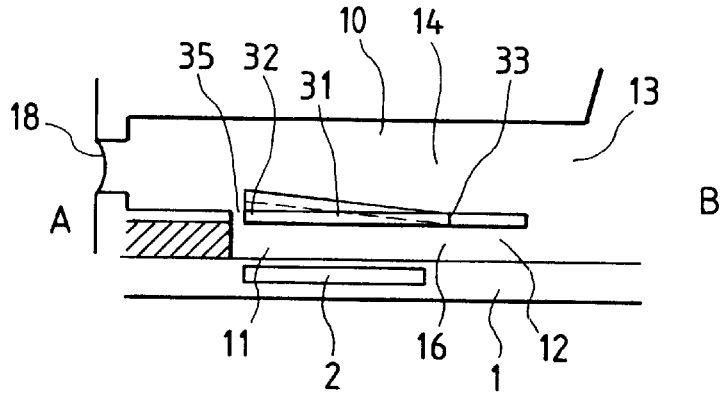
FIGS. 52A, 52B, 52C and 52D are schematic sectional views showing a liquid discharging head according to a fifteenth embodiment of the present invention.
Figure 52B:
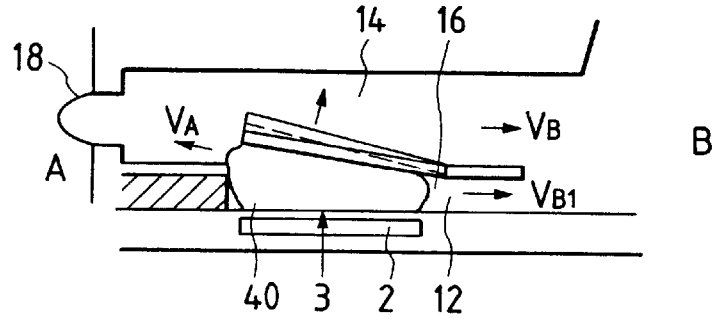
Figure 52C:
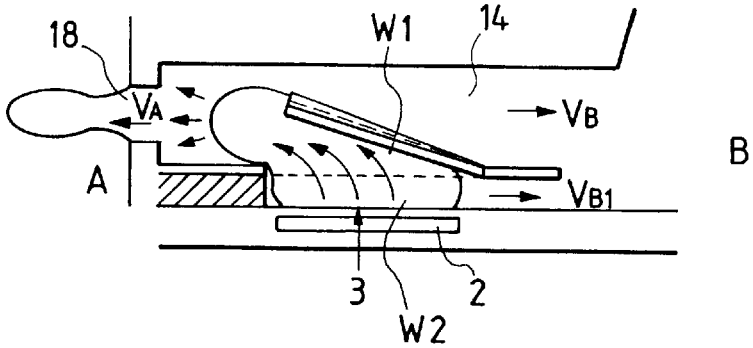
Figure 52D:
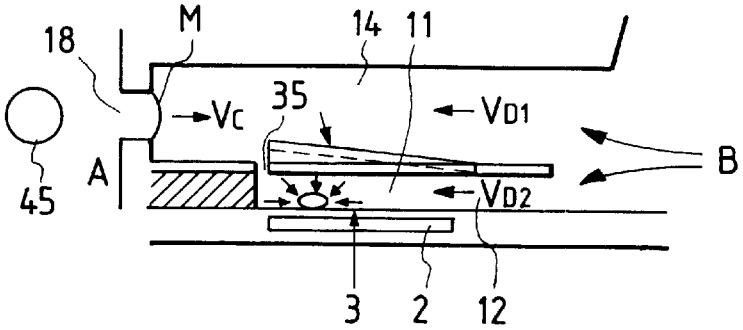
Figure 53:
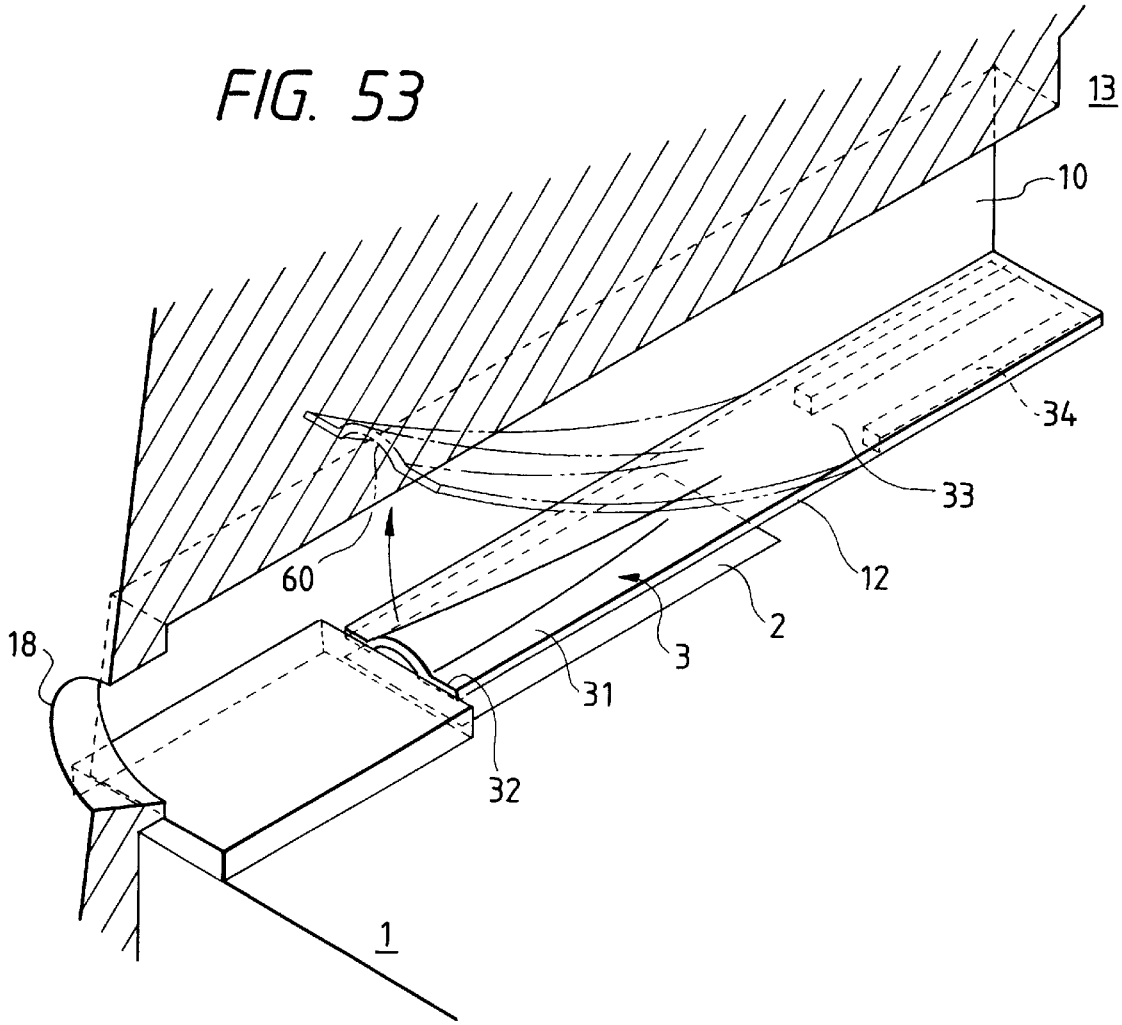
FIG. 53 is a partial fragmental perspective view of the liquid discharging head of FIGS. 52A, 52B, 52C and 52D.

FIGS. 52A, 52B, 52C and 52D are schematic sectional views of a liquid passage structure of a liquid discharging head according to this embodiment, and FIG. 53 is a partial fragmental perspective view of the liquid discharging head. FIG. 53 is a schematic sectional view of the liquid discharging head, looked at from a discharge port side.

The liquid discharging head according to this embodiment includes an element substrate 1 on which a heat generating element 2 (heat generating resistance member having a dimension of 40 $\mu$m×105 $\mu$m, in the illustrated embodiment) for acting thermal energy on liquid (as discharge energy generating element for generating energy for discharging the liquid) is arranged, and a liquid passage 10 is formed above the element substrate 1 in correspondence to the heat generating element 2. The liquid passage 10 communicates with a discharge port 18 and also communicates with a common liquid chamber 13 for supplying the liquid to a plurality of liquid passages 10, and receives the liquid corresponding to the discharged liquid from the common liquid chamber 13.

Within the liquid passage 10, above the element substrate 1, there is provided a plate-shaped movable member 31 made of material having elasticity such as metal and disposed in a cantilever fashion to face to the heat generating element 2. One end of the movable member 31 is secured to bases (support members) 34 formed by patterning photosensitive resin on a wall of the liquid passage 10 and on the element substrate. As a result, the movable member 31 is held and includes a fulcrum (fulcrum portion) 33.

The movable member 31 has the fulcrum 33 positioned at an upstream side of large flow of liquid flowing from the common liquid chamber 13 through the movable member 31 to the discharge port 18 and a free end (free end portion) 32 at a downstream side of the fulcrum 33 and is disposed in a confronting relation to the heat generating element 2 to cover the heat generating element 2 and is spaced apart from the heat generating element 5 by about 15 $\mu$m. A bubble generating area 11 is defined between the heat generating element 2 and the movable member 31.

Figure 54:
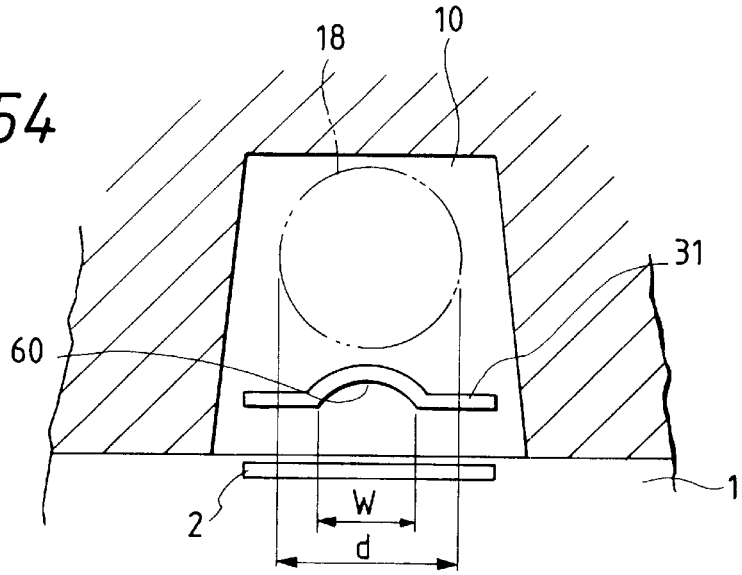
FIG. 54 is a schematic sectional view of the liquid discharging head of FIGS. 52A, 52B, 52C and 52D, looked at from a discharge port side.

A surface of the movable member 31 facing to the heat generating element 2 has a recessed portion 60 extending from the free end 32 to the fulcrum 33 and having an arcuate cross-section. As shown in FIG. 54, a width W of the recessed portion 60 at the free end 32 is smaller than a diameter d of the discharge port 18. Further, the width W and a depth of the recessed portion 60 are gradually decreased from the free end 32 to the fulcrum 33. Incidentally, since the movable member 31 is a plate-shaped member, when the recessed portion 60 is formed in the surface facing to the heat generating element 2, an opposite surface of the movable member becomes convex.

Kinds, configurations and dispositions of the heat generating element 2 and the movable member 31 are not limited to the above-mentioned ones, but, the heat generating element and the movable member may be configured and disposed to control the growth of the bubble and transmission of the pressure, which will be described later. Incidentally, for the explanation of a liquid flow which will be described later, the liquid passage 10 is explained to have a first liquid passage 14 (at one side of the movable member 31) directly communicated with the discharge port 18 and a second liquid passage 16 (at the other side of the movable member) including the bubble generating area 11 and a liquid supply passage 12. Hereinbelow, explanation is made by referring to the first and second liquid passages 14, 16.

Heat is applied to the liquid in the bubble generating area 11 between the movable member 31 and the heat generating element 2 by heating the heat generating element 2, and a bubble is formed in the liquid by a film-boiling phenomenon as disclosed in U.S. Pat. No. 4,723,129. Pressure caused by the formation of the bubble, and the bubble act on the movable member 31 preferentially, with the result that the movable member 31 is displaced around the fulcrum 33 to be greatly opened toward the discharge port 18, as shown in FIGS. 52B and 52C or FIG. 53. By the displacement or a displaced condition of the movable member 31, a transmitting direction of the pressure caused by the formation of the bubble and a growing direction of the bubble itself are oriented toward the discharge port 18.

Next, a discharging operation of the liquid discharging head according to the illustrated embodiment will be fully described with reference to FIGS. 52A, 52B, 52C and 52D.

FIG. 52A shows a condition before energy such a electrical energy is applied to the heat generating element 2, i.e., before heat is generated from the heat generating element 2. It is important that the movable member 31 is disposed in a confronting relation to at least a downstream portion of the bubble 40 which will be formed by the heat from the heat generating element 2. That is to say, the movable member 31 extends up to at least a position downstream of center 3 (FIG. 52B) of an area of the heat generating element in the liquid passage (i.e., downstream of a line passing through the center 3 of the area of the heat generating element and extending perpendicular to the length of the liquid passage) so that the movable member 31 acts on the downstream portion of the bubble 40.

FIG. 52B shows a condition that the heat generating element 2 is heated by applying the electrical energy to the heat generating element 2 and the bubble 40 is formed by the film-boiling caused by heating a portion of the liquid contained in the bubble generating area 11 by utilizing the heat from the heat generating element.

In this case, the movable member 31 is displaced or shifted by the pressure caused by the formation of the bubble 40 from the first position to the second position to direct the pressure transmitting direction of the bubble 40 toward the discharge port. Further, in this case, a major portion of the pressure component (among the pressure of the bubble 40) acting on the movable member 31 is received by the recessed portion 60 (FIG. 53) of the movable member 31, thereby facilitating the orientation of the pressure of the bubble 40 toward the discharge port 18. Here, it is important that, as mentioned above, the free end 32 of the movable member 31 is disposed at the downstream side (discharge port side) and the fulcrum 33 is disposed at the upstream side (common liquid chamber 13 side) so that at least a portion of the movable member 31 is faced to the downstream portion of the heat generating element 2 (i.e., downstream portion of the bubble 40). Further, it is preferable that a terminal end (near the fulcrum 33) of the recessed portion 60 of the movable member 31 is disposed at the upstream side of the heat generating element 2 so that the pressure of the bubble 40 can easily be received by the recessed portion 60.

FIG. 52C shows a condition that the bubble 40 is further growing and the movable member 31 is further displaced by the pressure caused by the growth of the bubble 40. The generated bubble 40 is grown more greatly at the downstream side than at the upstream side, and the bubble is greatly grown to exceed the first position (shown by the dot and chain line) of the movable member 31. In the illustrated embodiment, since the recessed portion 60 having the width smaller than the maximum diameter of the discharge port 18 and extending from the free end 32 to the fulcrum 33 is formed in the surface of the movable member 31 facing to the heat generating element 2 and the major portion of the pressure of the bubble 40 acting on the movable member 31 is received by the recessed portion 60, when the movable member 31 is displaced as the bubble 40 is growing, the pressure transmitting direction of the bubble 40 and the growing direction of the bubble 40 are uniformly directed toward the discharge port 18, thereby improving the discharging efficiency. When the growing direction of the bubble 40 and the pressure transmitting direction are oriented toward the discharge port, the movable member 31 does not resist against such orientation, with the result that the pressure transmitting direction and the growing direction of the bubble can be controlled efficiently in accordance with the magnitude of the pressure to be transmitted.

Further, since the width of the recessed portion 60 at the free end 32 is smaller than the diameter of the discharge port 18, the pressure of the bubble 40 is directed toward the discharge port 18 more correctly, and, further, since the width and the depth of the recessed portion 60 are gradually decreased toward the fulcrum 33, the pressure of the bubble 40 is directed toward the discharge port 18 efficiently.

FIG. 52D shows a condition that the bubble 40 is contracted to be disappeared by reduction of pressure in the bubble (after the film-boiling).

The movable member 31 which was displaced to the second position is returned to an initial position shown in FIG. 52A (first position) by negative pressure due to contraction of the bubble 40 and the restoring force due to the elasticity of the movable member 31 itself. Further, when the bubble is disappeared, in order to compensate the contracted volume of the bubble 40 at the bubble generating area 11 and to compensate the volume of the discharged liquid, the liquid flows into the bubble generating area from the upstream side (B), i.e., from the common liquid chamber 13 as shown by the arrows $V_{D1}$, $V_{D2}$ and from the discharge port 18 as shown by the arrow $V_C$.

While the operation of the movable member 31 in response to the formation of the bubble 40 and the liquid discharging operation were explained, now, refilling of the liquid in the liquid discharging head of the present invention will be fully explained.

The liquid supplying mechanism in the present invention will be fully described with reference to FIGS. 52A, 52B, 52C and 52D.

After the condition shown in FIG. 52C, when the bubble 40 is being contracted from the maximum volume condition, the liquid compensating the reduced bubble volume flows into the bubble generating area 11 from the discharge port 18 of the first liquid passage 14 and from the common liquid chamber 13 associated with the second liquid passage 16. In the conventional liquid passage design not having the movable member 31, an amount of liquid flowing toward the discharge port 18 into the reduced bubble position and an amount of liquid flowing toward the common liquid chamber into the reduced bubble position depend upon flow resistance between a portion (near the discharge port 18) of the bubble generating area and a portion (near the common liquid chamber 13) of the bubble generating area (i.e., depend upon resistances of the liquid passages and inertia of the liquid).

Thus, when the flow resistance between the bubble generating area and the discharge port is smaller than the flow resistance between the bubble generating area and the common liquid chamber, the greater amount of liquid flows into the reduced bubble position from the discharge port side, thereby increasing a retard amount of meniscus M. In particular, the smaller the flow resistance between the bubble generating area and the discharge port (to enhance the discharging efficiency), the greater the retard amount of the meniscus M, thereby increasing the refilling time to affect a bad influence upon the high speed recording.

To the contrary, in the illustrated embodiment, since the movable member 31 is provided, when it is assumed that a volume portion (above the first position) of the volume W of the bubble is W1 and a volume portion (below the first position, i.e., toward the bubble generating area 11) of the volume W of the bubble is W2, the retard of the meniscus M is stopped at the time when the movable member 31 is returned to its initial position during the reduction of the bubble. And, the liquid corresponding to the remaining volume W2 is mainly supplied from the liquid flow $V_{D2}$ in the second liquid passage 16. In this way, the retard amount of the meniscus M can be suppressed to about a half of the volume portion W1; incidentally, in the conventional techniques, the retard amount of the meniscus M was about a half of the entire volume W of the bubble.

Further, since the liquid corresponding to the volume portion W2 can forcibly be supplied mainly from the upstream side ($V_{D2}$) along the surface of the movable member 31 facing to the heat generating element 2 by utilizing the negative pressure during the disappearance of the bubble, the refilling time can be shortened.

When the refill is effected by utilizing the negative pressure during the disappearance of the bubble in the conventional head, the fluctuation of the meniscus becomes great to cause the deterioration of the image quality. To the contrary, in the high speed refill according to the illustrated embodiment, since the flowing of the liquid in the first liquid passage near the discharge port into the bubble generating area 11 near the discharge port 18 is suppressed by the movable member 31, the fluctuation of the meniscus M can be minimized. In this way, according to the present invention, since the high speed refill is achieved by the forcible refill of the liquid into the bubble generating area 11 from the liquid supply passage 12 of the second liquid passage 16 and suppression of the retard or fluctuation of the meniscus, the stable liquid discharging and high speed repeat discharging can be realized, and, when applied to the recording field, the high quality image and high speed recording can be realized.

In the arrangement according to the present invention, there is also provided the following effective function. That is to say, the transmission of the pressure caused by the formation of the bubble to the upstream side (back-wave) can be suppressed. The pressure of the bubble portion (near the common liquid chamber 13 (upstream side)) of the bubble 40 generated on the heat generating element 2 tends to push the liquid back to the upstream side (to cause the back-wave). The back-wave creates upstream pressure, upstream movement of the liquid and an inertia force due to the liquid movement, which resist the refill of the liquid into the liquid passage 10, thereby affecting a bad influence upon the high speed recording. In the present invention, since such upstream pressure, upstream liquid movement and inertia force can be suppressed by the movable member 31, the refill ability can be further improved.

Next, a further characteristic construction and advantage therefor in the illustrated embodiment will be described.

The second liquid passage 16 according to the illustrated embodiment has the liquid supply passage 12 having an inner wall flatly contiguous to (i.e., flush with) the heat generating element 2 at the upstream side of the heat generating element 2. In such a case, the supply of the liquid to the bubble generating area 11 and the surface of the heat generating element 2 is effected along the surface of the movable member 31 facing to the bubble generating area 11 (as flow $V_{D2}$). Thus, stagnation of liquid on the heat generating element 2 is prevented, with the result that gas included in the liquid and the residual bubble can easily be removed and excessive accumulation of heat in the liquid can be avoided. Accordingly, more stable formation of bubble can be repeated at a high speed. Incidentally, in the illustrated embodiment, while an example that the liquid supply passage 12 has a substantially flat inner wall was explained, the inner wall of the liquid supply passage is not limited to such an example, but may have a gentle slope or other shape smoothly contiguous to the surface of the heat generating element to prevent the stagnation of liquid on the heat generating element and disturbance of the supplied liquid.

Further, the liquid is supplied into the bubble generating area 11 from the direction $V_{D1}$ through the side (slit 35) of the movable member 31. However, a large movable member 31 for covering the entire bubble generating area 11 (covering the surface of the heat generating element) as shown in FIGS. 52A, 52B, 52C and 52D is used to direct the pressure of the bubble to the discharge port 18 more effectively. In this case, after the movable member 31 is returned to the first position, if the flow resistance between the bubble generating area 11 and an area (near the discharge port 18) of the first liquid passage 14 becomes great, the flow of the liquid from the direction $V_{D1}$ to the bubble generating area 11 is blocked. However, in the head arrangement according to the illustrated embodiment, since the liquid is supplied to the bubble generating area 11 from the direction $V_{D2}$, the liquid supply ability is extremely improved. Thus, even when the arrangement wherein the bubble generating area 11 is covered by the movable member 31 to improve the discharging efficiency is used, the liquid supplying ability is not worsened.

By the way, regarding the positions of the free end 32 and the fulcrum 33 of the movable member 31, for example, as shown in FIGS. 52A, 52B, 52C and 52D, the free end 32 is disposed at a down stream side of the fulcrum 33. With this arrangement, when the bubble is being formed, the pressure transmitting direction and the growing direction of the bubble 40 can be oriented or directed toward the discharge port 18 effectively. Further, this positional relation not only contributes the improvement of the discharging efficiency or ability but also reduces flow resistance of the liquid flowing through the liquid passage 10 during the supply of liquid, thereby achieving the high speed refill. The reason is that, as shown in FIGS. 52A, 52B, 52C and 52D, when the meniscus M retarded due to the liquid discharging is restored toward the discharge port 18 by a capillary phenomenon and/or when the liquid is supplied to compensate the disappeared bubble, the free end 32 and the fulcrum 33 are arranged not to resist against the liquid flows S1, S2, S3 flowing in the liquid passage 10 (including the first and second liquid passages 14, 16).

Further, in FIGS. 52A, 52B, 52C and 52D, as mentioned above, regarding the heat generating element 2, the free end 32 of the movable member 31 extends up to the position downstream of the center 3 of the area of the heat generating element 2 (i.e., downstream of the line passing through the center of the area of the heat generating element and extending perpendicular to the length of the liquid passage 10). Thus, the pressure and the downstream portion of the bubble 40 which are generated at the downstream side of the center 3 of the area of the heat generating element and greatly contribute to the liquid discharging are supported by the movable member 31, with the result that the pressure and the bubble are directed toward the discharge port 18, thereby improving the discharging efficiency and discharging force.

In addition, by utilizing the upstream portion of the bubble, various advantages can be achieved.

Further, in the illustrated embodiment, the momentary mechanical displacement of the free end 32 of the movable member 31 also contributes to the improvement of the liquid discharging.

(Sixteenth Embodiment)

Figure 55:
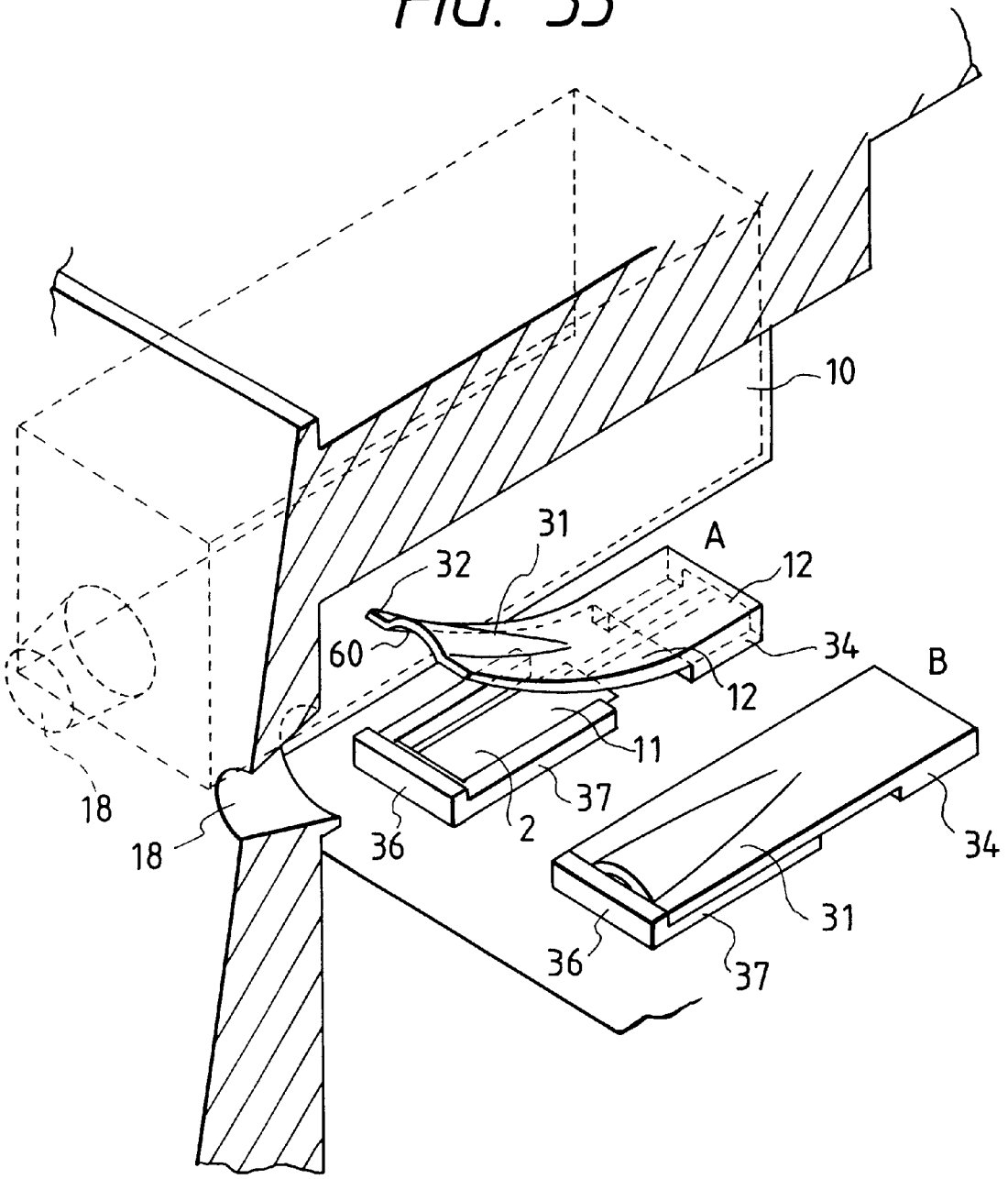
FIG. 55 is a partial fragmental perspective view of a liquid discharging head according to a sixteenth embodiment of the present invention.

FIG. 55 shows a sixteenth embodiment of the present invention. In FIG. 55, "A" shows a condition that a movable member 31 is displaced (a bubble is not shown), and "B" shows a condition that the movable member 31 is positioned in an initial position (first position). In the condition B, a bubble generating area 11 is substantially closed or sealed with respect to a discharge port 18. (Although not shown, there is a liquid passage wall between A and B to separate liquid passages from each other.)

The movable member 31 shown in FIG. 55 has a recessed portion 60 similar to that in the fifteenth embodiment. Further, there are two side bases 34 and a liquid supply passage 12 between the bases. With this arrangement, the liquid can be supplied along a surface of the movable member 31 facing to a heat generating element 2 from a liquid supply passage 12 having an inner surface flush with or smoothly contiguous to a surface of the heat generating element 2.

In the initial position (first position) of the movable member 31, the movable member 31 is adjacent to or closely contacted with a downstream wall 36 of the heat generating element disposed at a downstream end of the heat generating element 2, and an end (toward the discharge port 18) of a bubble generating area 11 is substantially sealed. Thus, pressure of a bubble (particularly, downstream pressure of the bubble) can be concentrated and oriented toward a free end 32 of the movable member 31 without escaping.

Further, when the bubble is disappeared, the movable member 31 is returned to the first position, and, when the liquid is supplied to compensate the disappeared bubble, since the side (near the discharge port 18) of the bubble generating area 11 is substantially sealed, the suppression of the retard of the meniscus and the like can be achieved, as is in the former embodiments.

Further, in the illustrated embodiment, as shown in FIGS. 53 and 55, the bases 34 for supporting and securing the movable member 31 are spaced apart from the heat generating element 2 and disposed at the upstream side of the heat generating element, and widths of the bases 34 are smaller than a width of the liquid passage 10 to permit the supply of liquid to a liquid supply passage 12. Further, the configuration of each base 34 is not limited to the illustrated one, but may be selected to perform the refill smoothly.

Incidentally, in the illustrated embodiment, while the distance between the movable member 31 and the heat generating element 2 was selected to about 15 $\mu$m, such a distance may be selected within a range in which the pressure caused by the formation of the bubble can be sufficiently transmitted to the movable member 31.

(Seventeenth Embodiment)

Figure 56:
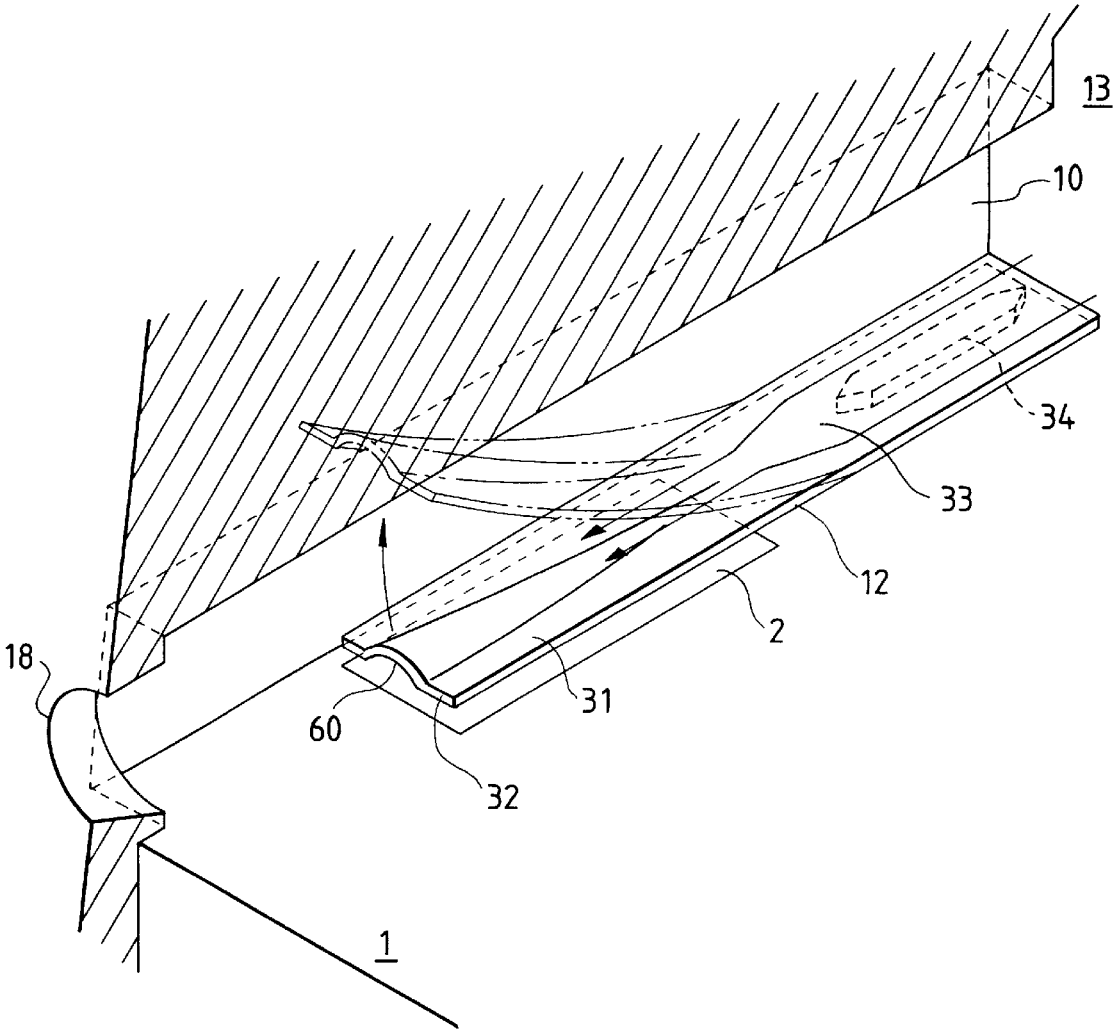
FIG. 56 is a partial fragmental perspective view of a liquid discharging head according to a seventeenth embodiment of the present invention.

FIG. 56 shows one of fundamental conceptions of the present invention associated with a seventeenth embodiment of the present invention. FIG. 56 shows a positional relation between a bubble generating area 11 in a liquid passage 10, a bubble generated in the area and a movable member 31, and shows an embodiment in which the liquid discharging method and the refilling method in the liquid discharging head of the present invention can easily be understood.

In the former embodiments, the prompt displacement of the movable member and the movement of the bubble are concentrated to the discharge port by concentrating the pressure of the generated bubble to the free end of the movable member. To the contrary, in this embodiment, the downstream portion of the bubble near the discharge port 18 (directly associated with the liquid discharging) is regulated by the free end 32 of the movable member 31, while permitting free growth of the bubble.

In FIG. 56, comparing with FIG. 53 (fifteenth embodiment), in this embodiment, there is no protruded portion or barrier (shown by the hatched area in FIGS. 52A, 52B, 52C and 52D) disposed at a downstream side of the bubble generating area on the element substrate 1 shown in FIG. 2. That is to say, the free end and both side areas of the movable member 31 is opened not to substantially close or seal the bubble generating area 11 with respect to the discharge port.

In this embodiment, since the growth of a downstream tip end portion of the downstream bubble portion which is directly associated with the liquid discharging is permitted, the pressure component of the tip end bubble portion can be used for the liquid discharging effectively. In addition, since the free end 32 of the movable member 31 causes at least the pressure directing upwardly of the downstream bubble portion to help the growth of the downstream bubble portion, the discharging efficiency can be improved, as is in the former embodiments. In this embodiment, the response to the energization of the heat generating element 2 is superior to those in the former embodiments.

Further, in this embodiment, since the construction is simple, the manufacture of the head can be facilitated.

The fulcrum of the movable member 31 in this embodiment is secured to a single base 34 having a width smaller than that of the movable member 31. Accordingly, during the disappearance of the bubble, the liquid is supplied through both sides of the base 34 (as shown by the arrows). The base 34 may have any configuration so long as the liquid can be supplied.

In the illustrated embodiment, since the liquid flow from the above into the bubble generating area 11 during the disappearance of the bubble is controlled by the presence of the movable member 31, the refill of the liquid is superior to the refill in the conventional bubble generating structure only having a heat generating element. Of course, with the arrangement as mentioned above, the retard amount of the meniscus can be reduced.

As an alteration of this embodiment, it is preferable that both side ends (or one of them) of the free end 32 of the movable member 31 alone are substantially sealed to the bubble generating area 11. With this arrangement, since the pressure directing laterally of the movable member 31 is utilized to growth of the downstream portion (near the discharge port) of the bubble, the discharging efficiency can be further improved.

(Eighteenth Embodiment)

Now, an eighteenth embodiment of the present invention will be explained with reference to FIGS. 57, 58, 59A and 59B.

Also in this embodiment, although the main liquid discharging principle is the same as the previous embodiments, in this embodiment, the liquid passage has a multi-passage structure so that the liquid in which the bubble is formed by applying the heat (bubble liquid) can be isolated from the liquid to be discharged (discharge liquid).

Figure 57:
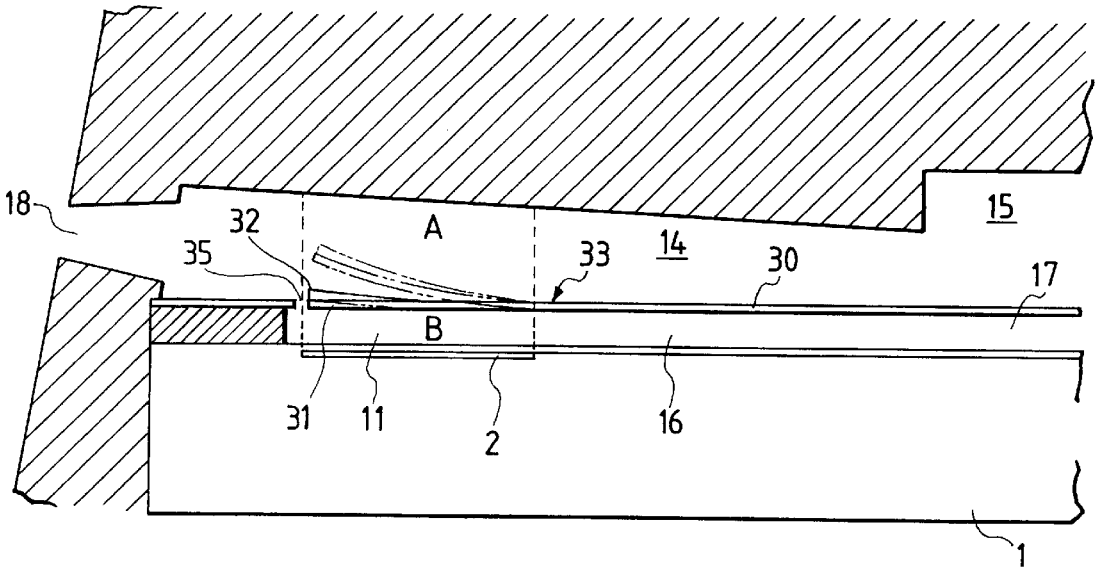
FIG. 57 is a sectional view of a liquid discharging head (two liquid passages) according to an eighteenth embodiment of the present invention.
Figure 58:
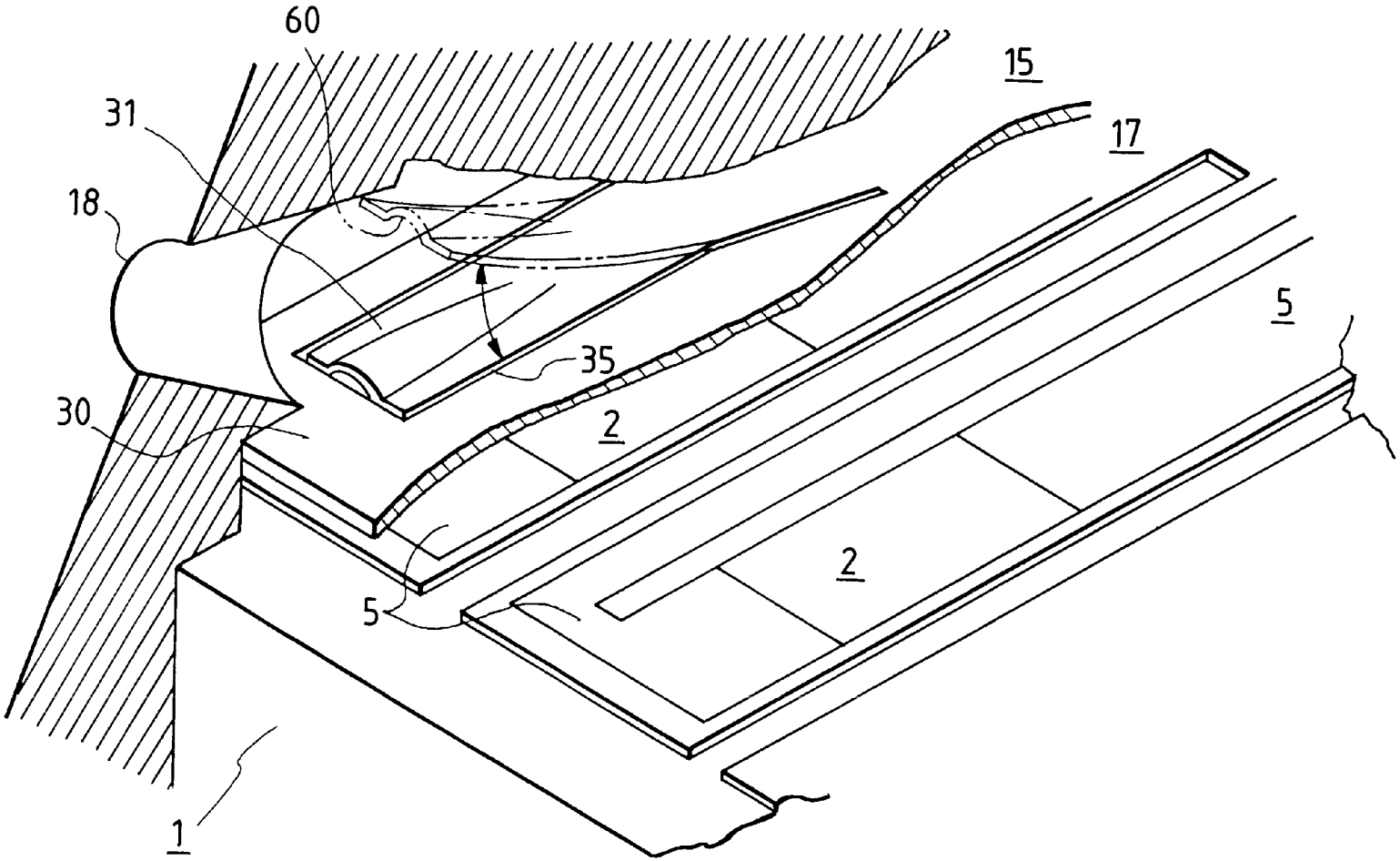
FIG. 58 is a partial fragmental perspective view of the liquid discharging head of FIG. 57.

FIG. 57 is a schematic sectional view of a liquid passage structure of a liquid discharging head according to this embodiment, and FIG. 58 is a partial fragmental perspective view of the liquid discharging head of FIG. 57.

The liquid discharging head according to this embodiment includes an element substrate 1 on which a heat generating element 2 for applying thermal energy for forming a bubble in the liquid is arranged, a second liquid passage 16 for the bubble liquid disposed on the element substrate 1, and a first liquid passage 14 for the discharge liquid directly communicated with the discharge port 18 and disposed above the second liquid passage.

An upstream side portion of the first liquid passage 14 is communicated with a first common liquid chamber 15 for supplying the discharge liquid to a plurality of first liquid passages 14, and an upstream side portion of the second liquid passage 16 is communicated with a second common liquid chamber 17 for supplying the bubble liquid to a plurality of second liquid passages 16.

However, when the same liquid is used both as the bubble liquid and as the discharge liquid, a single common liquid chamber may be used.

A separation wall 30 made of material having elasticity such as metal is disposed between the first liquid passage 14 and the second liquid passage 16 to isolate the first liquid passage 14 from the second liquid passage 16. Incidentally, when the mixing between the bubble liquid and the discharge liquid is desired to prevent as much as possible, the liquid in the first liquid passage 14 is isolated from the liquid in the second liquid passage 16 by the separation wall 30 as much as possible; whereas, when the bubble liquid and the discharge liquid may be mixed to some extent, the separation wall 30 may not have the perfect separation function.

A portion of the separation wall 30 positioned in an upper projection space regarding the heat generating element 2 (referred to as "discharge pressure generating area" hereinafter; an area A and area B of the bubble generating area 11 in FIG. 57) constitutes a movable member 31 (supported in a cantilever fashion) having a free end 32 opened toward the discharge port 18 (i.e., toward a downstream side in the liquid flowing direction) through a slit 35, and a fulcrum 33 disposed at the common liquid chamber (15, 17) side. Since the movable member 31 is disposed in a confronting relation to the bubble generating area 11 (B), the movable member is moved (as shown by the arrow) by the bubble in the bubble liquid to be opened toward the discharge port 18 in the first liquid passage 14. In FIG. 58, the separation wall 30 is disposed, with the interposition of a space for defining a second liquid passage, on the element substrate 1 on which heat generating resistance bodies as the heat generating elements 2 and electrodes 5 for applying an electrical signal to the heat generating body are disposed.

The positional relation between the fulcrum 33 and the free end 32 of the movable member 31 and the heat generating element 2 are the same as the former embodiments. Further, regarding the movable member 31, as is in the former embodiments, a surface of the movable member facing to the heat generating element 2 has a recessed portion 60 having a width smaller than a maximum diameter of the discharge port 18 and extending from the free end 32 to the fulcrum 33 to facilitate the orientation of the pressure of the bubble toward the discharge port 18.

Further, while the structural relation between the liquid supply passage 12 and the heat generating element 2 was explained in the previous embodiments, also in this embodiments, a structural relation between the second liquid passage 16 and the heat generating element 2 is the same as the above-mentioned structural relation.

Next, an operation of the liquid discharging head according to this embodiment will be explained with reference to FIGS. 59A and 59B.

Regarding the operation of the head, as the discharge liquid supplied to the first liquid passage 14 and the bubble liquid supplied to the second liquid passage 16, the same water-base ink is used. When the bubble liquid in the bubble generating area 11 in the second liquid passage 16 is subjected to the heat from the heat generating element 2, as is in the former embodiments, a bubble 40 is formed in the bubble liquid by film-boiling phenomenon as disclosed in U.S. Pat. No. 4,723,129.

Figure 59A:
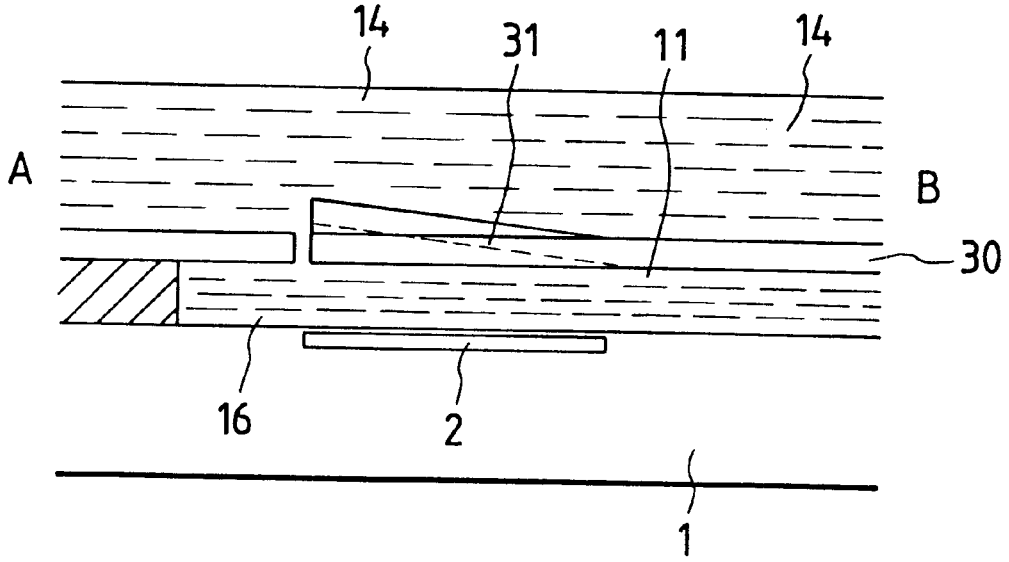
FIGS. 59A and 59B are views for explaining an operation of a movable member.
Figure 59B:
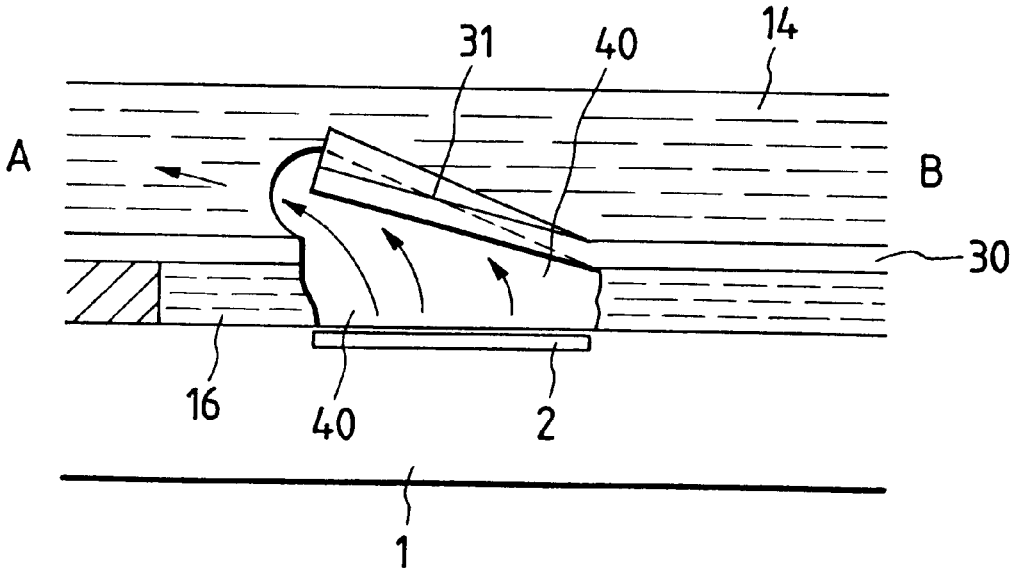

In this embodiment, since the bubble pressure cannot escape except through the upstream side of the bubble generating area 11, the pressure caused by the formation of the bubble is concentrated and transmitted toward the movable member 31, so that, as the bubble 40 is growing, the movable member 31 is displaced from a condition shown in FIG. 59A to a condition shown in FIG. 59B toward the first liquid passage 14. This movement of the movable member 31 causes the second liquid passage 16 to greatly communicate with the first liquid passage 14, with the result that the pressure of the bubble 40 is mainly transmitted to a direction toward the discharge port in the first liquid passage 14 (i.e., direction A). The liquid is discharged from the discharge port by such transmission of the pressure and the mechanical displacement of the movable member 31.

Then, as the bubble 40 is being disappeared, the movable member 31 is returned to condition shown in FIG. 59A, and, in the first liquid passage 14, the discharge liquid corresponding to an amount of the discharged liquid is supplied from the upstream side. Also in this embodiment, since the supply of the discharge liquid is effected toward a direction for closing the movable member 31 as is in the former embodiments, the refill of the discharge liquid is not prevented by the movable member 31.

While function and advantage regarding the transmission of the bubble pressure due to the displacement of the movable member 31, the growing direction of the bubble 40 and the prevention of the back-wave in this embodiment are the same as the first embodiment, the two-liquid passage structure of this embodiment further provides the following advantages.

That is to say, according to the arrangement of this embodiment, since the discharge liquid and the bubble liquid are isolated from each other, the discharge liquid can be discharged by the pressure of the bubble formed in the bubble liquid. Thus, even when high-viscous liquid such as polyethylene or glycol in which a bubble is not adequately formed and provides only poor discharging force is used, by supplying such high-viscous liquid in the first liquid passage 14 and by supplying liquid (mixture of ethanol:water=4:6; about 1–2 cp) or low boiling point liquid in which a bubble can easily be formed in the second liquid passage 16, the good discharging can be achieved.

Further, by selecting liquid in which deposit due to heat is not accumulated on the surface of the heat generating element 2 as the bubble liquid, the formation of the bubble can be stabilized and good discharging can be achieved.

In addition, since the head according to this embodiment provides the advantages same as the former embodiments, the liquid such as high-viscous liquid can be discharged with high discharging efficiency and high discharging force.

Further, even when liquid having poor resistance to heat is used, by supplying such liquid in the first liquid passage 14 and by supplying liquid having good resistance to heat and facilitating the formation of the bubble in the second liquid passage 16, the liquid can be discharged with high discharging efficiency and high discharging force and without thermal damage of the liquid.

(Nineteenth Embodiment)

Now, a nineteenth embodiment of the present invention will be explained with reference to the accompanying drawings.

This embodiment shows an example that, when the movable member is displaced, the resistance of the movable member subjected from the liquid becomes smaller to effectively operate the movable member during the growth of the bubble, thereby obtaining the good discharging efficiency and discharging force.

Figure 65A:
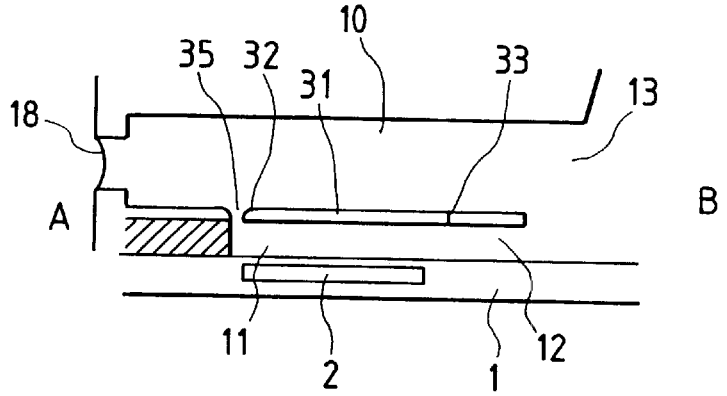
FIGS. 65A, 65B, 65C and 65D are schematic sectional views of a liquid discharging head according to a nineteenth embodiment of the present invention.
Figure 65B:
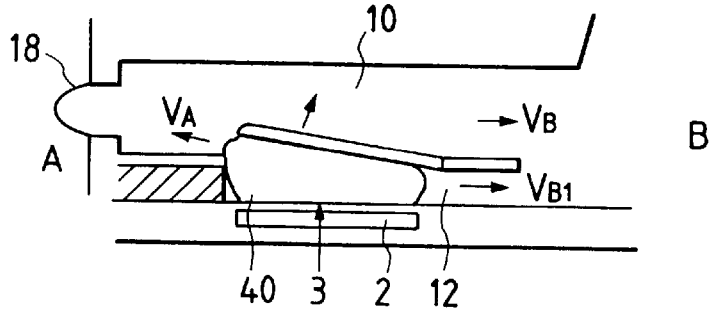
Figure 65C:
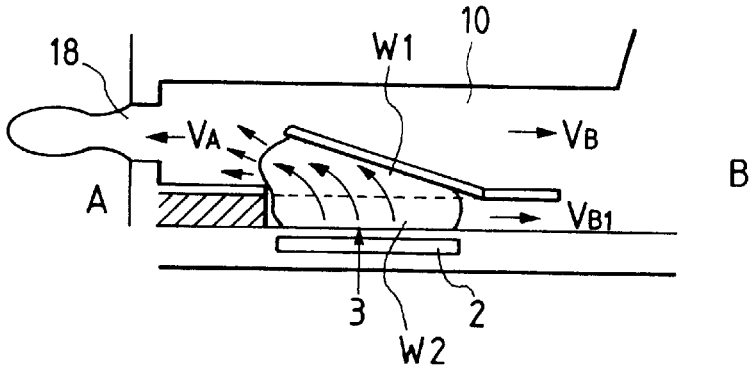
Figure 65D:
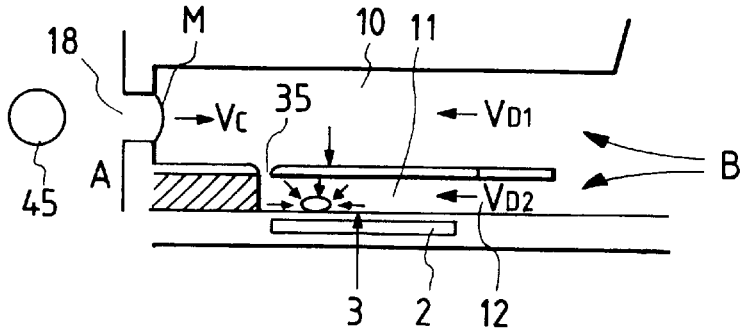
Figure 66:
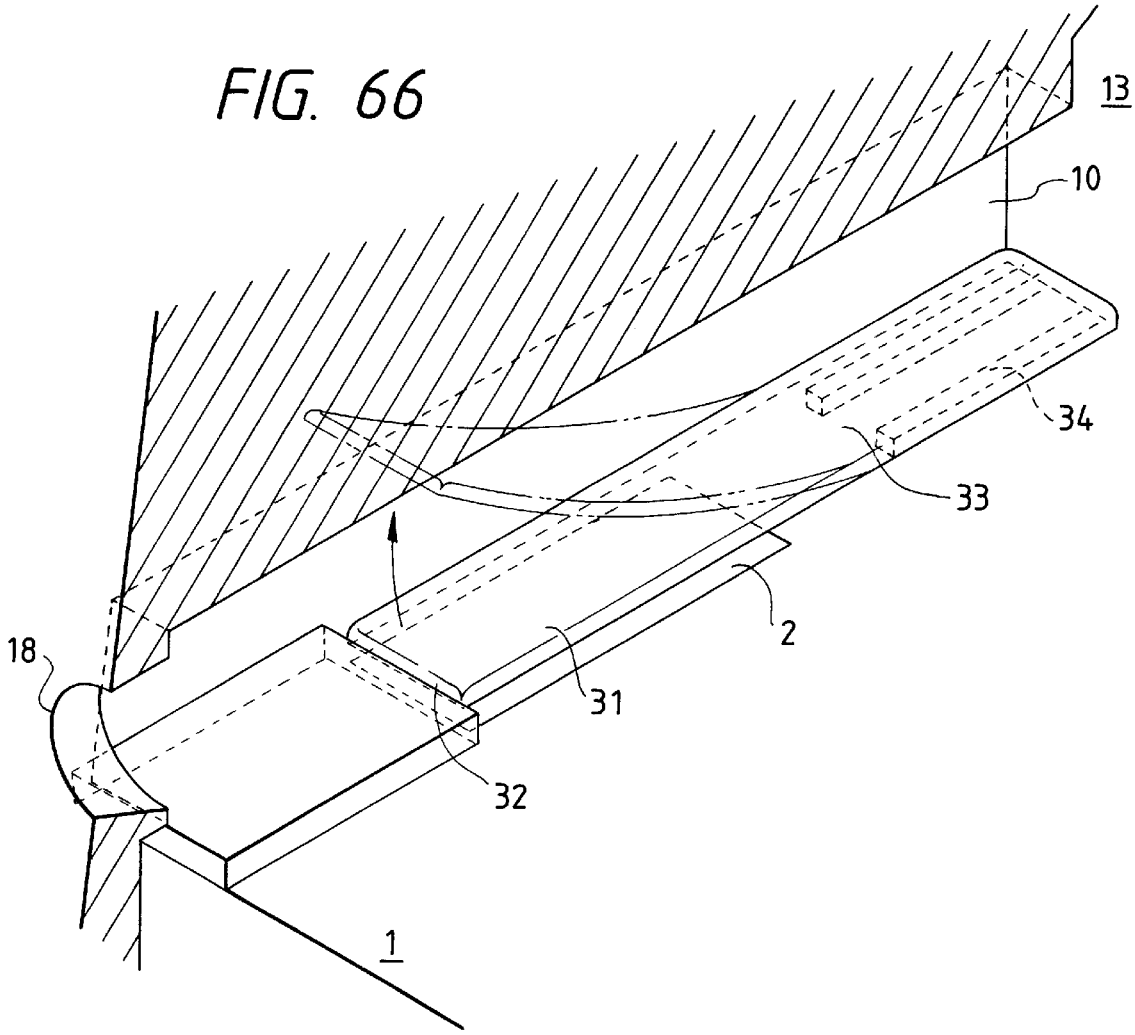
FIG. 66 is a partial fragmental perspective view of the liquid discharging head of FIGS. 65A, 65B and 65C.
Figure 67:
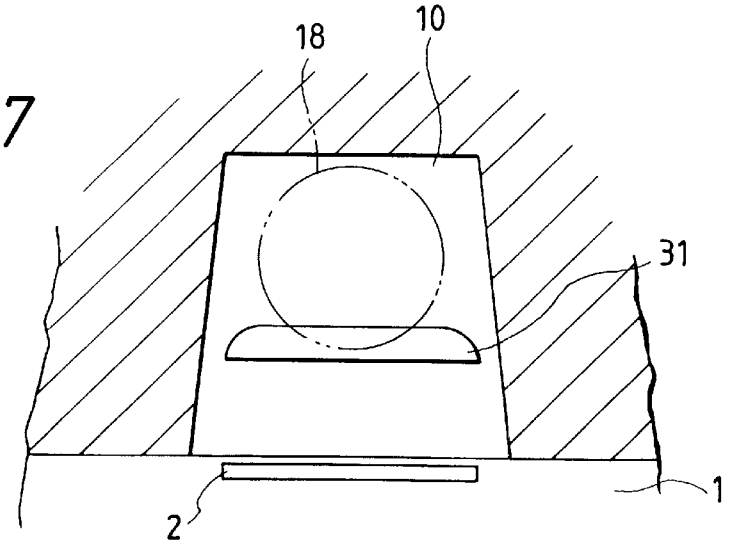
FIG. 67 is a schematic sectional view of the liquid discharging head of FIGS. 65A, 65B and 65C, looked at from a discharge port side.

FIGS. 65A, 65B, 65C and 65D are schematic sectional views of a liquid passage structure of a liquid discharging head according to the nineteenth embodiment, and FIG. 66 is a partial fragmental perspective view of the liquid discharging head. FIG. 67 is a schematic sectional view of the liquid discharging head according to the first embodiment, looked at from a discharge port side.

The liquid discharging head according to the illustrated embodiment includes an element substrate 1 on which a heat generating element 2 (heat generating resistance member having a dimension of 40 $\mu$m×105 $\mu$m, in the illustrated embodiment) for acting thermal energy on liquid (as discharge energy generating element for generating energy for discharging the liquid) is arranged, and a liquid passage 10 is formed above the element substrate 1 in correspondence to the heat generating element 2. The liquid passage 10 communicates with a discharge port 18 and also communicates with a common liquid chamber 13 for supplying the liquid to a plurality of liquid passages 10, and receives the liquid corresponding to the discharged liquid from the common liquid chamber 13.

Within the liquid passage 10, above the element substrate 1, there is provided a plate-shaped movable member 31 made of material having elasticity such as metal in a cantilever fashion. The movable member 31 has a flat surface facing to the heat generating element 2 and extending in parallel with a surface of the heat generating element 2. Further, a width of the movable member 31 is gradually decreased from the surface facing the heat generating element 2 to an opposite surface. One end of the movable member 31 is secured to bases (support member) 34 formed by patterning photosensitive resin on a wall of the liquid passage 10 and on the element substrate 1. As a result, the movable member 31 is held and has a fulcrum (support portion) 33.

The movable member 31 has the fulcrum 33 positioned at an upstream side of large flow of liquid flowing from the common liquid chamber 13 through the movable member 31 to the discharge port 18 and a free end (free end portion) 32 at a downstream side of the fulcrum 33 and is disposed in a confronting relation to the heat generating element 2 to cover the heat generating element 2 and is spaced apart from the heat generating element 5 by about 15 $\mu$m. A bubble generating area 11 is defined between the heat generating element 2 and the movable member 31. Incidentally, kinds, configurations and dispositions of the heat generating element 2 and the movable member 31 are not limited to the above-mentioned ones, but, the heat generating element and the movable member may be configured and disposed to control the growth of the bubble and transmission of the pressure, which will be described later.

Heat is applied to the liquid in the bubble generating area 11 between the movable member 31 and the heat generating element 2 by heating the heat generating element 2, and a bubble is formed in the liquid by a film-boiling phenomenon as disclosed in U.S. Pat. No. 4,723,129. Pressure caused by the formation of the bubble, and the bubble act on the movable member 31 preferentially, with the result that the movable member 31 is displaced around the fulcrum 33 to be greatly opened toward the discharge port 18, as shown in FIGS. 65B and 65C or FIG. 66. By the displacement or a displaced condition of the movable member 31, a transmitting direction of the pressure caused by the formation of the bubble and a growing direction of the bubble itself are oriented toward the discharge port 18.

Next, a discharging operation of the liquid discharging head according to the illustrated embodiment will be fully described.

FIG. 65A shows a condition before energy such as electrical energy is applied to the heat generating element 2, i.e., before heat is generated from the heat generating element 2. It is important that the movable member 31 is disposed in a confronting relation to at least a downstream portion of the bubble 40 which will be formed by the heat from the heat generating element 2. That is to say, the movable member 31 extends up to at least a position downstream of center 3 (FIG. 65B) of an area of the heat generating element in the liquid passage (i.e., downstream of a line passing through the center 3 of the area of the heat generating element and extending perpendicular to the length of the liquid passage) so that the movable member 31 acts on the downstream portion of the bubble 40.

FIG. 65B shows a condition that the heat generating element 2 is heated by applying the electrical energy to the heat generating element 2 and the bubble 40 is formed by the film-boiling caused by heating a portion of the liquid contained in the bubble generating area 11 by utilizing the heat from the heat generating element.

In this case, the movable member 31 is displaced or shifted by the pressure caused by the formation of the bubble 40 from the first position to the second position to direct the pressure transmitting direction of the bubble 40 toward the discharge port. Here, it is important that, as mentioned above, the free end 32 of the movable member 31 is disposed at the downstream side (discharge port side) and the fulcrum 33 is disposed at the upstream side (common liquid chamber 13 side) and at least a portion of the movable member 31 is faced to the downstream portion of the heat generating element 2 (i.e., downstream portion of the bubble 40).

FIG. 65C shows a condition that the bubble 40 is further growing and the movable member 31 is further displaced by the pressure caused by the growth of the bubble 40. The generated bubble 40 is grown more greatly at the downstream side than at the upstream side, and the bubble is greatly grown to exceed the first position (shown by the dot and chain line) of the movable member 31. When the movable member 31 is displaced as the bubble 40 is growing, the pressure transmitting direction of the bubble 40 is regulated to a direction toward which the pressure transmitting direction is apt to be oriented (i.e., to the free end opened toward the discharge port), with the result that the growing direction of the bubble 40 is uniformly oriented toward the discharge port 18, thereby improving the discharging efficiency. When the growing direction of the bubble 40 and the pressure transmitting direction are oriented toward the discharge port, the movable member 31 does not resist against such orientation, with the result that the pressure transmitting direction and the growing direction of the bubble 40 can be controlled efficiently in accordance with the magnitude of the pressure to be transmitted.

Further, as mentioned above, since the width of the movable member 31 is gradually decreased from the surface facing to the heat generating element 2 to the opposite surface, when the movable member 31 is displaced by the pressure of the bubble 40, the movable member 31 is hard to be resisted by the liquid in the liquid passage 10, with the result that the movable member can be displaced with low pressure. Accordingly, a component of the pressure of the bubble 40 used to displace the movable member 31 can be minimized, with the result that the remaining pressure contributes to grow the bubble toward the discharge port 18.

On the other hand, since the surface of the movable member 31 facing to the heat generating element 2 is substantially flat and extends in parallel with the surface of the heat generating element 2, the movable member can easily be subjected to the pressure of the bubble 40, thereby displacing the movable member 31 efficiently. The structure which can easily be subjected to the pressure of the bubble 40 is not limited to the above one, but, for example, sattin finished surface or serration may be formed on the surface of the movable member 31 facing to the heat generating element 2, or a concave portion for covering both sides of the bubble 40 may be formed in a portion of the surface of the movable member 31 facing to the heat generating element 2.

FIG. 65D shows a condition that the bubble 40 is contracted to be disappeared by reduction of pressure in the bubble (after the film-boiling).

The movable member 31 which was displaced to the second position is quickly returned to an initial position shown in FIG. 65A (first position) by negative pressure due to contraction of the bubble 40 and a restoring force due to the elasticity of the movable member 31 itself. Further, when the bubble is disappeared, in order to compensate the contracted volume of the bubble 40 at the bubble generating area 11 and to compensate the volume of the discharged liquid, the liquid flows into the bubble generating area from the upstream side (B), i.e., from the common liquid chamber 13 as shown by the arrows $V_{D1}$, $V_{D2}$ and from the discharge port 18 as shown by the arrow $V_C$.

While the operation of the movable member 31 in response to the formation of the bubble 40 and the liquid discharging operation were explained, now, refilling of the liquid in the liquid discharging head of the present invention will be fully explained.

The liquid supplying mechanism in the present invention will be fully described with reference to FIGS. 65A, 65B, 65C and 65D.

After the condition shown in FIG. 65C, when the bubble 40 is being contracted from the maximum volume condition, the liquid compensating the reduced bubble volume flows into the bubble generating area 11 from the discharge port 18 of the liquid passage 10 and from the common liquid chamber 13 associated with the liquid supply passage 12. In the conventional liquid passage design not having the movable member 31, an amount of liquid flowing toward the discharge port 18 into the reduced bubble position and an amount of liquid flowing toward the common liquid chamber 13 into the reduced bubble position depend upon flow resistance between the bubble generating area 11 and the discharge port 18, and, flow resistance between the bubble generating area and the common liquid chamber 13 (i.e., depend upon resistances of the liquid passages and inertia of the liquid).

Thus, when the flow resistance between the bubble generating area and the discharge port 18 is smaller than the flow resistance between the bubble generating area and the common liquid chamber, the greater amount of liquid flows into the reduced bubble position from the discharge port 18, thereby increasing a retard amount of meniscus M. In particular, the smaller the flow resistance between the bubble generating area and the discharge port 18 (to enhance the discharging efficiency), the greater the retard amount of the meniscus M, thereby increasing the refilling time to affect a bad influence upon the high speed recording.

To the contrary, in the illustrated embodiment, since the movable member 31 is provided, when it is assumed that a volume portion (above the first position) of the volume W of the bubble is W1 and a volume portion (below the first position, i.e., toward the bubble generating area 11) of the volume W of the bubble is W2, the retard of the meniscus M is stopped at the time when the movable member 31 is returned to its initial position during the reduction of the bubble. And, the liquid corresponding to the remaining volume W2 is mainly supplied from the liquid flow $V_{D2}$ in the liquid supply passage 12. In this way, the retard amount of the meniscus M can be suppressed to about a half of the volume portion W1; incidentally, in the conventional techniques, the retard amount of the meniscus M was about a half of the entire volume W of the bubble.

Further, since the liquid corresponding to the volume portion W2 can forcibly be supplied mainly from the upstream side of the supply passage 12 ($V_{D2}$) along the surface of the movable member 31 facing to the heat generating element 2 by utilizing the negative pressure during the disappearance of the bubble, the refilling time can be shortened.

When the refill is effected by utilizing the negative pressure during the disappearance of the bubble in the conventional head, the fluctuation of the meniscus becomes great to cause the deterioration of the image quality. To the contrary, in the high speed refill according to the illustrated embodiment, since the flowing of the liquid in the liquid passage 10 near the discharge port 18 into the bubble generating area 11 near the discharge port 18 is suppressed by the movable member 31, the fluctuation of the meniscus M can be minimized.

In this way, according to the present invention, since the high speed refill is achieved by the forcible refill of the liquid into the bubble generating area 11 from the liquid supply passage 12 and suppression of the retard or fluctuation of the meniscus, the stable liquid discharging and high speed repeat discharging can be realized, and, when applied to the recording field, the high quality image and high speed recording can be realized.

In the arrangement according to the present invention, there is also provided the following effective function. That is to say, the transmission of the pressure caused by the formation of the bubble to the upstream side (back-wave) can be suppressed. The pressure of the bubble portion (near the common liquid chamber 13 (upstream side)) of the bubble 40 generated on the heat generating element 2 tends to push the liquid back to the upstream side (to cause the back-wave). The back-wave creates upstream pressure, upstream movement of the liquid and an inertia force due to the liquid movement, which resist the refill of the liquid into the liquid passage 10, thereby affecting a bad influence upon the high speed recording. In the present invention, since such upstream pressure, upstream liquid movement and inertia force can be suppressed by the movable member 31, the refill ability can be further improved.

Next, a further characteristic construction and advantage therefor in the illustrated embodiment will be described.

The liquid supply passage 12 according to the illustrated embodiment has an inner wall flatly contiguous to (i.e., flush with) the heat generating element 2 at the upstream side of the heat generating element 2. In such a case, the supply of the liquid to the bubble generating area 11 and the surface of the heat generating element 2 is effected along the surface of the movable member 31 facing to the bubble generating area 11 (as flow $V_{D2}$). Thus, stagnation of liquid on the heat generating element 2 is prevented, with the result that gas included in the liquid and the residual bubble can easily be removed and excessive accumulation of heat in the liquid can be avoided. Accordingly, more stable formation of bubble can be repeated at a high speed. Incidentally, in the illustrated embodiment, while an example that the liquid supply passage 12 has a substantially flat inner wall was explained, the inner wall of the liquid supply passage is not limited to such an example, but may have a gentle slope or other shape smoothly contiguous to the surface of the heat generating element to prevent the stagnation of liquid on the heat generating element and disturbance of the supplied liquid.

Further, the liquid is supplied into the bubble generating area 11 from the direction $V_{D1}$ through the side (slit 35) of the movable member 31. However, a large movable member 31 for covering the entire bubble generating area 11 (covering the surface of the heat generating element) as shown in FIGS. 65A, 65B, 65C and 65D is used to direct the pressure of the bubble to the discharge port 18 more effectively. In this case, after the movable member 31 is returned to the first position, if the flow resistance between the bubble generating area 11 and an area (near the discharge port 18) of the liquid passage 10 becomes great, the flow of the liquid from the direction $V_{D1}$ to the bubble generating area 11 is blocked. However, in the head arrangement according to the illustrated embodiment, since the liquid is supplied to the bubble generating area 11 from the direction $V_{D2}$, the liquid supply ability is extremely improved. Thus, even when the arrangement wherein the bubble generating area 11 is covered by the movable member 31 to improve the discharging efficiency is used, the liquid supplying ability is not worsened.

By the way, regarding the positions of the free end 32 and the fulcrum 33 of the movable member 31, for example, as shown in FIGS. 65A, 65B, 65C and 65D, the free end 32 is disposed at a downstream side of the fulcrum 33. With this arrangement, when the bubble is being formed, the pressure transmitting direction and the growing direction of the bubble 40 can be oriented or directed toward the discharge port 18 effectively. Further, this positional relation not only contributes the improvement of the discharging efficiency or ability but also reduces flow resistance of the liquid flowing through the liquid passage 10 during the supply of liquid, thereby achieving the high speed refill. The reason is that, when the meniscus M retarded due to the liquid discharging is restored toward the discharge port 18 by a capillary phenomenon and/or when the liquid is supplied to compensate the disappeared bubble, the free end 32 and the fulcrum 33 are arranged not to resist against the liquid flows Sl, S2, S3 flowing in the liquid passage 10.

Further, in FIGS. 65A, 65B, 65C and 65D, as mentioned above, regarding the heat generating element 2, the free end 32 of the movable member 31 extends up to the position downstream of the center 3 of the area of the heat generating element 2 (i.e., downstream of the line passing through the center of the area of the heat generating element and extending perpendicular to the length of the liquid passage 10). Thus, the pressure and the downstream portion of the bubble 40 which are generated at the downstream side of the center 3 of the area of the heat generating element and greatly contribute to the liquid discharging are supported by the movable member 31, with the result that the pressure and the bubble are directed toward the discharge port 18, thereby improving the discharging efficiency and discharging force.

In addition, by utilizing the upstream portion of the bubble, various advantages can be achieved.

Further, in the illustrated embodiment, the momentary mechanical displacement of the free end 32 of the movable member 31 also contributes to the improvement of the liquid discharging.

(Twentieth Embodiment)

Figure 68:
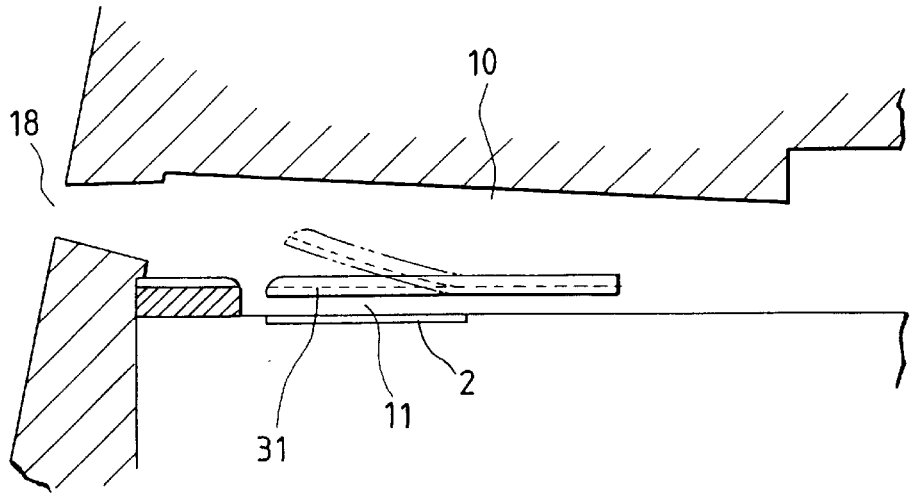
FIG. 68 is a schematic sectional view of a liquid discharging head according to a twentieth embodiment of the present invention.
Figure 69:
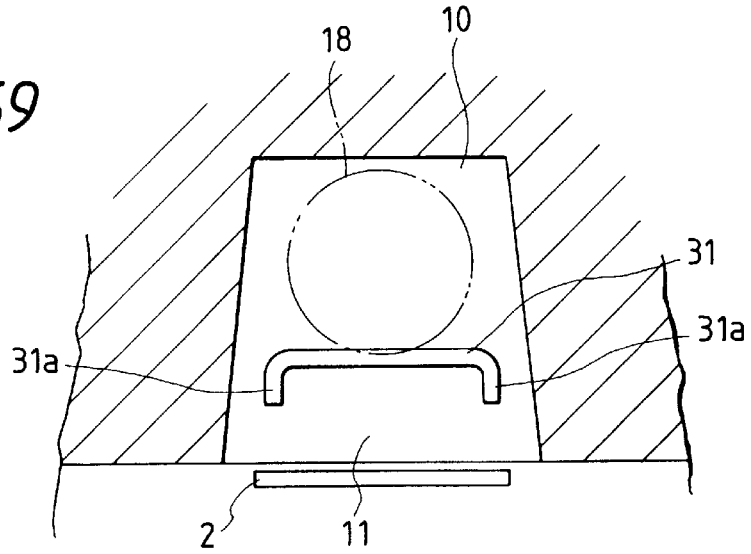
FIG. 69 is a schematic sectional view of the liquid discharging head of FIG. 68, looked at from a discharge port side.

FIG. 68 is a schematic sectional view of a liquid discharging head according to a twentieth embodiment of the present invention, and FIG. 69 is a schematic sectional view of the liquid discharging head of FIG. 68, looked at from a discharge port side.

In this twenty embodiment, upright wall portions 31*a* extending toward the heat generating element 2 are integrally formed with both lateral edges of a movable member 31 similar to that of the nineteenth embodiment. The upright wall portions 31*a* are disposed outside of the bubble generating area 11 in a width-wise direction of the movable member 31 so that both sides of the bubble generated in the bubble generating area 11 are covered by the upright wall portions 31*a*.

With this arrangement, when the movable member 31 is displaced, as is in the nineteenth embodiment, the resistance of the liquid in the liquid passage 10 is reduced and the bubble pressure is prevented from escaping laterally, thereby utilizing the bubble pressure to the displacement of the movable member 31 more effectively. Further, since the release of pressure toward directions other than the discharge port direction due to the displacement of the movable member 31 is suppressed to effectively direct the bubble pressure toward the discharge port 18, the pressure of the bubble contributes to the liquid discharging more effectively.

(Twenty-first Embodiment)

Figure 70:
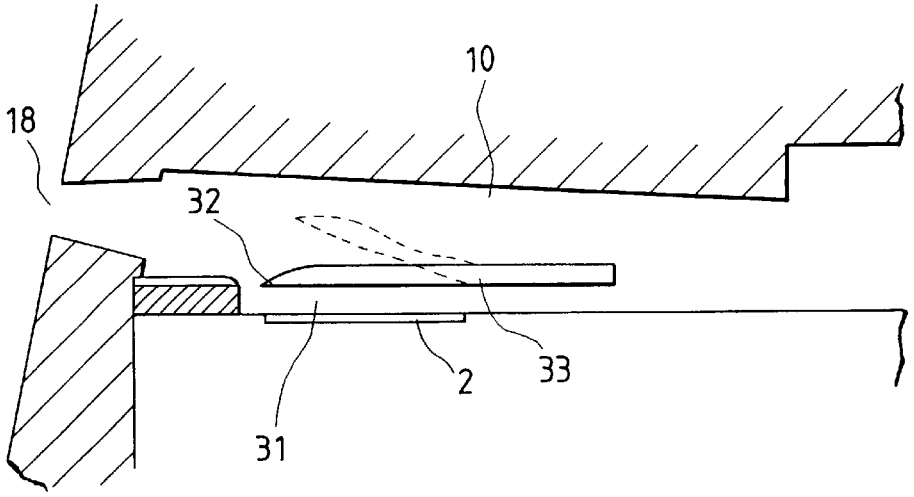
FIG. 70 is a schematic sectional view of a liquid discharging head according to a twenty-first embodiment of the present invention.

FIG. 70 is a schematic sectional view of a liquid discharging head according to a twenty-first embodiment of the present invention.

Also in this embodiment, although a movable member 31 similar to that of the nineteenth embodiment, a thickness of the movable member is gradually decreased from the fulcrum 33 to the free end 32. With this arrangement, when the movable member 31 is displaced, since the resistance of the liquid in the liquid passage 10 becomes further small and the free end 32 can be greatly displaced, the bubble can positively be grown toward the discharge port 18.

(Twenty-second Embodiment)

Now, a twenty-second embodiment of the present invention will be explained with reference to FIGS. 71, 72, 73A and 73B.

Also in this embodiment, although the main liquid discharging principle is the same as the previous embodiments, in this embodiment, the liquid passage has a multi-passage structure so that the liquid in which the bubble is formed by applying the heat (bubble liquid) can be isolated from the liquid to be discharged (discharge liquid).

Figure 71:
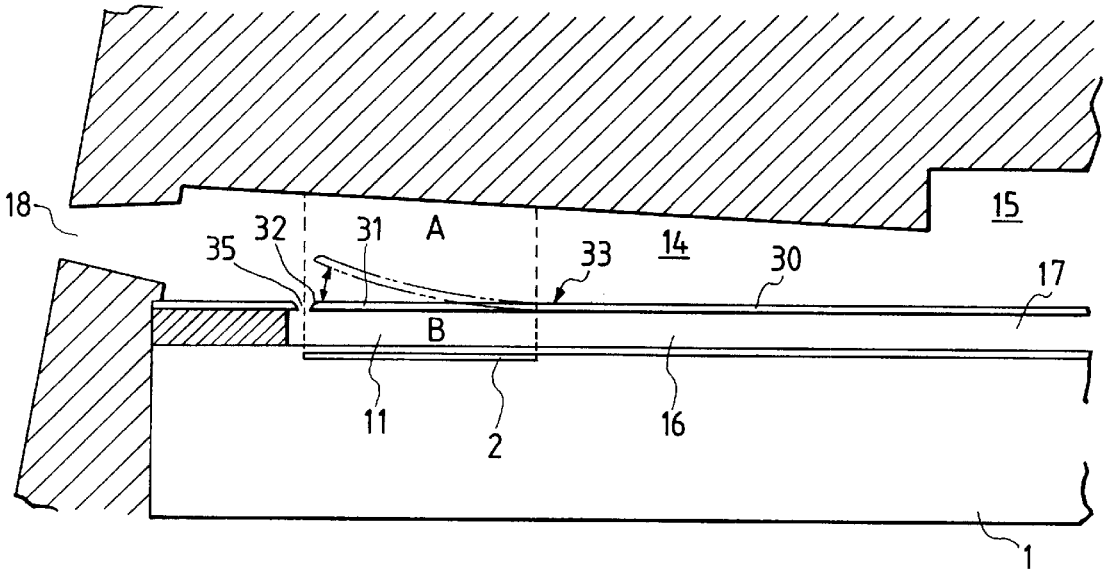
FIG. 71 is a sectional view of a liquid discharging head (two liquid passages) according to a twenty-second embodiment of the present invention.
Figure 72:
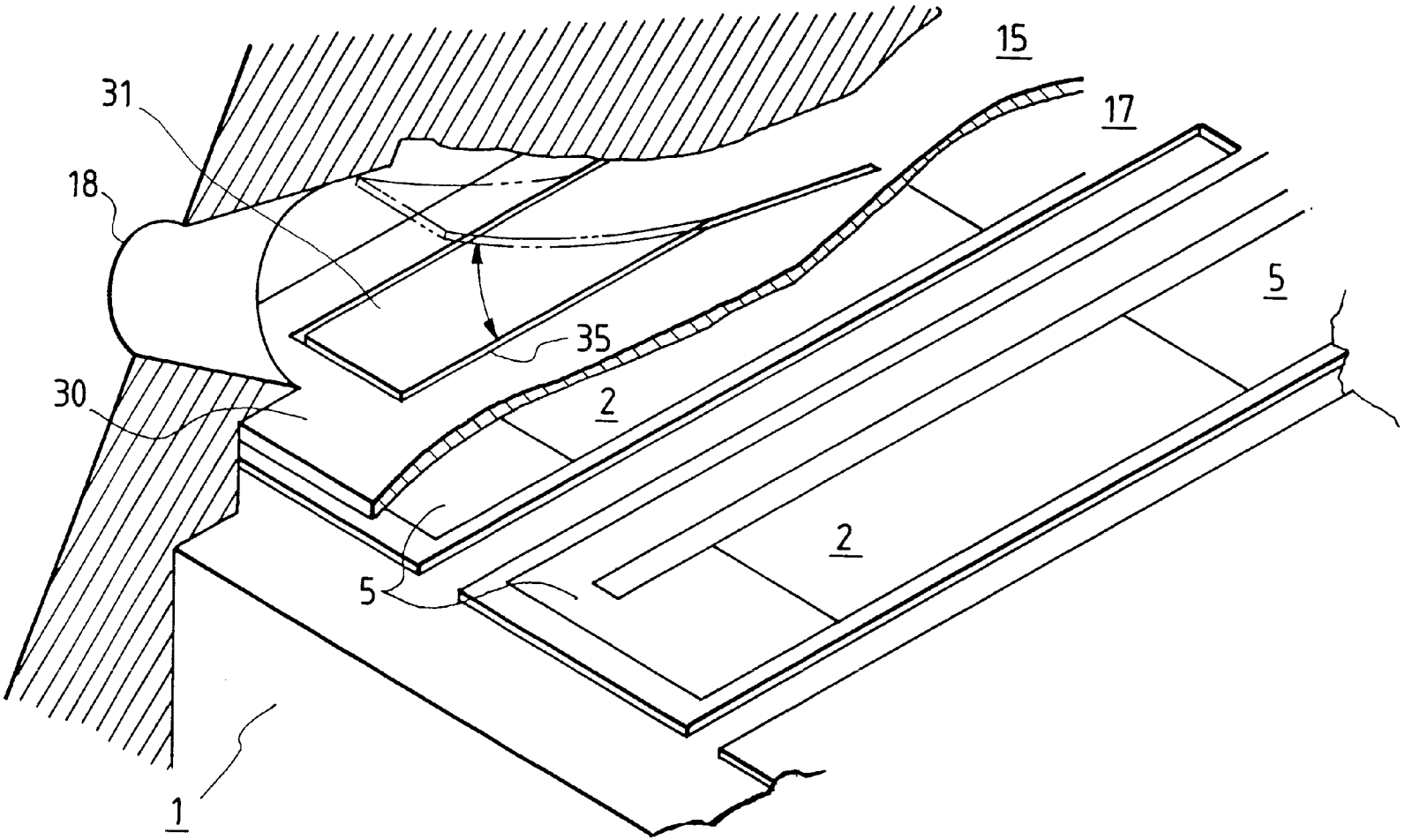
FIG. 72 is a partial fragmental perspective view of the liquid discharging head of FIG. 71.

FIG. 71 is a schematic sectional view of a liquid passage structure of a liquid discharging head according to this embodiment, and FIG. 72 is a partial fragmental perspective view of the liquid discharging head.

The liquid discharging head according to this embodiment includes an element substrate 1 on which heat generating elements 2 for applying thermal energy for forming a bubble in the liquid are arranged, a second liquid passage 16 for the bubble liquid disposed on the element substrate 1, and a first liquid passage 14 for the discharge liquid directly communicated with the discharge port 18 and disposed above the second liquid passage.

An upstream side portion of the first liquid passage 14 is communicated with a first common liquid chamber 15 for supplying the discharge liquid to a plurality of first liquid passages 14, and an upstream side portion of the second liquid passage 16 is communicated with a second common liquid chamber 17 for supplying the bubble liquid to a plurality of second liquid passages 16.

A separation wall 30 made of material having elasticity such as metal is disposed between the first liquid passage 14 and the second liquid passage 16 to isolate the first liquid passage 14 from the second liquid passage 16. Incidentally, when the mixing between the bubble liquid and the discharge liquid is desired to prevent as much as possible, the liquid in the first liquid passage 14 is isolated from the liquid in the second liquid passage 16 by the separation wall 30 as much as possible; whereas, when the bubble liquid and the discharge liquid may be mixed to some extent, the separation wall 30 may not have the perfect separation function.

A portion of the separation wall 30 positioned in an upper projection space regarding the heat generating element 2 (referred to as "discharge pressure generating area" hereinafter; an area A and an area B of the bubble generating area 11 in FIG. 71) constitutes a movable member 31 (supported in a cantilever fashion) having a free end 32 opened toward the discharge port 18 (i.e., toward a downstream side in the liquid flowing direction) through a slit 35, and a fulcrum 33 disposed at the common liquid chamber (15, 17) side. Since the movable member 31 is disposed in a confronting relation to the bubble generating area 11 (B), the movable member is moved (as shown by the arrow) by the bubble in the bubble liquid to be opened toward the discharge port 18 in the first liquid passage 14. In FIG. 72, the separation wall 30 is disposed, with the interposition of a space for defining a second liquid passage, on the element substrate 1 on which heat generating resistance bodies as the heat generating elements 2 and electrodes 5 for applying an electrical signal to the heat generating body are disposed.

The positional relation between the fulcrum 33 and the free end 32 of the movable member 31 and the heat generating element 2 are the same as the former embodiments. Further, regarding the cross-section of the movable member 31, as is in the previous embodiment, a width of the movable member is gradually decreased from the surface facing to the heat generating element 2 to the opposite surface, so that, when the movable member 31 is displaced, the resistance to the liquid in the first liquid passage 14 becomes smaller.

Further, while the structural relation between the liquid supply passage 12 and the heat generating element 2 was explained in the previous embodiments, also in this embodiments, a structural relation between the second liquid passage 16 and the heat generating element 2 is the same as the above-mentioned structural relation.

Next, an operation of the liquid discharging head according to this embodiment will be explained with reference to FIGS. 73A and 73B.

Regarding the operation of the head, as the discharge liquid supplied to the first liquid passage 14 and the bubble liquid supplied to the second liquid passage 16, the same water-base ink is used. When the bubble liquid in the bubble generating area 11 in the second liquid passage 16 is subjected to the heat from the heat generating element 2, as is in the former embodiments, a bubble 40 is formed in the bubble liquid by film-boiling phenomenon as disclosed in U.S. Pat. No. 4,723,129.

Figure 73A:
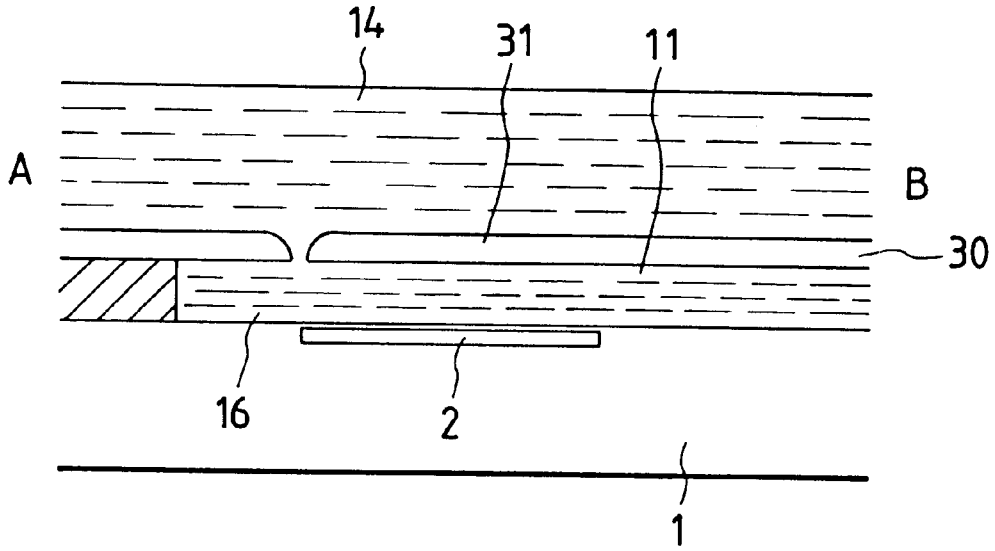
FIGS. 73A and 73B are views for explaining an operation of a movable member.
Figure 73B:
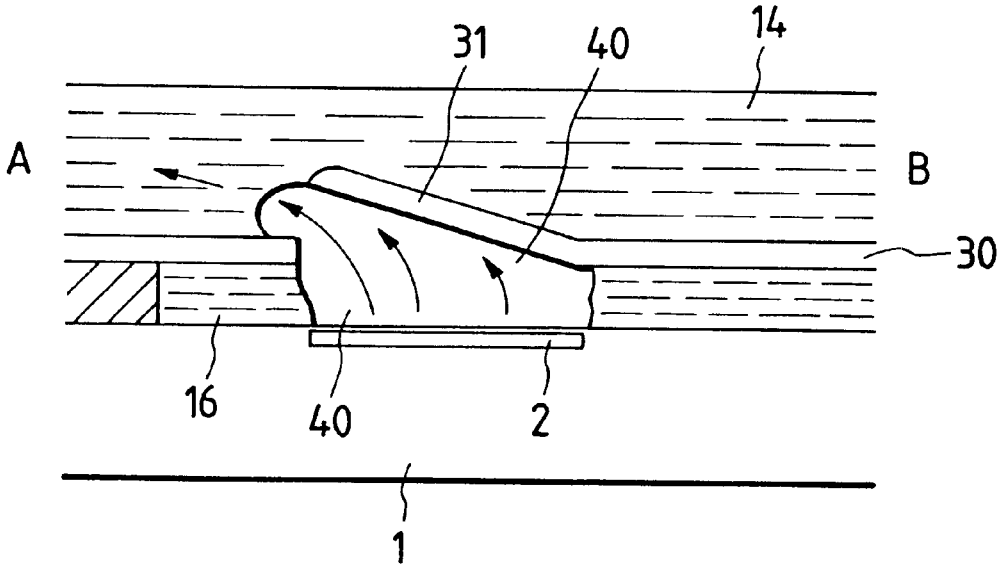

In this embodiment, since the bubble pressure cannot escape except through the upstream side of the bubble generating area 11, the pressure caused by the formation of the bubble is concentrated and transmitted toward the movable member 31 disposed at the discharge pressure generating portion, so that, as the bubble 40 is growing, the movable member 31 is displaced from a condition shown in FIG. 73A to a condition shown in FIG. 73B toward the first liquid passage 14. This movement of the movable member 31 causes the second liquid passage 16 to greatly communicate with the first liquid passage 14, with the result that the pressure of the bubble 40 is mainly transmitted to a direction toward the discharge port in the first liquid passage 14 (i.e., direction A). The liquid is discharged from the discharge port by such transmission of the pressure and the mechanical displacement of the movable member 31.

Then, as the bubble 40 is being disappeared, the movable member 31 is returned to the condition shown in FIG. 73A, and, in the first liquid passage 14, the discharge liquid corresponding to an amount of the discharged liquid is supplied from the upstream side. Also in this embodiment, since the supply of the discharge liquid is effected toward a direction for closing the movable member 31 as is in the former embodiments, the refill of the discharge liquid is not prevented by the movable member 31.

While the function and advantage regarding the easy displacement of the movable member 31, the transmission of the bubble pressure due to the displacement of the movable member 31, the growing direction of the bubble 40 and the prevention of the back-wave in this embodiment are the same as the first embodiment, the two-liquid passage structure of this embodiment further provides the following advantages.

That is to say, according to the arrangement of this embodiment, since the discharge liquid and the bubble liquid are isolated from each other, the discharge liquid can be discharged by the pressure of the bubble formed in the bubble liquid. Thus, even when high-viscous liquid such as polyethylene or glycol in which a bubble is not adequately formed and provides only poor discharging force is used, by supplying such high-viscous liquid in the first liquid passage 14 and by supplying liquid (mixture of ethanol:water=4:6; about 1–2 cp) or low boiling point liquid in which a bubble can easily be formed in the second liquid passage 16, the good discharging can be achieved.

Further, by selecting liquid in which deposit due to heat is not accumulated on the surface of the heat generating element 2 as the bubble liquid, the formation of the bubble can be stabilized and good discharging can be achieved.

In addition, since the head according to this embodiment provides the advantages same as the former embodiments, the liquid such as high-viscous liquid can be discharged with high discharging efficiency and high discharging force.

Further, even when liquid having poor resistance to heat is used, by supplying such liquid in the first liquid passage 14 and by supplying liquid having good resistance to heat and facilitating the formation of the bubble in the second liquid passage 16, the liquid can be discharged with high discharging efficiency and high discharging force and without thermal damage of the liquid.

Other Embodiments

While the embodiments regarding the liquid discharging head and liquid discharging method of the present invention were explained, now, examples applicable to the above embodiments will be explained. Incidentally, hereinbelow, although explanation is made regarding the embodiment of one-passage type or the embodiment of two-passage type in some cases, the other cases can be applied to both embodiments of one-passage type and of two-passage type.

Configuration of Ceiling of Liquid Passage

Figure 24:
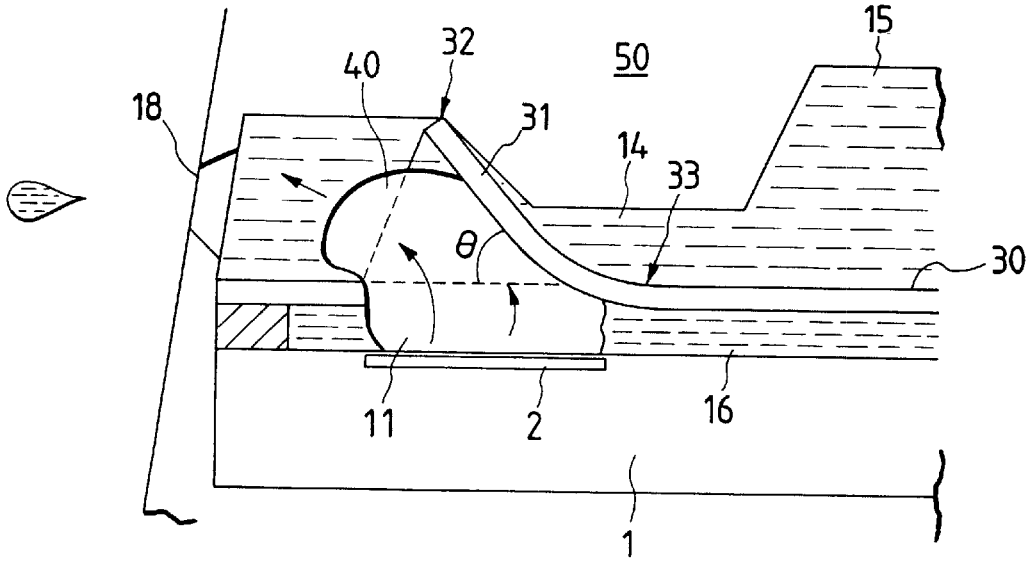
FIG. 24 is a sectional view for explaining structures of a movable member and a first liquid passage.

FIG. 24 is a sectional view of a liquid passage structure of the liquid discharging head according to the present invention. A grooved member 50 having a groove for constituting the first liquid passage 14 (or liquid passage 10 in FIGS. 1A, 1B, 1C and 1D) is provided on the separation wall 30. In this example, a ceiling of the liquid passage at a position near the free end 32 of the movable member 31 is elevated so that a displacement angle θ of the movable member 31 can be greater. Although the displacement range of the movable member 31 may be determined in consideration of the structure of the liquid passage, durability of the movable member 31 and the force of the bubble, it is desirable that the movable member can be displaced up to an angle including an axial angle of the discharge port 18.

Further, as shown, by selecting so that the displacement height of the free end 32 of the movable member 31 becomes greater than the diameter of the discharge port 18, more adequate discharging force can be transmitted. Further, as shown, since the height of the ceiling of the liquid passage at the free end 32 of the movable member 31 is higher than the height of the ceiling of the liquid passage at the fulcrum 33 of the movable member 31, the upstream escape of the pressure wave due to the displacement of the movable member 31 can be prevented more effectively.

As the structure of the movable member 31, although a design including the thin diaphragm having the expansion/contraction portions and a design including the side walls can be used, when the displacement angle θ of the movable member 31 can be greater, in case of the structure including the side walls, the heights of the side walls must be increased in accordance with the displacement angle θ of the movable member 31 in order to positively cover the both sides of the growing bubble 40. Accordingly, the height of the second liquid passage 16 is also increased in accordance with the heights of the side walls, with the result that, since the thickness of the entire liquid discharging head is increased accordingly, it is preferable that the design including the thin diaphragm having the expansion/contraction portions is applied to the structure of the movable member 31.

Positional Relation Between Second Liquid Passage and Movable Member

Figure 25A:
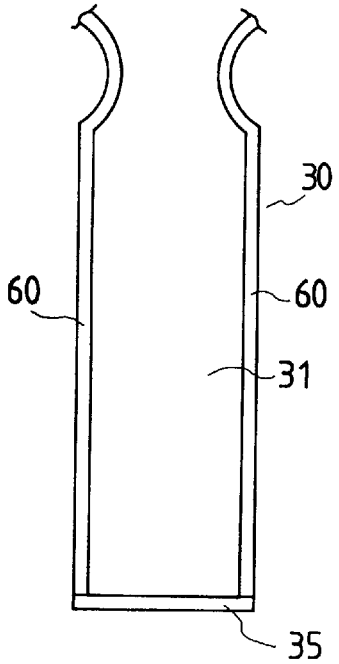
FIGS. 25A, 25B and 25C are views for explaining structures of a movable member and a liquid passage.
Figure 25B:
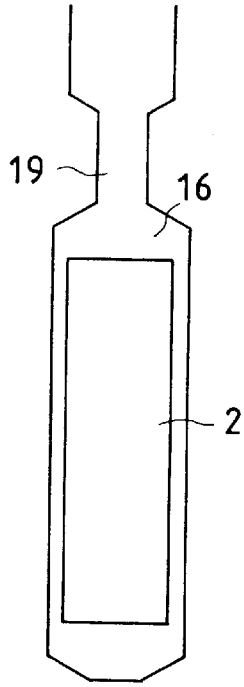
Figure 25C:
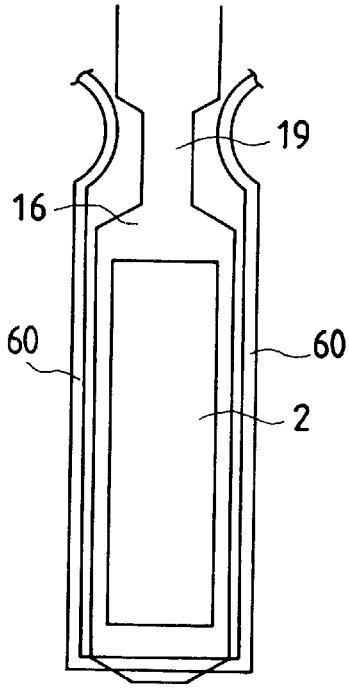

FIGS. 25A, 25B and 25C are views for explaining a positional relation between the movable member 31 and the second liquid passage 16. In this case, the movable member 31 includes the thin diaphragm having the expansion/contraction portions 60. FIG. 25A shows the separation wall 30 and the movable member 31 looked at from the above, and FIG. 25B shows the second liquid passage 16 (but, the separation wall 30 is removed) looked at from the above. FIG. 25C schematically shows a positional relation between the movable member 31 and the second liquid passage 16 in an overlapped condition. Incidentally, these figures front faces below which the discharge ports are disposed.

Figure 64A:
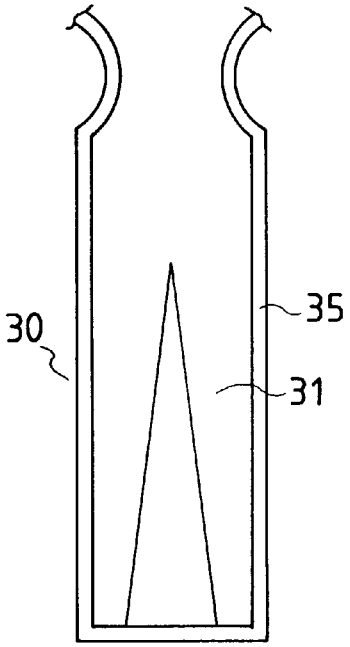
FIGS. 64A, 64B and 64C are views for explaining a positional relation between a second liquid passage and a movable member.
Figure 64B:
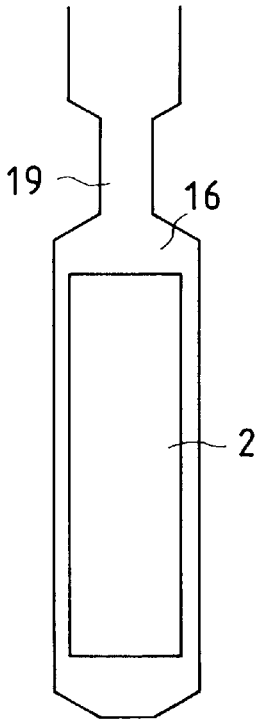
Figure 64C:
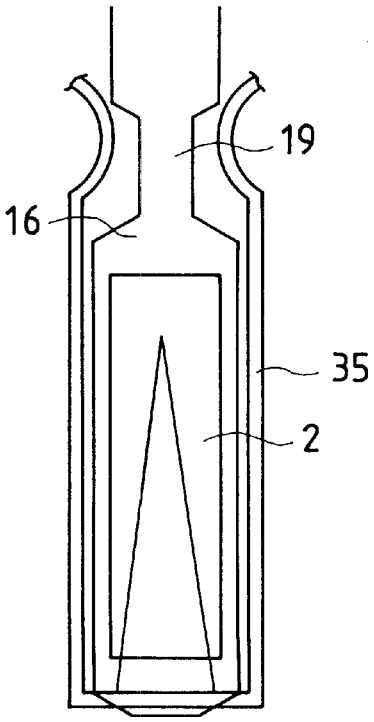

Further, FIGS. 64A, 64B and 64C are views for explaining a positional relation between the movable member 31 and the second liquid passage 16 according to the above-mentioned fifteenth to eighteenth embodiments. FIG. 64A shows the separation wall 30 and the movable member 31 looked at from the above, and FIG. 64B shows the second liquid passage 16 (but, the separation wall 30 is removed) looked at from the above. FIG. 64C schematically shows a positional relation between the movable member 31 and the second liquid passage 16 in an overlapped condition. Incidentally, these figures front faces below which the discharge ports are disposed. Further, a triangular portion of the movable member 31 shows an outline of a convex portion formed on the opposite surface (upper surface) when the recessed portion is formed in the surface of the movable member 31 facing to the heat generating element 2.

Furthermore, movable member 31 shown in FIGS. 74A, 74B, 74C and 74D are alterations of the movable member 31 shown in FIG. 67, and, in each alteration, a surface of the movable member facing the heat generating element is flat and a opposite surface is changed in configuration. Movable members 31 shown in FIGS. 74E, 74F, 74G and 74H are alterations of the movable members shown in FIGS. 74A, 74B, 74C and 74D, in which each surface facing to the heat generating element has the same configuration as that of the opposite surface and both lateral ends of each movable member are protruded toward the heat generating element more than a central portion of the movable member. With these arrangements, the same advantage as that of the movable member 31 shown in FIG. 8 can be achieved. In a movable member 31 shown in FIG. 74I, upright walls are added to both lateral ends of the movable member 31 shown in FIG. 74A. This is an alteration of the movable member 31 shown in FIG. 8.

The second liquid passage 16 has a restriction 19 at the upstream side of the heat generating element 2 (at an upstream side in the large flow directing from the second common liquid chamber through the heat generating element, movable member and first liquid passage to the discharge port), thereby providing a chamber (bubble liquid chamber) structure for suppressing the easy escape of the pressure of the bubble toward the upstream side of the second liquid passage 16.

As is in the conventional heads, in case of a head in which a liquid passage for the bubble liquid and a liquid passage for the discharge liquid are common and a restriction is provided for preventing pressure of a bubble generated in a liquid chamber by a heat generating element from escaping toward a common liquid chamber, it is necessary that area of flow at the restriction is no so large in consideration of the refill of the liquid.

To the contrary, in the illustrated embodiment, since the discharge liquid in the first liquid passage is mainly discharged and the bubble liquid in the second liquid passage including the heat generating element 2 is almost not consumed, a refilling amount of liquid in the bubble generating area of the second liquid passage may be less. Accordingly, since the gap at the restriction can greatly be reduced to several μm–ten-odd μm, the bubble pressure generated in the second liquid passage 16 can be prevented from escaping therearound, thereby concentrating the bubble pressure toward the movable member 31. Further, since the pressure can be used for the liquid discharging through the movable member 31, high discharging efficiency and high discharging force can be achieved. However, the configuration of the second liquid passage 16 is not limited to the above-mentioned one, but may be selected to transmit the bubble pressure to the movable member 31 effectively.

Both sides of the movable member 31 cover portions of walls defining the second liquid passage 16. With this arrangement, the movable member 31 can be prevented from dropping in the second liquid passage 16. As a result, the separation between the discharge liquid and the bubble liquid is further improved. Further, since the escaping of liquid through the slit 35 can be suppressed, the discharging force and discharging efficiency can be improved. In addition, the refilling effect due to the negative pressure during the disappearance of bubble (for supplying the liquid from the upstream side) can be enhanced.

Incidentally, in FIGS. 15B, 24 and 59B, when the movable member 31 is displaced toward the first liquid passage 14, a portion of the bubble 40 generated in the bubble generating area 11 of the second liquid passage 16 extends into the first liquid passage 14. By selecting the height of the second liquid passage 16 so that the bubble 40 can extend into the first liquid passage, the discharging force can be improved, in comparison with the case where the bubble 40 cannot extend. In order to permit the bubble 40 to extend into the first liquid passage 14, it is desirable that the height of the second liquid passage 16 is smaller than a height of a maximum bubble. This height is preferably several μm to 30 μm. In the illustrated embodiment, the height is selected to 15 μm.

In the illustrated embodiment, while the movable member 31 having the extension/contraction portions 60 was explained, the movable member 31 having the side walls 66 as shown in FIGS. 16, 17A, 17B, 18A and 18B may be used. In this case, portions designated by the reference numeral 60 in FIGS. 25A, 25B and 25C constitute the slit 35, and the movable member 31 is defined by the slit 35. Further, the side walls 66 of the movable member 31 are disposed inside of the second liquid passage 16.

The material for forming the movable member 31 and the separation wall 30 is insoluble to the bubble liquid and the discharge liquid and has elasticity permitting good operation of the movable member 31.

The material for the movable member 31 may be durable metal such as silver, nickel, gold, iron, titanium, aluminium, platinum, tantalum, stainless steel and bronze phosphite and its alloys, or, resin including nitrile group such as acrylonitrile, butadiene and styrene, or, resin including amide group such as polyamide, or, resin including calboxyl group such as polycarbonate, or, resin including aldehyde group such as polyacetal, or, resin including sulfone group such as polysulfone, or, other resins such as crystalliquid polymer and their compounds, or ink-resistance metal such as gold, tungsten, tantalum, nickel, stainless steel and titanium and its alloys. Regarding the ink-resistance, materials on which such metal is coated, or, resin including amide group such as polyamide, or, resin including aldehyde group such as polyacetal, or, resin including ketone group such as polyether-etherketone, or, resin including imide group such polyimide, or, resin including hydro-group such as phenol resin, or, resin including ethyl group such as polyethylene, or, resin including alkyl group such as polypropylene, or, resin including epoxy group such as epoxy resin, or, resin including amino group such as melamine resin, or, resin including methylol group such as xylene resin and their compounds, or, ceramics such as silicon dioxide and its compounds.

The material for the separation wall 30 may be insoluble resin having good heat-resistance and good molding ability (for example, engineering plastics) such as polyethylene, polypropylene, polyamide, polyethylene terephthalate, melamine resin, phenol resin, epoxy resin, polybutadiene, polyurethane, polyether-etherketone, polyether-sulfone, polyallylate, polyimide, polysulfone, liquid crystal polymer (LCP) and their compounds, or, metal such as silicon dioxide, silicon nitride, nickel, gold and stainless steel and its alloys and compounds, or, materials on which titanium or gold is coated.

Incidentally, while a width of the slit 35 was selected to 2 μm in the illustrated embodiment, when the bubble liquid differs from the bubble liquid and the mixing of these liquids is desired to be prevented, the width of the slit may be selected so that the meniscus is formed between the liquids to suppress the mixing of liquids. For example, when liquid having about 2 cp (centipoise) is used as the bubble liquid and liquid having 100 cp or more is used as the discharge liquid, although the mixing of liquids can be prevented by a slit 35 of about 35 μm, the slit is preferably 3 μm or less.

Further, although a thickness of the separation wall 30 may be determined in consideration of its material and configuration to achieve the adequate strength as the separation wall 30, the thickness is preferably about 0.5–10 μm.

In the illustrated embodiment, the thickness of the movable member is in the order of μm (t μm), and the thickness of the movable member in the order of cm is not required. Regarding the movable member having the thickness in the order of μm, when the slit having a width (W μm) in the order of μm is formed, it is desirable that manufacturing tolerance is considered.

When a thickness of the free end of the movable member in which the slit is formed and/or a thickness of a member facing to the lateral ends is the same as the thickness of the movable member (FIGS. 15A, 15B, 24 and the like), a relation between the thickness and the width of the slit is selected within the following range in consideration of the manufacturing tolerance of unevenness so that the mixing of the liquids can stably be suppressed. Thus, from the view point of design, when high viscous ink (for example, 5 cp, 10 cp) is used in association with the bubble liquid having viscosity of 3 cp or less, by satisfying a relation $W/t \leqq 1$, the mixing of two liquids can be prevented for a long time.

In order to achieve a "substantially sealed condition" in the present invention, the slit may be in the order of several μm.

As mentioned above, when the bubble liquid is isolated from the discharge liquid, the movable member acts as a partition. When the movable member is shifted during the growth of the bubble, a very small amount of the bubble liquid is mixed with the discharge liquid. In case of ink jet recording, when it is considered that the discharge liquid for forming an image normally has color density of about 3%–5%, if the bubble liquid of 20% or less is mixed with the discharge liquid, the change intensity does not occur. Accordingly, in the present invention, even if the bubble liquid is mixed with the discharge liquid, a mixing amount of the bubble liquid with the discharge liquid is suppressed below 20%.

Incidentally, it was found that, even when the viscosity is changed, the mixing amount of the bubble liquid was 15% at the maximum, and, regarding the liquid having 5 cps or less, the maximum mixing amount was about 10%.

Particularly, the smaller the viscosity of the discharge liquid (20 cps or less) the smaller the mixing amount (for example, 5% or less).

Movable Member and Separation Wall

Figure 26A:
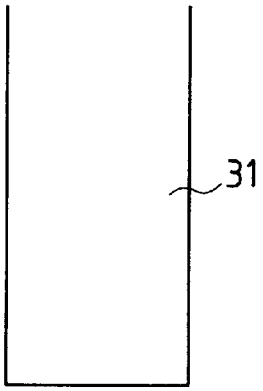
FIGS. 26A, 26B and 26C are views for explaining another configuration of a movable member.
Figure 26B:
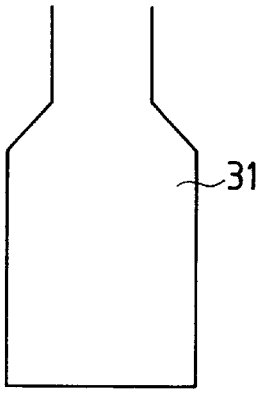
Figure 26C:
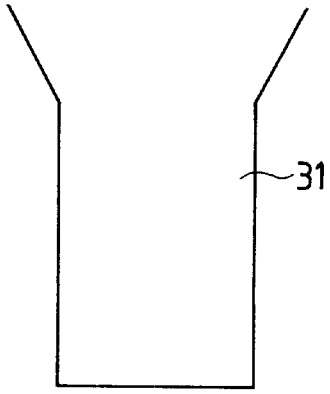

FIGS. 26A, 26B and 26C show another configurations of the movable member 31. FIG. 26A shows a rectangular movable member, FIG. 26B shows a movable member having a narrower fulcrum to facilitate the displacement of he movable member 31, and FIG. 26C shows a movable ember having a wider fulcrum to improve the durability f the movable member 31. Regarding a configuration providing good displacement and durability, as shown in FIG. 25A, a movable member including a fulcrum having a concave narrower portion is desirable. However, the movable member may have any configuration so long as the movable member does not penetrate into the second liquid passage 16 and can easily be displaced and has good durability.

FIGS. 60A, 60B, 61A, 61B, 62A, 62B, 63A and 63B show various configurations of the movable member. FIGS. 60A, 61A, 62A and 63A are end views of the movable member 31, looked at from the free end 32, and FIGS. 60B, 61B, 62B and 63B are side views of the movable member 31 and the heat generating element 2.

Figure 60A:
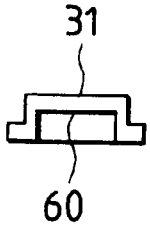
FIGS. 60A and 60B are views showing an alteration of a configuration of a recess of the movable member.
Figure 60B:
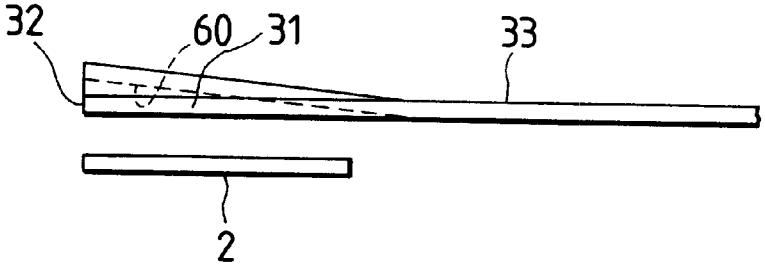

In the movable member 31 shown in FIGS. 60A and 60B, the recessed portion 60 has a rectangular cross-section, and its width and depth are gradually decreased from the free end 32 to the fulcrum 33. Further, a terminal end of the recessed portion 60 near the fulcrum 33 is positioned at an upstream side of the heat generating element 2.

Figure 61A:
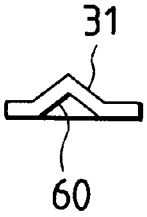
FIGS. 61A and 61B are views showing another alteration of the configuration of the recess of the movable member.
Figure 61B:
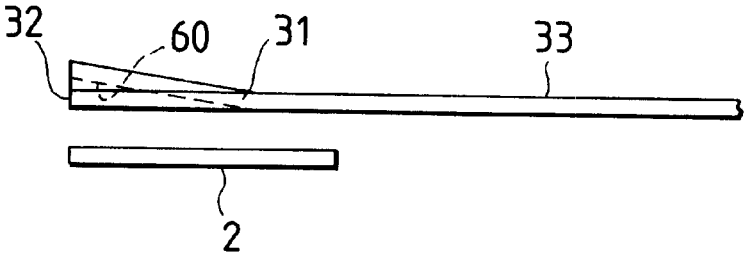

In the movable member 31 shown in FIGS. 61A and 61B, the recessed portion 60 has a triangular cross-section, and its width and depth are gradually decreased from the free end 32 th the fulcrum 33. Further, a terminal end of the recessed portion 60 near the fulcrum 33 is positioned at a downstream side of the heat generating element 2.

Figure 62A:
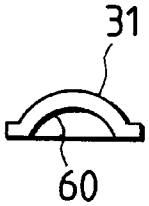
FIGS. 62A and 62B are views showing a further alteration of the configuration of the recess of the movable member.
Figure 62B:
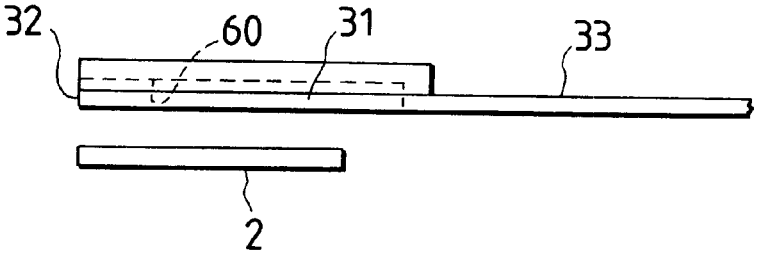

In the movable member 31 shown in FIGS. 62A and 62B, the recessed portion 60 has a semi-circular cross-section, and its width and depth are constant. Further, a terminal end of the recessed portion 60 near the fulcrum 33 is positioned at an upstream side of the heat generating element 2.

Figure 63A:
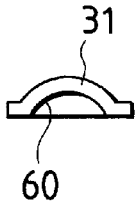
FIGS. 63A and 63B are views showing a still further alteration of the configuration of the recess of the movable member.
Figure 63B:
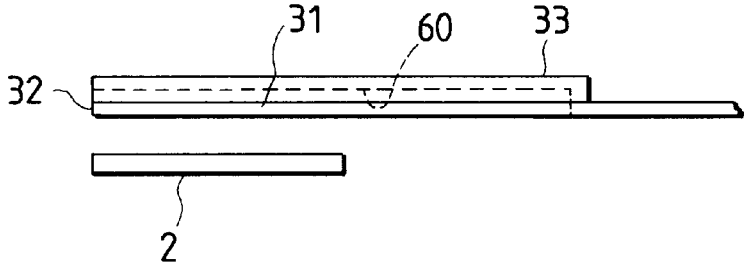

In the movable member 31 shown in FIGS. 63A and 63B, a configuration of the recessed portion 60 is the same as that shown in FIGS. 62A and 62B, but, a terminal end of the recessed portion 60 near the fulcrum 33 is positioned at an upstream side of both the heat generating element 2 and the fulcrum 33.

In the movable members 31 shown in FIGS. 60A, 60B, 61A, 61B, 62A, 62B, 63A and 63B, the bubble pressure can be directed to the discharge port efficiently. Particularly, in the movable members 31 shown in FIGS. 60A, 60B, 61A and 61B in which the width and depth of the recessed portion 60 are gradually decreased toward the fulcrum, the bubble pressure can be directed to the discharge port more efficiently.

Next, a positional relation between the heat generating element and the movable member in the head will be explained with reference to the accompanying drawings. However, configurations, dimensions and number of the movable member and heat generating element are not limited to the following example. The bubble pressure can be used as the discharging force effectively by selecting optimum positional relation between the heat generating element and the movable member.

Figure 27:
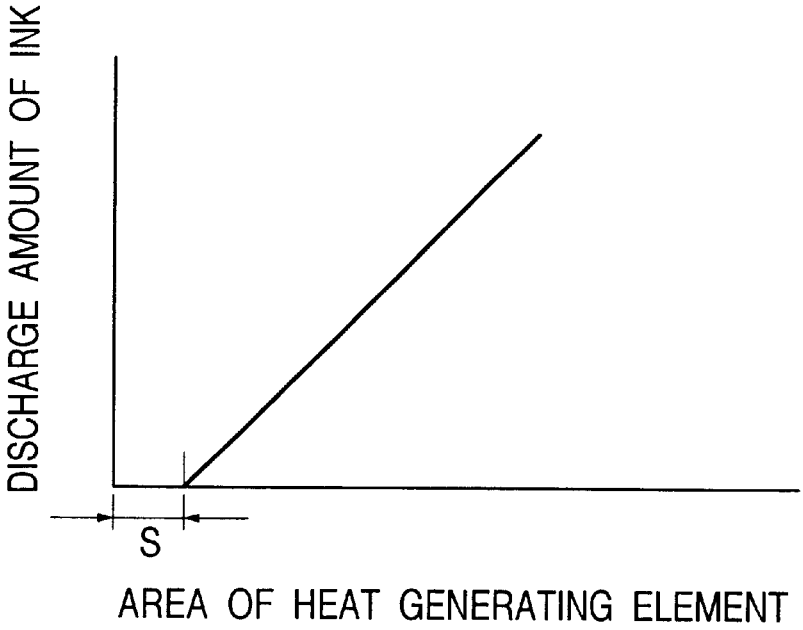
FIG. 27 is a graph showing a relation between an area of a heat generating element and a discharge amount of ink.

In the conventional techniques regarding the ink jet recording system. i.e., so-called bubble jet recording system in which change in state of ink including abrupt change in volume (generation of bubble) is caused by supplying energy such as heat to the ink and the ink is discharged from a discharge port by an action force based on the change in state to adhere the ink onto a recording medium, as shown in FIG. 27, although an area of the heat generating element is proportional to the ink discharge amount, there is a non-effective bubble generating area S which does not contribute to the ink discharging. Further, it can be under stood that such a non-effective bubble generating area S is situated at a peripheral portion of the heat generating element by checking the deposit on the heat generating element. From these results, it has seen recognized that a peripheral zone, having a width of about 4 $\mu$m, of the heat generating element does not contribute to the generation of the bubble.

Accordingly, in order to effectively utilize the bubble pressure, it is effective that a portion of the bubble generating area except for the peripheral zone having the width of about 4 $\mu$m is covered by the movable portion of the movable member from the above. In the illustrated embodiment, while an example that the effective bubble generating zone is considered as the portion of the bubble generating area except for the peripheral zone having the width of about 4 $\mu$m was explained, depending upon the kind and/or manufacturing method of the heat generating element, the effective zone is not limited to the above example.

Figure 28A:
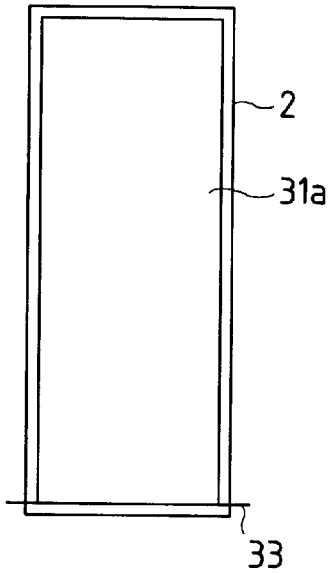
FIGS. 28A and 28B are views showing a positional relation between a movable member and a heat generating element.
Figure 28B:
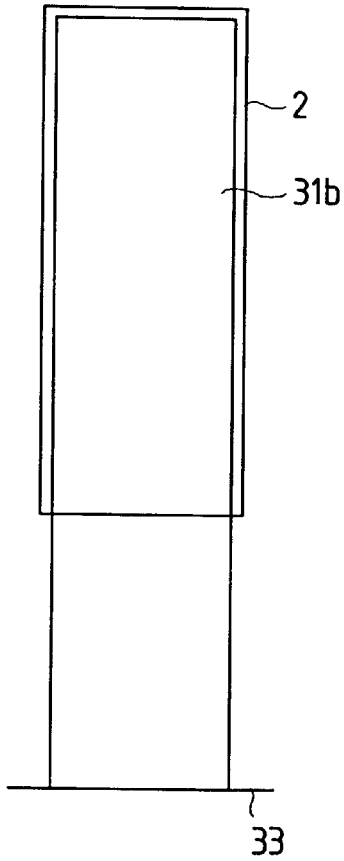

FIGS. 28A and 28B are schematic plan views showing conditions that a movable member 31*a* (FIG. 28A) and a movable member 31*b* (FIG. 28B) which have different area of the movable portion are arranged on the heat generating element 2 having a dimension of 58×150 $\mu$m.

The movable member 31*a* has a dimension of 53×145 $\mu$m which is slightly smaller than that of the heat generating element 2 and is arranged to cover the effective bubble generating zone. On the other hand, the movable member 31*b* has a dimension of 53×220 $\mu$m which is greater than that of the heat generating element 2 (i.e., when width is the same, the dimension between the fulcrum and the free end is longer than that of the heat generating element 2) and is arranged to cover the effective bubble generating zone, as is in the movable member 31*a*. Regarding two movable members 31*a*, 31*b*, durability and discharging efficiency were measured. The measuring condition was as follows:

| | |
|---|---|
| Bubble liquid | ethanol 40% aqueous solution |
| Discharge ink | dye ink |
| voltage | 20.2 V |
| frequency | 3 kHz |

As a result of tests under such measuring condition, regarding the durability of the movable member, (a) when $1\times10^7$ pulses are applied to the movable member 31*a*, the fulcrum 33 of the movable member 31*a* was damaged; whereas, (b) even after $3\times10^8$ pulses were applied to the movable member 31*b*, no damage was found. Further, kinetic energy determined from discharge amount and discharge speed regarding the applied energy was recognized to be improved by about 1.5–2.5 times.

From the above results, regarding both durability and discharging efficiency, it is preferable that the effective bubble generating zone is covered from the above and it is desirable that the area of the movable member is greater than the area of the heat generating element.

Figure 29:
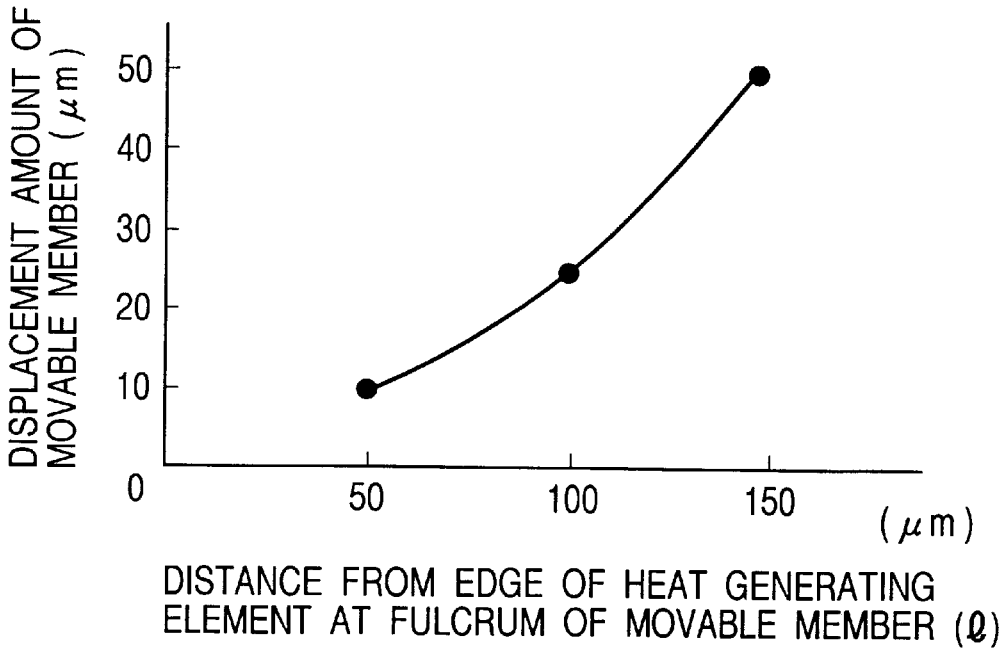
FIG. 29 is a graph showing a relation between a distance from an edge of a heat generating element at a fulcrum of a movable member and a displacement amount of the movable member.
Figure 30:
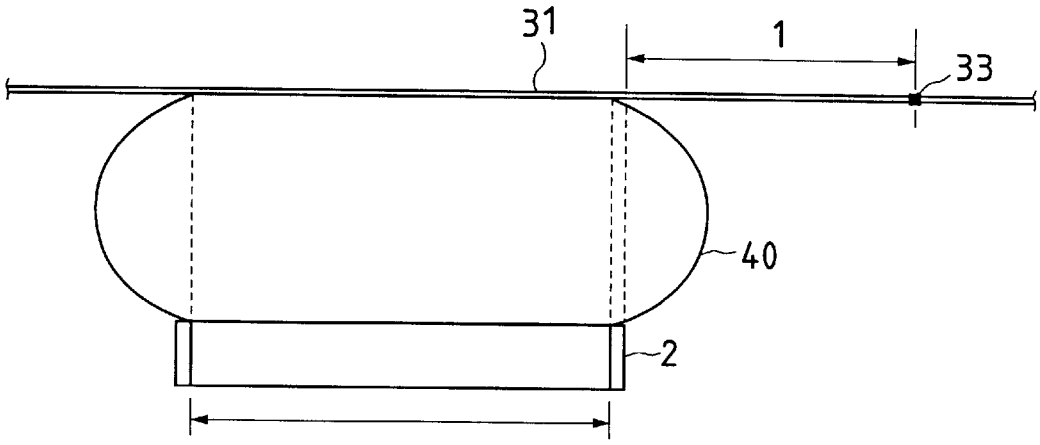
FIG. 30 is a view for explaining a positional relation between a heat generating element and a movable member.

FIG. 29 shows a relation between a distance from an edge of the heat generating element to the fulcrum of the movable member and the displacement amount of the movable member. Further, FIG. 30 is a side sectional view showing a relation between the heat generating element 2 and the movable member 31. The heat generating element 2 having the dimension of 40×105 $\mu$m was used. It can be seen that the greater the distance from the edge of the heat generating element 2 to the fulcrum of the movable member 31 the greater the displacement amount. Accordingly, it is desirable that the optimum displacement amount is determined depending upon the required ink discharge amount, the liquid passage structure and the configuration of the heat generating element, and the position of the fulcrum 33 of the movable member 31 is determined thereby.

If the fulcrum of the movable member is positioned above the effective bubble generating zone of the heat generating element, since the fulcrum is directly subjected to stress due to the displacement of the movable member and the bubble pressure, the durability of the movable member will be worsened. According to the inventor's tests, it was found that in the case where the fulcrum is positioned above the effective bubble generating zone, when $1\times10^6$ pulses are applied to the movable member, the movable wall is damaged, thereby reducing the durability. Therefore, by arranging the fulcrum of the movable member out of the effective bubble generating zone of the heat generating element, even a movable member having configuration and material having relatively small durability can be put to a practical use. However, even when the fulcrum is positioned above the effective bubble generating zone, by selecting the configuration and material of a movable member appropriately, the movable member can be used. With the above-mentioned arrangement, a liquid discharging head having high discharging efficiency and good durability can be obtained.

Element Substrate

Now, a construction of the element substrate on which the heat generating elements for applying the heat will be explained.

Figure 31A:
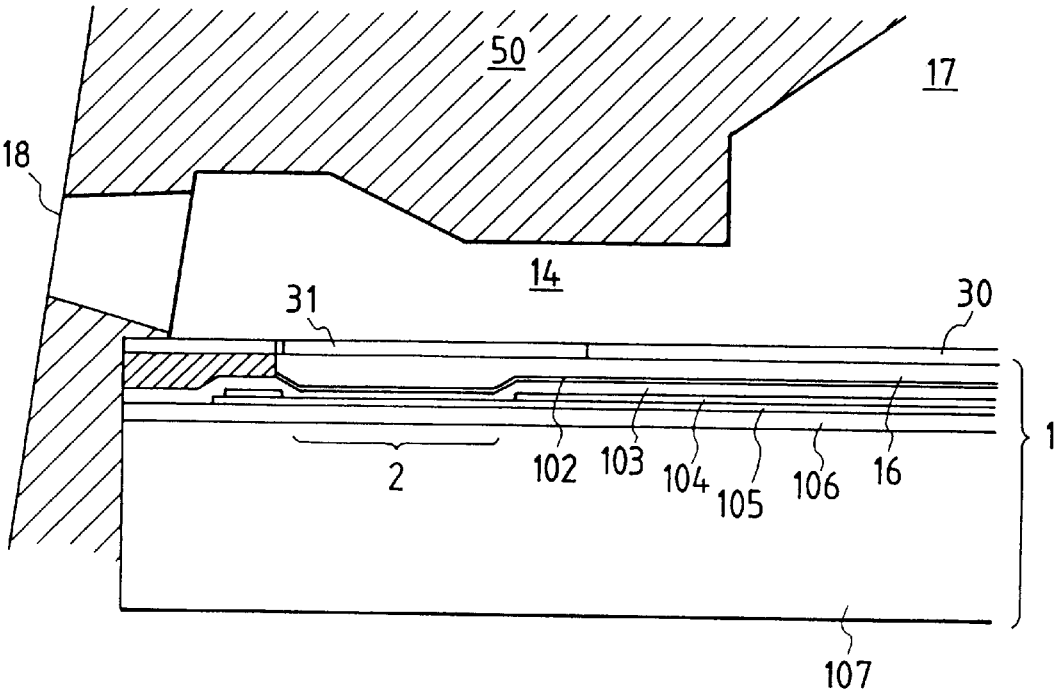
FIGS. 31A and 31B are longitudinal sectional views of a liquid discharging head according to the present invention.
Figure 31B:
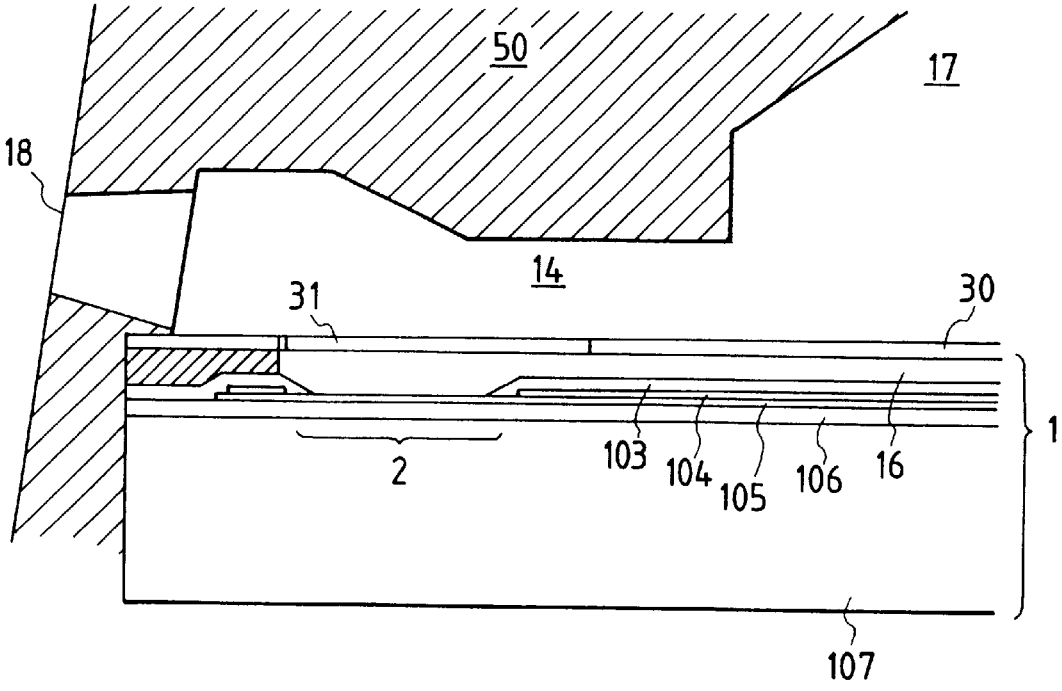

FIGS. 31A and 31B are sectional views of the liquid discharging head according to the present invention, where FIG. 31A shows a head having a protection layer (cavitation-resistance layer) which will be described later and FIG. 31B shows a head having no protection layer.

Above the element substrate 1, there are disposed the second liquid passage 16, separation wall 30, first liquid passage 14 and grooved member 50 having a groove defining the first liquid passage 14.

In the element substrate 1, silicon oxide film or silicon nitride film 106 (for the purpose of insulation and heat accumulation) is formed on a silicone substrate, and an electric resistance layer 105 (having a thickness of 0.01–0.2 $\mu$m) (constituting the heat generating elements 2) formed from hafnium boride ($HfB_2$), tantalum nitride (TaN) or tantalum aluminium (TaAl) and wiring electrodes 104 (having a thickness of 0.2–1.0 $\mu$m) made of aluminium are patterned on the film 106. By applying voltage from two wiring electrodes 104 to the electric resistance layer 105, current flows through the electric resistance layer 105, thereby generating heat. On the electric resistance layer 105, between the wiring electrodes 104, there is provided a protection layer 103 (having a thickness of 0.1–2.0 $\mu$m) made of silicon oxide or silicon nitride, and a cavitation-resistance layer 102 (having a thickness of 0.1–0.6 $\mu$m) made of tantalum is formed on the protection layer, thereby protecting the electric resistance layer 105 from various liquid such as ink.

Particularly, since the pressure and shock wave generated during the formation and disappearance of the bubble are very strong and worsens the durability of fragile oxide films, metal material such as tantalum (Ta) is used for forming the cavitation-resistance layer 102.

Further, by combining the liquids, liquid passage structure and resistance material appropriately, the cavitation-resistance layer 102 can be omitted. Such an example is shown in FIG. 31B. The material of the electric resistance layer 105 capable of omitting the cavitation-resistance layer may be iridium/tantalum/aluminium alloy.

In this way, as the construction of the heat generating element 2 in the former embodiments, only the electric resistance layer (heat generating portion) 105 disposed between the wiring electrodes 104 may be used, or the protection layer 103 for protecting electric resistance layer 105 may be added.

In the illustrated embodiment, while an example that the heat generating portion formed from the electric resistance layer 105 capable of generating heat in response to the electrical signal is used as the heat generating element 2 was explained, the heat generating element is not limited to such an example, but any element for generating the bubble sufficient to discharge the discharge liquid in the bubble liquid may be used. For example, a heat generating element having an optothermal converter capable of generating heat by receiving light such as laser light or a heat generating element having a heat generating body capable of generating heat by receiving a high frequency wave may be used as the heat generating portion.

Incidentally, in the element substrate 1, as well as the electrothermal converter constituted by the electric resistance layer 105 forming the heat generating portion and the wiring electrodes 104 for supplying the electrical signal to the electric resistance layer 105, function elements (for selectively driving the electrothermal converter) such as a transistor, diode, latch and shift-resistor are integrally incorporated by a semi-conductor manufacturing process.

Figure 32:
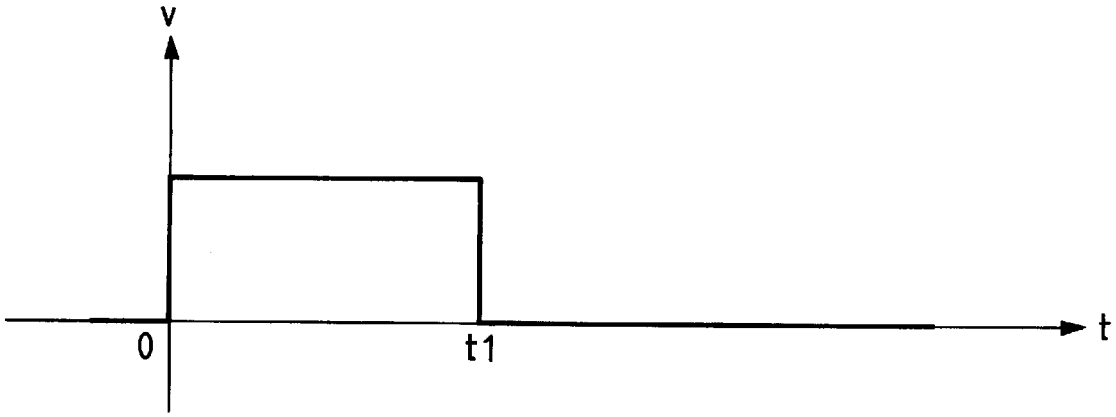
FIG. 32 is a schematic view showing a form of a drive pulse.

Further, in order to discharge the liquid by driving the heat generating portion of the electrothermal converter provided on the element substrate 1, a rectangular pulse shown in FIG. 32 is applied to the electric resistance layer 105 through the wiring electrodes 104, thereby heating the electric resistance layer 105 between the wiring electrodes 104 quickly. In the heads of the previous embodiments, the heat generating element 2 is driven by applying voltage of 24V, pulse width of 7 $\mu$sec, current of 150 mA and electrical signal of 6 kHz, thereby discharging the liquid from the discharge port 18 under the above-mentioned operation. However, the condition of the drive signal is not limited to the above, but any drive signal capable of generating the bubble in the bubble liquid properly may be used.

Head Structure of Two-liquid Passage Type

Now, a structure of a liquid discharging head in which two different liquids can be introduced into the first and second common liquid chambers, respectively, and in which the number of parts can be reduced and "cost-down" can be achieved will be explained.

Figure 33:
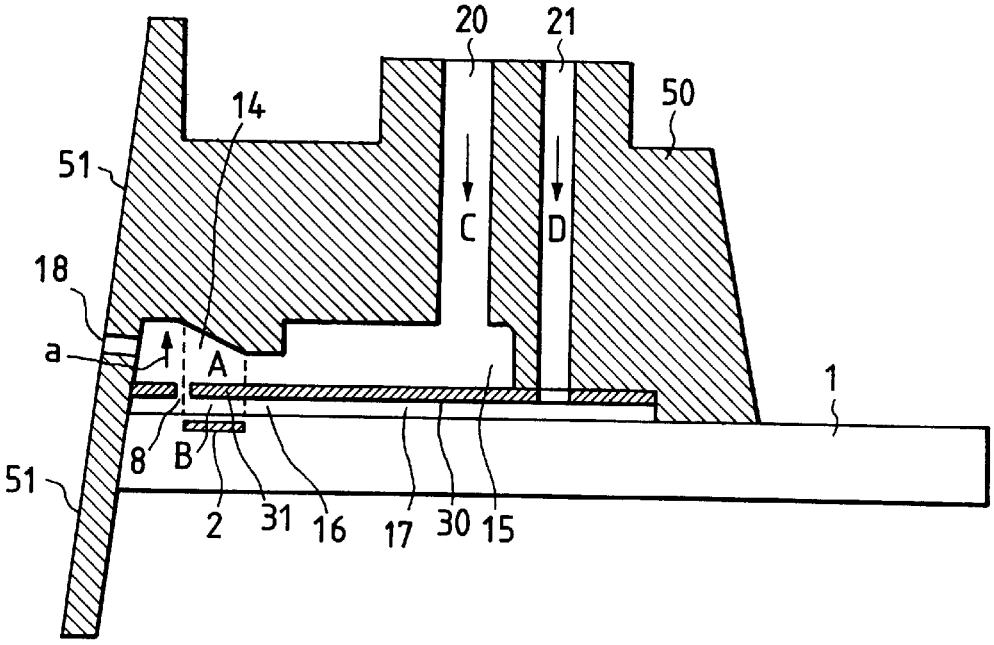
FIG. 33 is a sectional view for explaining a supply passage of the liquid discharging head according to the present invention.

FIG. 33 is a schematic sectional view showing a construction of such liquid discharging head. The same elements as those in the previous embodiments are designated by the same reference numerals and detailed explanation thereof will be omitted.

In the illustrated embodiment, the grooved member 50 includes an orifice plate 51 having the discharge ports 18, a plurality of grooves constituting a plurality of first liquid passages 14, and a recessed portion constituting the first common liquid chamber 15 communicated with the plurality of first liquid passages 14 and adapted to supply the liquid (discharge) liquid to the plurality of first liquid passage 14.

By joining the separation wall 30 to a lower portion of the grooved member 50, the plurality of first liquid passages 14 can be formed. The grooved member 50 has a first liquid supply passage 20 extending into the first common liquid chamber 15 from the above. Further, the grooved member 50 has a second liquid supply passage 21 extending into the second common liquid chamber 17 from the above through the separation wall 30.

As shown by the arrow C in FIG. 33, the first liquid (discharge liquid) is supplied to the first liquid passage 14 through the first liquid supply passage 20 and the first common liquid chamber 15, and, as shown by the arrow D in FIG. 33, the second liquid (bubble liquid) is supplied to the second liquid passage 16 through the second liquid supply passage 21 and the second liquid chamber 17.

In the illustrated embodiment, while an example that the second liquid supply passage 21 extends in parallel with the first liquid supply passage 20 was shown, the present invention is not limited to such an example, but, any arrangement of the second liquid supply passage 21 may be adopted so long as it extends into the second common liquid chamber 17 through the separation wall 30 disposed outside of the first common liquid chamber 15.

Further, a magnitude (diameter) of the second liquid supply passage 21 is determined in consideration of the supply amount of the second liquid. The cross-sectional shape of the second liquid supply passage 21 is not limited to a circular shape, but may be rectangular.

Figure 34:
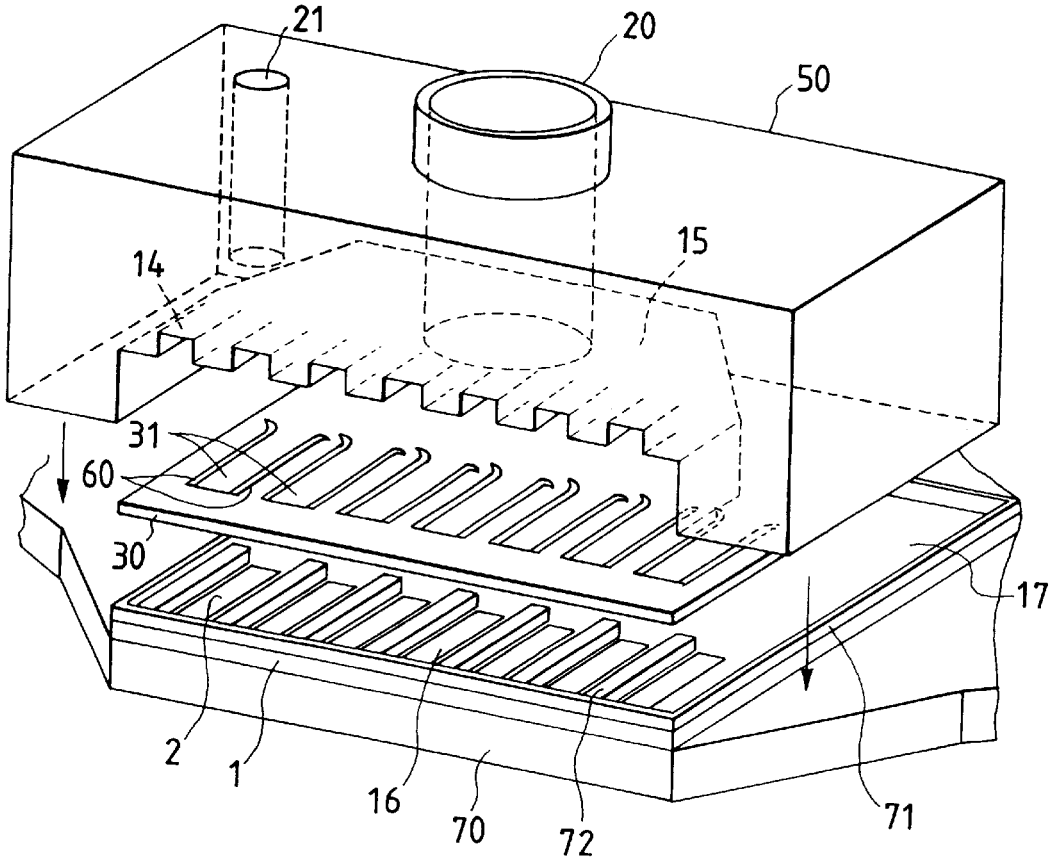
FIG. 34 is an exploded perspective view of the head according to the present invention.

The second common liquid chamber 17 can be formed by partitioning the grooved member 50 by the separation wall 30. As an example, as shown in FIG. 34 (exploded perspective view), the second common liquid chamber 17 and the second liquid passage 16 can be formed by forming a common liquid chamber frame 71 and a second liquid passage wall 72 on the element substrate 1 and then by joining an assembly of the separation wall 30 and the grooved member 50 to the element substrate 1.

In the illustrated embodiment, the element substrate 1 on which the plurality of electrothermal converters (heat generating elements 2) for generating the heat for forming the bubble in the bubble liquid by the film-boiling are arranged is disposed on a support 70 made of metal such as aluminium.

On the element substrate 1, there are provided a plurality of grooves for constituting the second liquid passages 16 defined by the second liquid passage walls 72, a recessed portion constituting the second common liquid chamber (common bubble liquid chamber) 17 communicated with the plurality of discharge liquid passages and adapted to supply the bubble liquid to the discharge liquid passages, and the separation wall 30 including the movable members 31.

The grooved member 50 includes the grooves for constituting the discharge liquid passages (first liquid passages) 14 by combining with the separation wall 30, the recessed portion for constituting the first common liquid chamber (common discharge liquid chamber) 15 communicated with the discharge liquid passages and adapted to supply the discharge liquid to the discharge liquid passages, the first liquid supply passage (discharge liquid supply passage) 20 for supplying the discharge liquid to the first common liquid chamber 15, and the second liquid supply passage (bubble liquid supply passage) 21 for supplying the bubble liquid to the second common liquid chamber 17. The second liquid supply passage 21 is connected to a communication passage extending into the second common liquid chamber 17 through the separation wall 30 disposed outside of the first common liquid chamber 15, and, by this communication passage, the bubble liquid can be supplied to the second common liquid chamber 17 without mixing with the discharge liquid.

Regarding the positional relation between the element substrate, the separation wall 30 and the grooved member 50, the movable members 31 are disposed in correspondence to the heat generating elements 2 of the element substrate 1, and the discharge liquid passages 14 are arranged in correspondence to the movable members 31. Further, in the illustrated embodiment, while an example that the single second liquid supply passage 21 is formed in the grooved member 50 was explained, a plurality of second liquid supply passages may be provided in accordance with the liquid supply amount. In addition, flow areas of the first and second liquid supply passages 20, 21 may be determined in proportion to the liquid supply amount. Further, when the movable member 31 has the side walls 66 as shown in FIGS. 16, 17A, 17B, 18A and 18B, the grooves constituting the first liquid passages are not necessarily provided in the grooved member 50. By optimizing the flow areas in this way, the parts constituting the grooved member 50 and the like can be made compact.

As mentioned above, according to the present invention, since the second liquid supply passage 21 for supplying the second liquid to the second liquid passages 16 and the first liquid supply passage 20 for supplying the first liquid to the first liquid passages 14 are formed in the same grooved member 50, the number of parts can be reduced, the number of manufacturing steps can be reduced and the "cost-down" can be achieved.

Further, since the supply of the second liquid to the second common liquid chamber 17 communicated with the second liquid passages 16 is effected by the second liquid supply passage 21 extending through the separation wall 30, the assembling between the separation wall 30, grooved member 50 and element substrate 1 can be performed by a single step, thereby facilitating the manufacture, improving the assembling accuracy and achieving the good liquid discharging.

Further, since the second liquid is supplied to the second common liquid chamber 17 through the separation wall 30, the supply of the second liquid to the second liquid passages 16 is effected positively, and, thus, since the adequate liquid supply amount is ensured, the stable liquid discharging can be achieved.

Discharge Liquid and Bubble Liquid

As mentioned above, in the present invention, since the head has the above-mentioned movable members, the liquid can be discharged at high speed with higher discharging force and higher discharging efficiency than those in the conventional heads. When the same liquid is used as both bubble liquid and discharge liquid, various kinds of liquids can be used so long as the liquid is not deteriorated by the heat from the heat generating element, deposit from the liquid due to the heat is hard to be accumulated on the heat generating element, the reversible state change between evaporation and condensation can be permitted and the deterioration of liquid passage walls, movable members and separation wall can be prevented.

Among such liquids, as the recording liquid, ink having conventional composition utilized in the conventional bubble jet apparatuses can be used.

On the other hand, when the head of two-passage type is used and the discharge liquid is different from the bubble liquid, as the bubble liquid, the liquids having the above-mentioned features may be used. More specifically, the following liquids may be used: methanol, ethanol, n-propanol, isopropanol, n-hexane, n-heptane, n-octane, toluene, xylene, methylene dichloride, trichlene, fleon TF, fleon BF, ethylether, dioxane, cyclohexane, methyl acetate, ethyl acetate, acetone, methylethylketone, water and their compounds.

Regarding the discharge liquid, various kinds of liquids can be used without bubbling ability and thermal features. Even liquid having low bubbling ability and liquid easy to be deteriorated by heat can be used.

However, if the liquid discharging, formation of the bubble and/or operation of the movable member are prevented by the feature of the discharge liquid and the reaction between the discharge liquid and the bubble liquid, such discharge liquid should not be used.

Regarding the recording discharge liquid, high viscous ink can be used. Further, medical liquids and scented water having poor resistance to heat can also be used as the discharge liquid.

In the present invention, as the recording liquid used as both the discharge liquid and the bubble liquid, ink having the following composition was used. As a result, since the discharging speed of ink was increased by enhancement of the discharging force, target accuracy of ink droplet was improved and a high quality image could be obtained.

| | | |
|---|---|---|
| dye ink (viscosity 2 cp) | (C.I. food black 2) dye | 3 wt % |
| | diethylene glycol | 10 wt % |
| | thiodiglycol | 5 wt % |
| | ethanol | 3 wt % |
| | water | 77 wt % |

Further, liquid having the following composition was combined with the bubble liquid and the discharge liquid and the recording was performed. As a result, not only liquid having viscosity of ten-odd cps (which was hard to be discharged in the conventional techniques) but also high viscous liquid having viscosity of 150 cps could be discharged effectively and high quality image could be obtained.

| | | |
|---|---|---|
| bubble liquid 1 | ethanol | 40 wt % |
| | water | 60 wt % |
| bubble liquid 2 | water | 100 wt % |
| bubble liquid 3 | isopropyl alcohol | 10 wt % |
| | water | 90 wt % |
| discharge liquid 1 dye ink (viscosity about 15 cp) | carbon black | 5 wt % |
| | stylene-acrylic acid-acrylic acid ester copolymer (oxidation 140 weight average molecular weight 8000) | 1 wt % |
| | monoethanol amine | 0.25 wt % |
| | glycerol | 69 wt % |
| | thiodiglycol | 5 wt % |
| | ethanol | 3 wt % |
| | water | 16.75 wt % |
| discharge liquid 2 (viscosity 55 cp) | polyethylene glycol | 100 wt % |
| discharge liquid 3 (viscosity 150 cp) | polyethylene glycol | 100 wt % |

By the way, in case of the above-mentioned liquid which has conventionally been considered to be hard to discharge, since the discharging speed is small, unevenness in discharging direction was worsened and the target accuracy of ink dot was also worsened and there arose unevenness in discharge amount due to unstable discharging, which resulted in poor image. However, in the illustrated embodiment, by using the bubble liquid, the bubble can be generated stably and adequately. Thus, the target accuracy of the liquid droplet can be improved and the ink discharge amount can be stabilized, thereby improving the image quality greatly.

Structure of Movable Member

Next, some examples of a method for manufacturing the movable member which is most important characteristic of the present invention will be explained, among the above-mentioned embodiments.

Figure 75A:
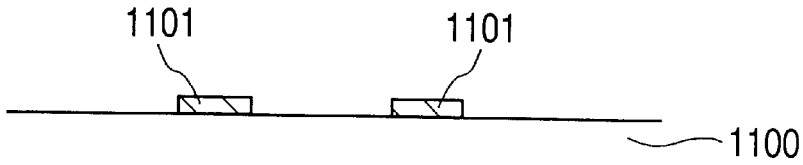
FIGS. 75A, 75B and 75C are explanatory views showing a method for manufacturing the movable member of FIG. 67.
Figure 75B:
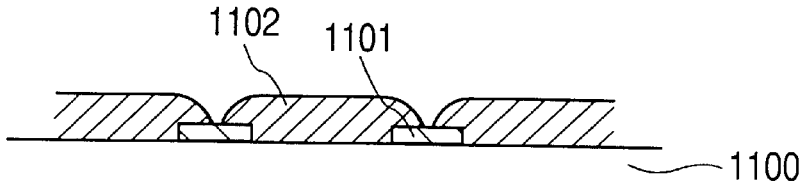
Figure 75C:
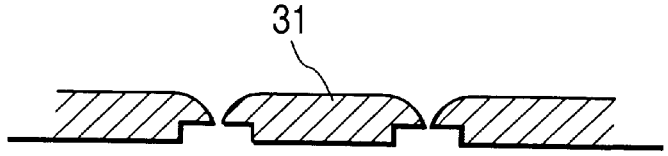
Figure 76A:
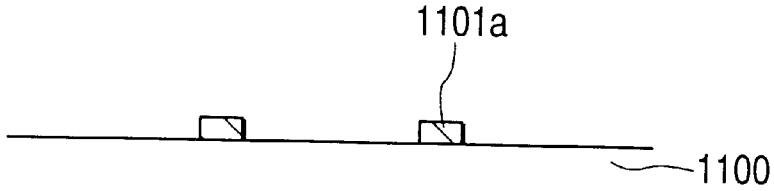
FIGS. 76A, 76B, 76C, 76D and 76E are explanatory views showing a method for manufacturing the movable member of FIG. 74C.
Figure 76B:
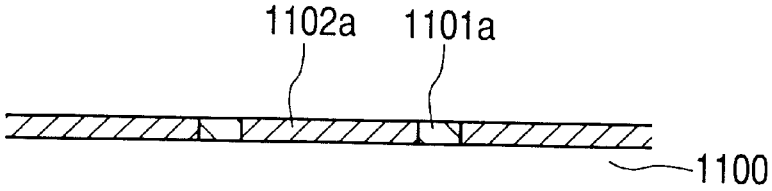
Figure 76C:
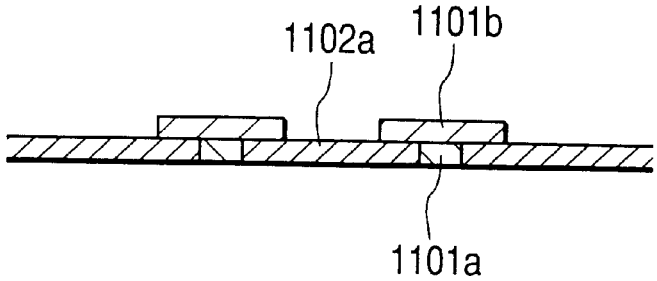
Figure 76D:
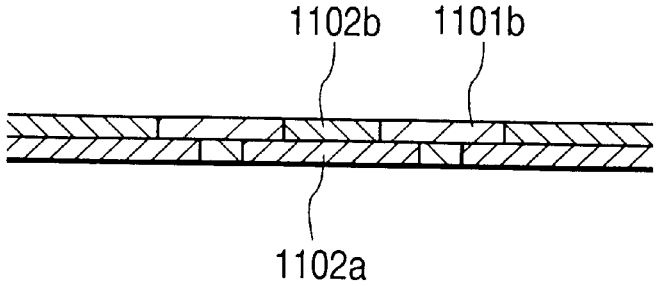
Figure 76E:
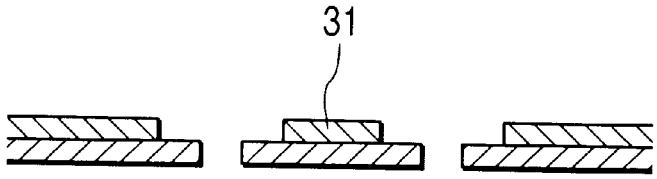

First of all, an example of a method for manufacturing the movable member 31 shown in FIG. 67 will be described with reference to FIGS. 75A to 75C.

(a) Regist 1101 having a thickness of 0.5 μm is patterned on a SUS substrate plate 1100. In case of regist having the thickness of 0.5 μm, when a width to be remained as the slit is 3 μm, a width of the regist 1101 to be patterned is 12 μm.

(b) The SUS substrate plate 1100 is electro-plated to form a nickel layer 1102 having a thickness of 5 μm on the SUS substrate plate 1100. Regarding electro-plating liquid, sulfonic acid nickel, stress reduction agent ("Zeorol": trade mark; available from World Metal Inc.), boric acid, pit prevention agent (NP-APS available from World Metal Inc.) and nickel chloride are used. Regarding application of electric field upon electrodeposition, an electrode is attached to an anode and the SUS substrate plate 1100 on which the regist 1101 was patterned is attached to a cathode, and a temperature of the plating liquid is selected to 50° C. and current density is selected to 5 A/cm$^2$.

Under this condition, when the nickel layer 1102 is grown, the nickel layer 1102 is growing (from the thickness of 5 μm) not only in a thickness direction but also in directions for covering the regist 1101. And, when the total thickness becomes 5 μm, the nickel layer 1102 covers both side portions of the regist 1101 by a thickness of about 4.5 μm. As a result, on the regist 1101, a gap having a width of 3 μm is formed along the pattern of the regist 1101, and, a radius of curvature nickel layer at the gap in the thickness direction becomes 4.5 μm.

(c) After the electro-plating is finished, the SUS substrate plate 1100 is subjected to ultrasonic vibration, so that the nickel layer 1102 is peeled from the SUS substrate plate 1100, thereby obtaining the movable member 31 having a width gradually decreased from the bottom to the top.

In this case, although steps corresponding the removed regist 1101 are formed in a lower surface of the movable member 31, since the heights of the steps are 0.5 μm, the lower surface of the movable member can be regarded as flatness.

Figure 74A:
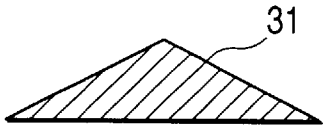
FIGS. 74A, 74B, 74C, 74D, 74E, 74F, 74G, 74H and 74I are sectional views showing various alterations of the movable member.
Figure 74B:
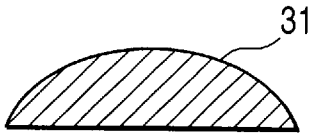
Figure 74C:
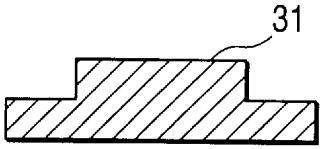

Next, an example of a method for manufacturing the movable member 31 shown in FIG. 74C will be described with reference to FIGS. 76A, 76B, 76C, 76D and 76E.

(a) Regist 1101*a* having a thickness of 2.5 μm is patterned on a SUS substrate plate 1100. A width of the regist 1101 to be patterned is selected to be equal to a width to be remained as the slit.

(b) The SUS substrate plate 1100 is electroplated to form a nickel layer 1102*a* having a thickness of 2.5 μm on the SUS substrate plate 1100. Regarding electro-plating liquid, sulfonic acid nickel, stress reduction agent ("Zeorol": trade mark; available from World Metal Inc.), boric acid, pit prevention agent (NP-APS available from World Metal Inc.) and nickel chloride are used. Regarding application of electric field upon electrodeposition, an electrode is attached to an anode and the SUS substrate plate 1100 on which the regist 1101*a*, 1101*b* were patterned is attached to a cathode, and a temperature of the plating liquid is selected to 50° C. and current density is selected to 5 A/cm$^2$.

(c) Regist 1101*b* having a thickness of 2.5 μm is patterned on the regist 1101*a*. A width of the regist 1101*b* is greater than the width of the regist 1101*a*.

(d) The nickel layer 1102*a* is subjected to the electroplating again to form a second nickel layer having a thickness of 2.5 μm on the first nickel layer. The plating condition is the same as that of the first nickel layer 1102*a*.

(e) After the regists 1101*a*, 1101*b* are removed, the SUS substrate plate 1100 is subjected to ultrasonic vibration, so that the first nickel layer 1102*a* is peeled from the SUS substrate plate 1100, thereby obtaining the movable member 31 of two-layer type.

Figure 74D:
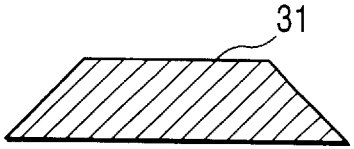
Figure 74E:
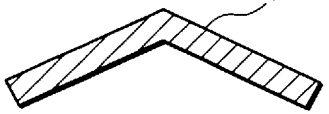
Figure 74F:
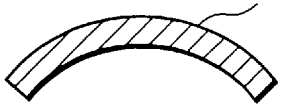
Figure 74G:
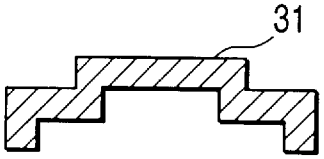
Figure 77A:
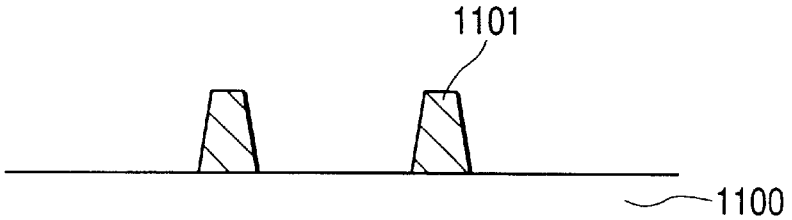
FIGS. 77A, 77B, and 77C are explanatory views showing a method for manufacturing the movable member of FIG. 74D.
Figure 77B:
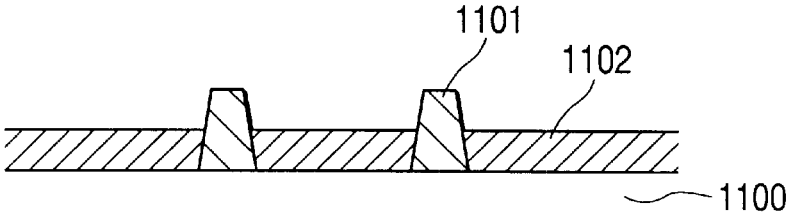
Figure 77C:
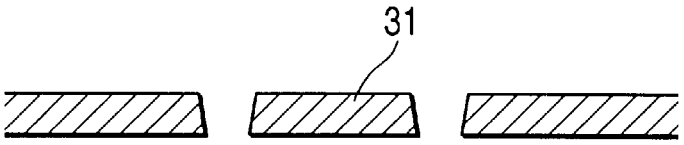
Figure 78A:
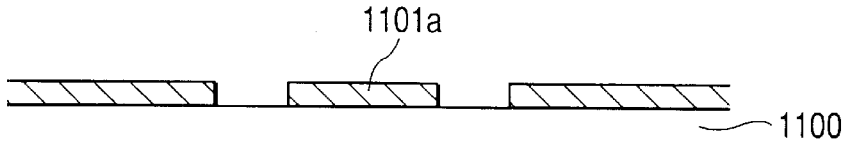
FIGS. 78A, 78B, 78C, 78D, 78E and 78F are explanatory views showing a method for manufacturing the movable member of FIG. 74H.
Figure 78B:
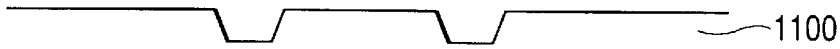
Figure 78C:
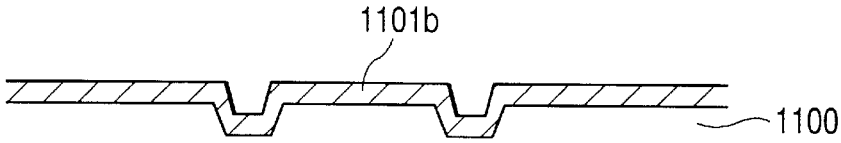
Figure 78D:
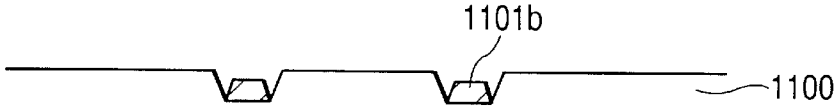
Figure 78E:
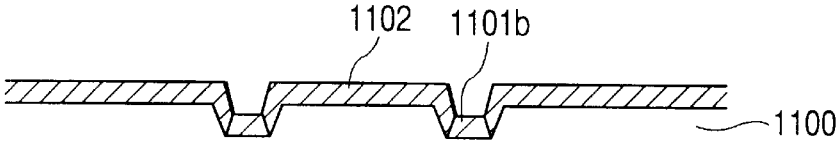
Figure 78F:
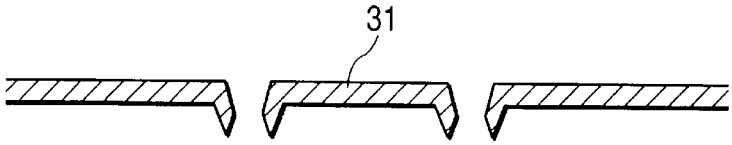

Next, an example of a method for manufacturing the movable member 31 shown in FIG. 74D will be described with reference to FIGS. 77A, 77B and 77C.

(a) Regist 1101 having a thickness of 15 μm is patterned on a SUS substrate plate 1100. In this case, the focus of exposure is deviated so that the regist 1101 has inclined side surfaces.

(b) The SUS substrate plate 1100 is electro-plated to form a nickel layer 1102 having a thickness of 5 μm on the SUS substrate plate 1100. Regarding electro-plating liquid, sulfonic acid nickel, stress reduction agent ("Zeorol": trade mark; available from World Metal Inc.), boric acid, pit prevention agent (NP-APS available from World Metal Inc.) and nickel chloride are used. Regarding application of electric field upon electrodeposition, an electrode is attached to an anode and the SUS substrate plate 1100 on which the regist 1101 was patterned is attached to a cathode, and a temperature of the plating liquid is selected to 50° C. and current density is selected to 5 A/cm$^2$.

(c) After the electroplating is finished, the SUS substrate plate 1100 is subjected to ultrasonic vibration, so that the nickel layer 1102 is peeled from the SUS substrate plate 1100. When the peeled nickel layer is inverted, a trapezoidal movable member 31 is obtained.

Figure 74H:
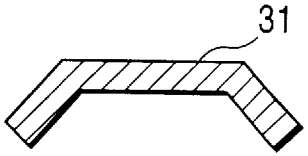
Figure 74I:
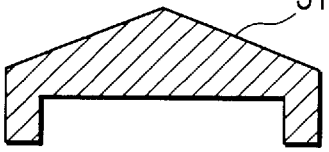

Next, an example of a method for manufacturing the movable member 31 shown in FIG. 74H will be described with reference to FIGS. 78A, 78B, 78C, 78D, 78E and 78F.

(a) Regist 1101*a* is patterned on a SUS substrate plate 1100.

(b) The SUS substrate plate 1100 on which the regist 1101*a* was patterned is dipped into etching liquid (solution of iron (III) chloride or copper (II) chloride), thereby etching portions exposed from the regist 1101*a*. Thereafter, the regist 1101*a* is peeled.

(c) The etched entire surface of the SUS substrate plate 1100 is coated again by regist 1101*b*.

(d) The regist 1101*b* coated on the SUS substrate plate is patterned by exposure so that the regist 1101*b* remains only on the etched portion of the bottom of the SUS substrate plate 1100.

(e) The SUS substrate plate 1100 is electro-plated to form a nickel layer 1102 having a thickness of 5 μm on the SUS substrate plate 1100. Regarding electro-plating liquid, sulfonic acid nickel, stress reduction agent ("Zeorol": trade mark; available from World Metal Inc.), boric acid, pit prevention agent (NP-APS available from World Metal Inc.) and nickel chloride are used. Regarding application of electric field upon electrodeposition, an electrode is attached to an anode and the SUS substrate plate 1100 on which the regist 1101*b* was patterned is attached to a cathode, and a temperature of the plating liquid is selected to 50° C. and current density is selected to 5 A/cm$^2$.

(f) After the electro-plating is finished, the SUS substrate plate 1100 is subjected to ultrasonic vibration, so that the nickel layer 1102 is peeled from the SUS substrate plate 1100, thereby obtaining having integral upright walls at its both lateral ends.

Manufacture of Liquid Discharging Head

Next, a method for manufacturing the liquid discharging head according to the present invention will be explained.

In case of the liquid discharging head as shown in FIG. 2, the bases 34 for attaching the movable member 31 to the element substrate 1 are formed by patterning dry film and the like, and the movable member 31 is bonded or welded to the bases 34. Incidentally, although the movable member 31 is formed from the thin diaphragm, the method for manufacturing the thin diaphragm was already explained in connection with FIGS. 4A, 4B and 4C. Thereafter, the grooved member having the plurality of grooves constituting the liquid passages 10, and the recessed portion constituting the discharge ports 18 and the common liquid chamber 13 is joined to the element substrate 1 in such a manner that the grooves are opposed to the movable members 31.

Next, a method for manufacturing the liquid discharging head of two-passage type as shown in FIGS. 14 and 34 will be explained.

Briefly explaining, the walls for the second liquid passages 16 are formed on the element substrate 1, and the separation wall 30 is attached onto the element substrate, and then, the grooved member 50 having the grooves constituting the first liquid passages 14 and the like is attached thereto. Alternatively, after the walls for the second liquid passages 16 were formed, the grooved member 50 to which the separation wall 30 was attached is joined to the walls.

Now, a method for manufacturing the second liquid passages 16 will be fully explained.

FIGS. 35A, 35B, 35C, 35D and 35E are schematic sectional views for explaining a first embodiment of a method for manufacturing the liquid discharging head of the present invention.

Figure 35A:
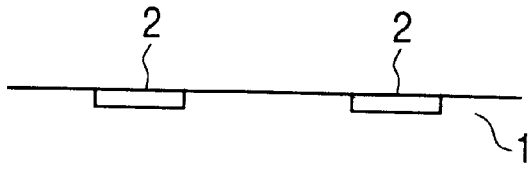
FIGS. 35A, 35B, 35C, 35D and 35E are views for explaining a method for manufacturing the liquid discharging head according to the present invention.

In this embodiment, as shown in FIG. 35A, after the electrothermal converters having the heat generating elements 2 made of hafnium boride or tantalum nitride are formed on the element substrate (silicon wafer) 1 by using the same manufacturing apparatus as that used in the semiconductor manufacturing process, the surface of the element substrate 1 is cleaned in order to improve close contact ability between the substrate and photosensitive resin in a next process or step. Further, in order to improve the close contact ability, it is desirable that, after the surface of the element substrate 1 is illuminated by ultraviolet ray/ozone, for example, liquid obtained by diluting silane coupling agent (A189 available from Nippon Unika Co., Ltd.) with ethylalcohol up to 2 wt % is spin-coated on the treated surface.

Figure 35B:
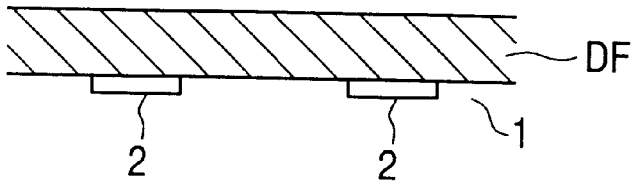

Then, after the surface cleaning is effected, as shown in FIG. 35B, ultraviolet-sensitive resin film DF ("Dry Film Odel SY-318" (trade mark); available from Tokyo Ohka Co., Ltd.) is laminated on the element substrate 1 (close contact ability of the surface was improved).

Figure 35C:
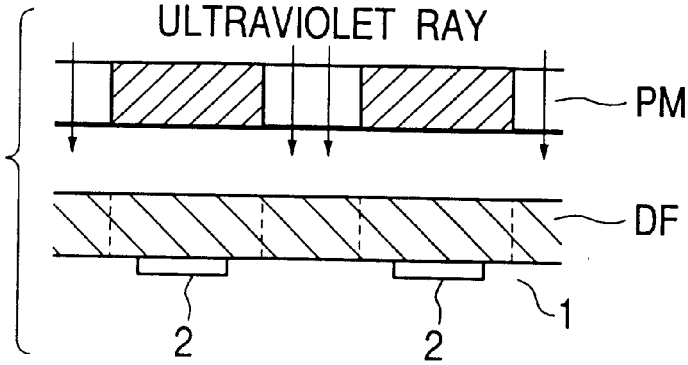

Then, as shown in FIG. 35C, a photo-mask PM is disposed on the dry film DF, and, ultraviolet ray is illuminated onto a portion of the dry film DF which is to be remained as the second liquid passage walls through the photo-mask PM. This exposure process is effected by using the apparatus (MPA-600 available from Canon, in Japan) with an exposure amount of about 600 mJ/cm$^2$.

Figure 35D:
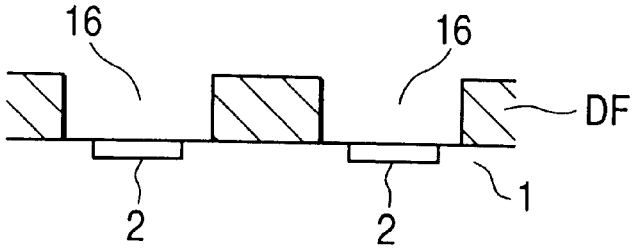

Then, as shown in FIG. 35D, the dry film DF is developed by a developing liquid (BMRC-3 available from Tokyo Ohka Co., Ltd.) comprised of mixture liquid of xylene and butyl selsolve acetate to dissolve the non-exposed portion, thereby forming the hardened portions as the wall portions of the second liquid passages 16. Further, the residual matters remaining on the surface of the element substrate 1 are removed by driving an oxide plasma ashing apparatus (MAS-800 available from Alcantec Inc.) for about 90 seconds. Then, the ultraviolet ray is further illuminated with the exposure amount of 100 mJ/cm$^2$ at a temperature of 50° C. for two hours, thereby completely hardening the exposed portions.

A plurality of heater boards (element substrates) obtained by dividing so treated silicon wafer have high accurate second liquid passages 16. The silicon wafer were divided into the heater boards by a dicing machine (AWD-4000 available from Tokyo Seimitsu Co., Ltd.) including a diamond blade having a thickness of 0.05 mm. The divided or separated heater board 1 is secured to an aluminium base plate (support) 70 (FIG. 38) by an adhesive (SE4400 available from Toray Co., Ltd.). Then, a printed wiring board 73 (FIG. 39) previously connected to the aluminium base plate 70 is connected to the heater board 1 via aluminium wires (not shown) having a diameter of 0.005 mm.

Figure 35E:
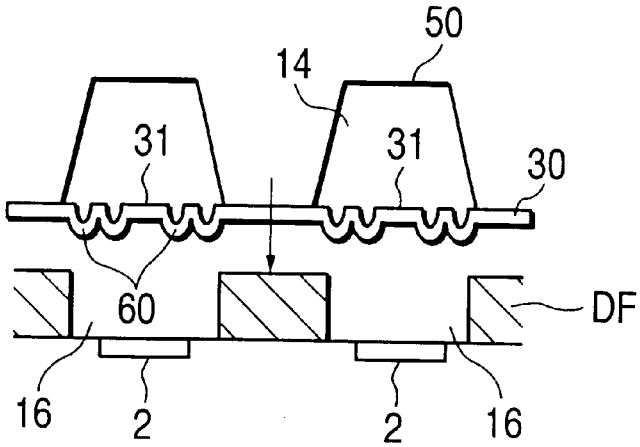

Then, as shown in FIG. 35E, the assembly of the grooved member 50 and the separation wall 30 is positioned and joined. That is to say, the grooved member 50 including the separation wall 50 and the heater board 1 are positioned and secured to each other by a cap spring 78 (FIG. 38), and, then, an ink/bubble liquid supplying member 80 (FIG. 38) is securely joined to the aluminium base plate 70 with the interposition of the assembly 200 of the grooved member 50 and the separation wall 30. Then, gaps between the aluminium wires and between the grooved member 50, the heater board 1 and the ink/bubble liquid supplying member 80 are filled with and sealed by silicone sealant (TSE399 available from Toshiba Silicone Co., Ltd.), thereby completing the head.

By forming the second liquid passages 16 in this way, high accurate liquid passages having no positional deviation with respect to the heat generating elements 2 of the heater board 1 can be obtained. Particularly, by previously assembling the grooved member 50 and the separation wall 30 together in the previous step, the positional accuracy of the first liquid passages 14 and the movable members 31 can be enhanced.

By using such high accurate manufacturing methods, the discharging feature can be stabilized and the image quality can be improved. Further, since the element substrates can be formed on the wafer collectively, mass-production can be permitted, thereby achieving the "cost-down".

Incidentally, in the illustrated embodiment, while an example that the dry film of type which can be cured by the ultraviolet ray is used to form the second liquid passages 16 was explained, resin having ultraviolet band (particularly, absorption band near 248 nm) may be used, and, after lamination, resin may be cured and then portions corresponding to the second liquid passages 16 may be directly removed by excimer laser.

FIGS. 36A, 36B, 36C and 36D are schematic sectional views showing a second embodiment of a method for manufacturing the liquid discharging head of the present invention.

Figure 36A:
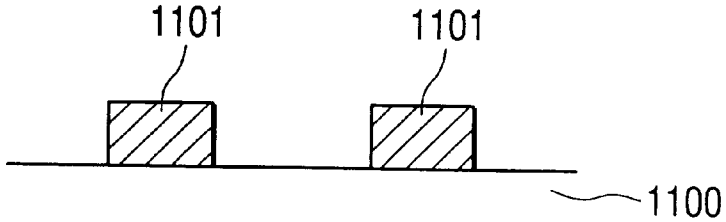
FIGS. 36A, 36B, 36C and 36D are views for explaining a method for manufacturing a liquid discharging head according to the present invention.

In this embodiment, as shown in FIG. 36A, regist 1101 having a thickness of 15 $\mu$m is patterned on a SUS substrate plate 1100 in correspondence to the shape of the second liquid passages 16.

Figure 36B:
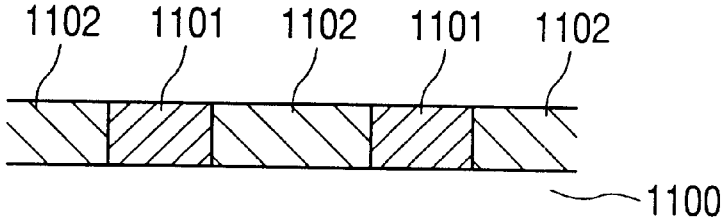

Then, as shown in FIG. 36B, the SUS substrate plate 1100 is electro-plated to form a nickel layer 1102 having a thickness of 15 $\mu$m on the SUS substrate plate 1100. Regarding electroplating liquid, sulfonic acid nickel, stress reduction agent ("Zeorol": trade mark; available from World Metal Inc.), boric acid, pit prevention agent (NP-APS available from World Metal Inc.) and nickel chloride are used. Regarding application of electric field upon electrodeposition, an electrode is attached to an anode and the patterned SUS substrate plate 1100 is attached to a cathode, and a temperature of the plating liquid is selected to 50° C. and current density is selected to 5 A/cm$^2$.

Figure 36C:
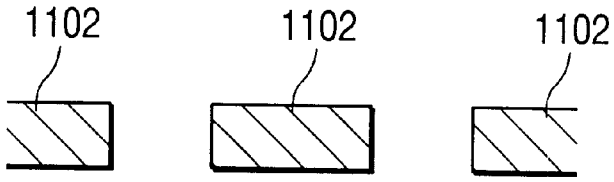

Then, as shown in FIG. 36C, after the electro-plating is finished, the SUS substrate plate 1100 is subjected to ultrasonic vibration, so that the nickel layer 1102 is peeled from the SUS substrate plate 1100, thereby obtaining desired second liquid passages.

Figure 36D:
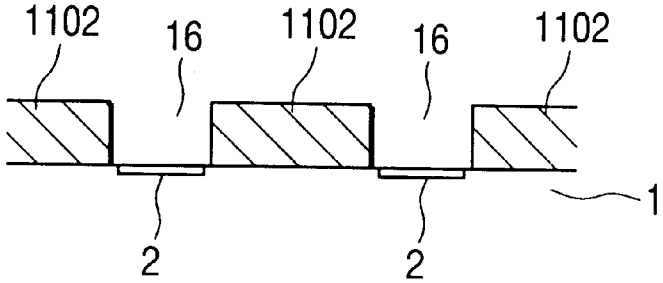

On the other hand, a plurality of heater boards having the electrothermal converters are formed on a silicon wafer by the same apparatus used in the semi-conductor process. Then, as is in the first embodiment, the silicon wafer is divided into the heater boards by the dicing machine. The divided or separated heater board 1 is secured to an aluminium base plate 70 to which a printed wiring board 73 was previously connected, and the printed wiring board 73 is connected to aluminium wires (not shown), thereby completing electrical connection. As shown in FIG. 36D, the second liquid passages 16 obtained by the previous step are positioned on and secured to the heater board 1. Regarding such securing, as is in the first embodiment, since the second liquid passages 16 are securely joined by the top plate having the separation wall and the cap spring, the securing may be effected to the extent that positional deviation does not occur during the joining of the top plate.

In this embodiment, the securing is effected by using adhesive (Amicon UV-300 available from Glace Japan Co., Ltd.) of type which can be cured by the ultraviolet ray and an ultraviolet ray illuminating apparatus and by illuminating with the exposure amount of 100 mJ/cm$^2$ for about 3 seconds.

According to the illustrated method, the high accurate second liquid passages 16 having no positional deviation with respect to the heat generating elements 2 can be obtained, and, since the liquid passage walls are formed from nickel, a high reliable head having good resistance to alkaline liquid can be obtained.

FIGS. 37A, 37B, 37C and 37D are schematic sectional views showing a third embodiment of a method for manufacturing the liquid discharging head of the present invention.

Figure 37A:
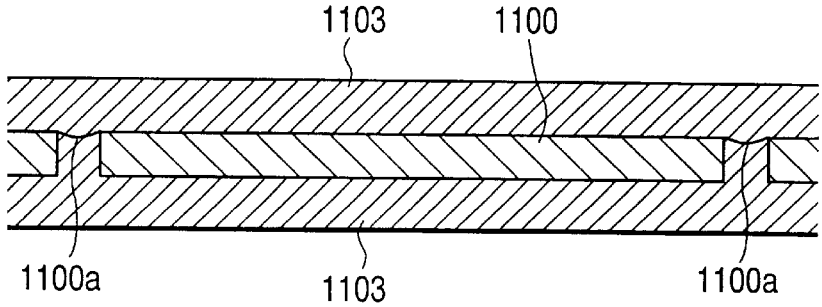
FIGS. 37A, 37B, 37C and 37D are views for explaining a method for manufacturing a liquid discharging head according to the present invention.

In this embodiment, as shown in FIG. 37A, registers 1103 are coated on both surfaces of a SUS substrate plate 1100 having a thickness of 15 $\mu$m and having alignment holes 1100*a* or marks. As the regist 1103, PMERP-AR900 available from Tokyo Oyo Kagaku Co., Ltd. is used.

Figure 37B:
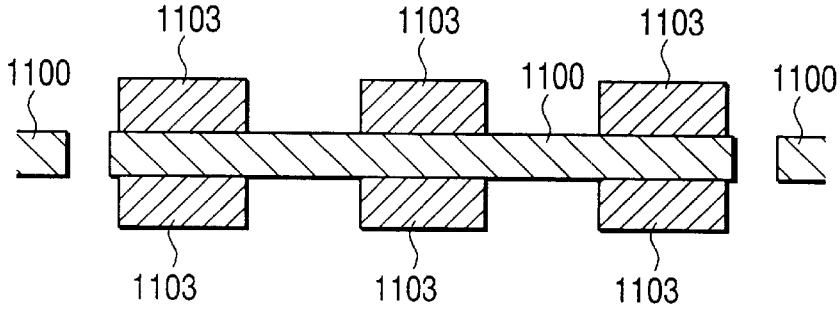

Thereafter, as shown in FIG. 37B, the exposure is effected in coincidence with the alignment holes llOOa of the SUS substrate plate 1100 by using an exposure apparatus (MPA-600 available from Canon CO., Ltd. in Japan) to remove the regist 1103 from portions where the second liquid passages 16 are to be formed. The exposure is effected with the exposure amount of 800 mJ/cm$^2$.

Figure 37C:
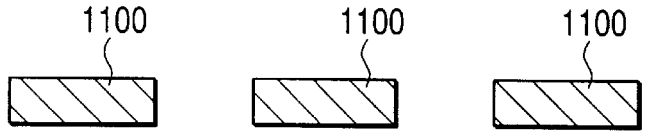

Then, as shown in FIG. 37C, the SUS substrate plate 1100 having the patterned 1103 at on both surfaces is dipped into etching liquid (solution of iron (III) chloride or copper (II) chloride), thereby etching portions exposed from the regist 1103. Thereafter, the regist 1103 is peeled.

Figure 37D:
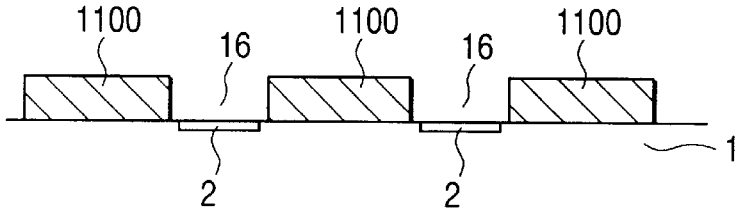

Then, as shown in FIG. 37D, as is in the former embodiment of the method, the etched SUS substrate plate 1101 is positioned on and secured to the heater board 1, thereby assembling the liquid discharging head having the second liquid passages 16.

According to the illustrated method, the high accurate second liquid passages 16 having no positional deviation with respect to the heat generating elements 2 can be obtained, and, since the liquid passage walls are formed from SUS, a high reliable head having good resistance to alkaline liquid can be obtained.

As mentioned above, according to the illustrated method, by previously arranging the walls for the second liquid passages 16 on the element substrate, the heat generating elements and the second liquid passages 16 can be positioned relative to each other with high accuracy. Further, since the second liquid passages can be simultaneously formed on a plurality of element substrates before division, a number of liquid discharging heads can be obtained with low cost.

Further, in the liquid discharging head obtained by the illustrated method, since the heat generating elements and the second liquid passages 16 can be positioned relative to each other with high accuracy, the pressure of the bubble generated by the heat from the heat generating element can receive efficiently, thereby improving the discharging efficiency.

Liquid Discharging Head Cartridge

Next, a liquid discharging head cartridge including the above-mentioned liquid discharging head will be briefly explained.

Figure 38:
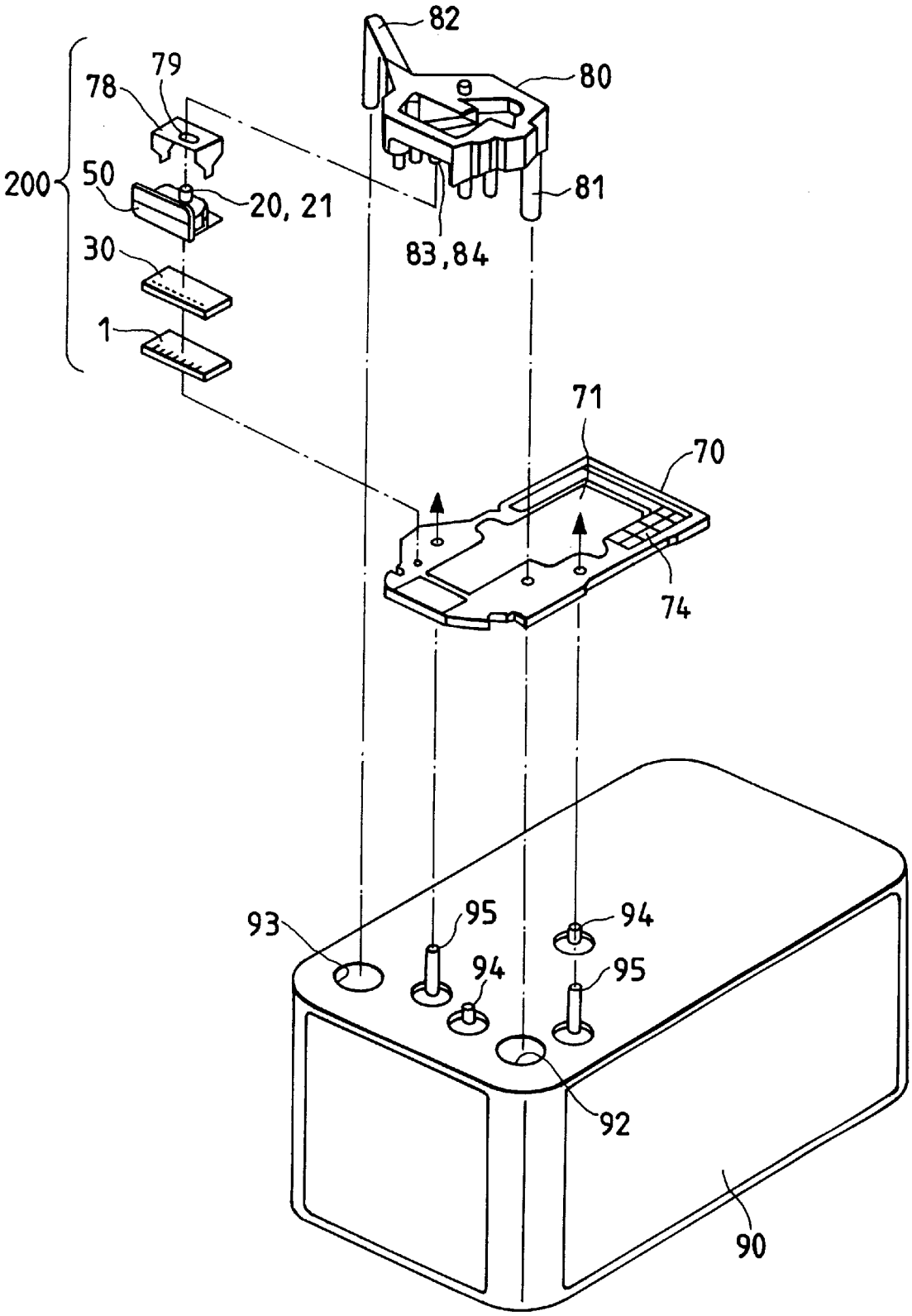
FIG. 38 is an exploded perspective view of a liquid discharging head cartridge.

FIG. 38 is a schematic exploded perspective view of a liquid discharging head cartridge including the above-mentioned liquid discharging head. The liquid discharging head cartridge mainly comprises a liquid discharging head portion 200 and a liquid container 90.

The liquid discharging head portion 200 includes the element substrate 1, separation wall 30, grooved member 50, cap spring 78, liquid supplying member 80 and aluminum base plate (support) 70. The element substrate 1 includes a plurality of side-by-side arranged heat generating resistance bodies for applying the heat to the bubble liquid, and a plurality of function elements for selectively driving the heat generating resistance bodies. The bubble liquid passages are formed between the element substrate 1 and the separation wall 30 having the movable walls, and the bubble liquid flow through these liquid passages. By joining the grooved top plate 50 to the separation wall 30, the discharge liquid passages (not shown) are formed, and the discharge liquid flows these liquid passages.

The cap spring 78 serves to apply a biasing force directing toward the element substrate 1 to the grooved member 50. By such biasing force, the element substrate 1, separation wall 30 and grooved member 50 are effectively integrated with the support 70 which will be described later.

The support 70 serves to support the element substrate 1, and, on the support 70, there are disposed a printed wiring board 73 connected to the element substrate 1 and adapted to supply an electrical signal, and contact pads 74 for connection to the liquid discharging apparatus to perform communication between the cartridge and the apparatus.

The liquid container 90 serve to independently contain the discharge liquid such as ink and the bubble liquid for generating the bubble. Positioning portions 94 for attaching a connection member for connecting the liquid container 90 to the liquid discharging head portion 200, and securing shafts 95 for securing the connection member are disposed on an outer surface of the liquid container 90. The discharge liquid is supplied from a discharge liquid supply passage 92 of the liquid container 90 to a discharge liquid supply passage 81 of the supplying member 80 through a supply passage 84 of the connection member and then is supplied to the first common liquid chamber through liquid supply passages 83, 79, 20 of the members. Similarly, the bubble liquid is supplied from a bubble liquid supply passage 93 of the liquid container 90 to a bubble liquid supply passage 82 of the supplying member 80 through a supply passage of the connection member and then is supplied to the second liquid chamber through liquid supply passages 84, 79, 21 of the members.

In the above-mentioned liquid discharging head cartridge, while the supply system and the liquid container 90 which can perform the liquid supply even when the bubble liquid is different from the discharge liquid were explained, when the discharge liquid and the bubble liquid are the same, the supply path for the bubble liquid may not be separated from the supply path for the discharge liquid, and the liquid container may contain the single liquid.

Incidentally, after the liquid(s) from the liquid container 90 is used up or consumed, new liquid may be replenished. To this end, liquid pouring port(s) may be provided in the liquid container 90. Further, the liquid container 90 may be integrally formed with the liquid discharging head portion 200 or may removably be mounted on the liquid discharging head portion 200.

Liquid Discharging Apparatus

Figure 39:
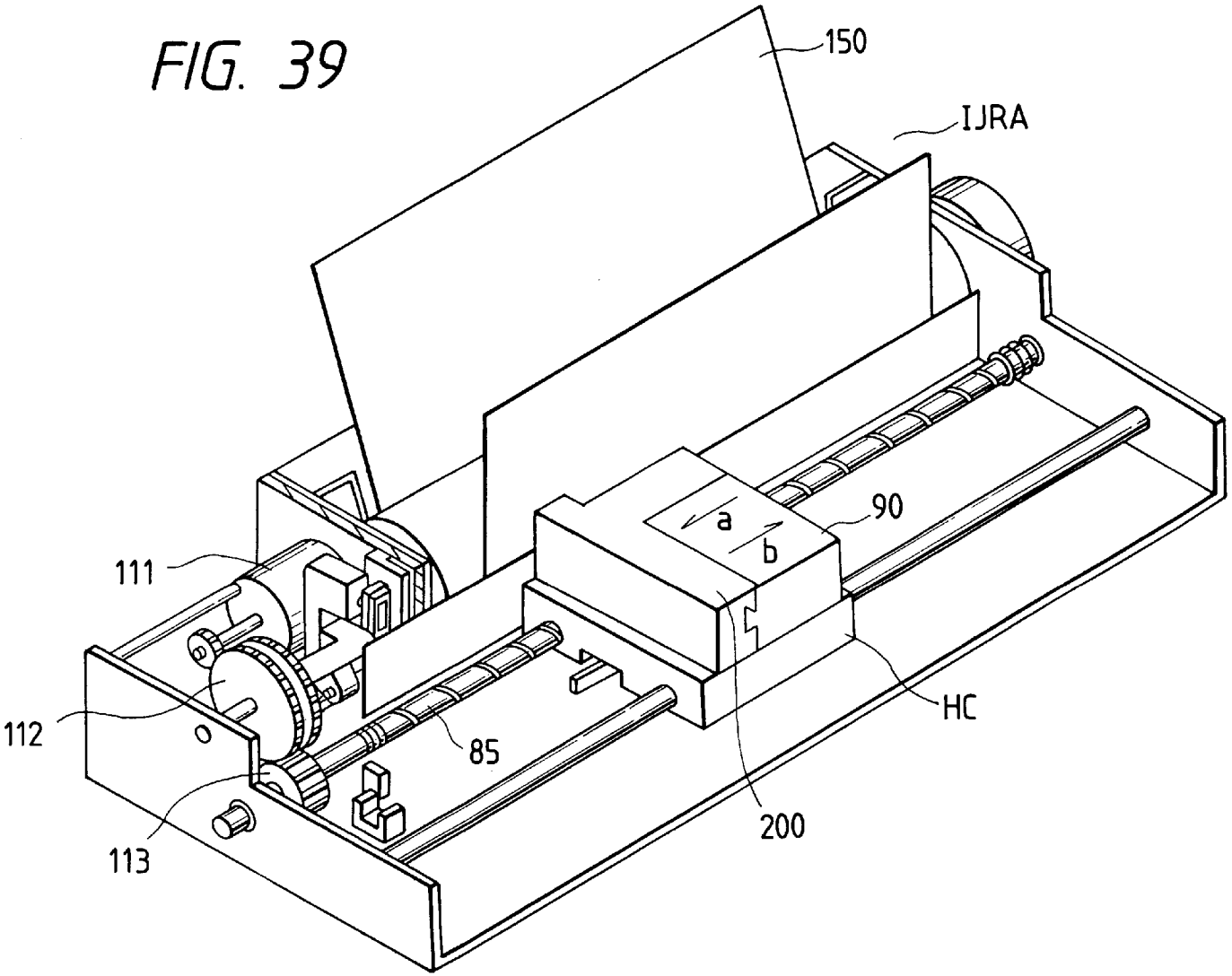
FIG. 39 is a schematic perspective view of a liquid discharging apparatus.

FIG. 39 schematically shows a liquid discharging apparatus on which the above-mentioned liquid discharging head is mounted. In this example, particularly, an ink discharge recording apparatus IJRA using ink as the discharge liquid will be explained as the liquid discharging apparatus. The cartridge to which the liquid container 90 for containing the ink and the liquid discharging head portion 200 are removably attached is mounted on a carriage HC of the apparatus. The carriage can be reciprocally shifted in a width-wise direction (directions a, b) of a recording medium 150 conveyed by a recording medium convey means.

When a drive signal is supplied from a drive signal supplying means (not shown) to the liquid discharging means on the carriage HC, the recording liquid is discharged from the liquid discharging head portion 200 toward the recording medium 150 in response to the drive signal.

Further, in the liquid discharging apparatus according to the illustrated embodiment, there are provided a motor (drive source) 111 for driving the recording medium convey means and the carriage HC, gears 112, 113 for transmitting a driving force from the drive source to the carriage HC, and a carriage shaft 85. By discharging the liquid onto various kinds of recording media by using the recording apparatus and the liquid discharging method (effected in the recording apparatus), a good image can be recorded on the recording medium.

Figure 40:
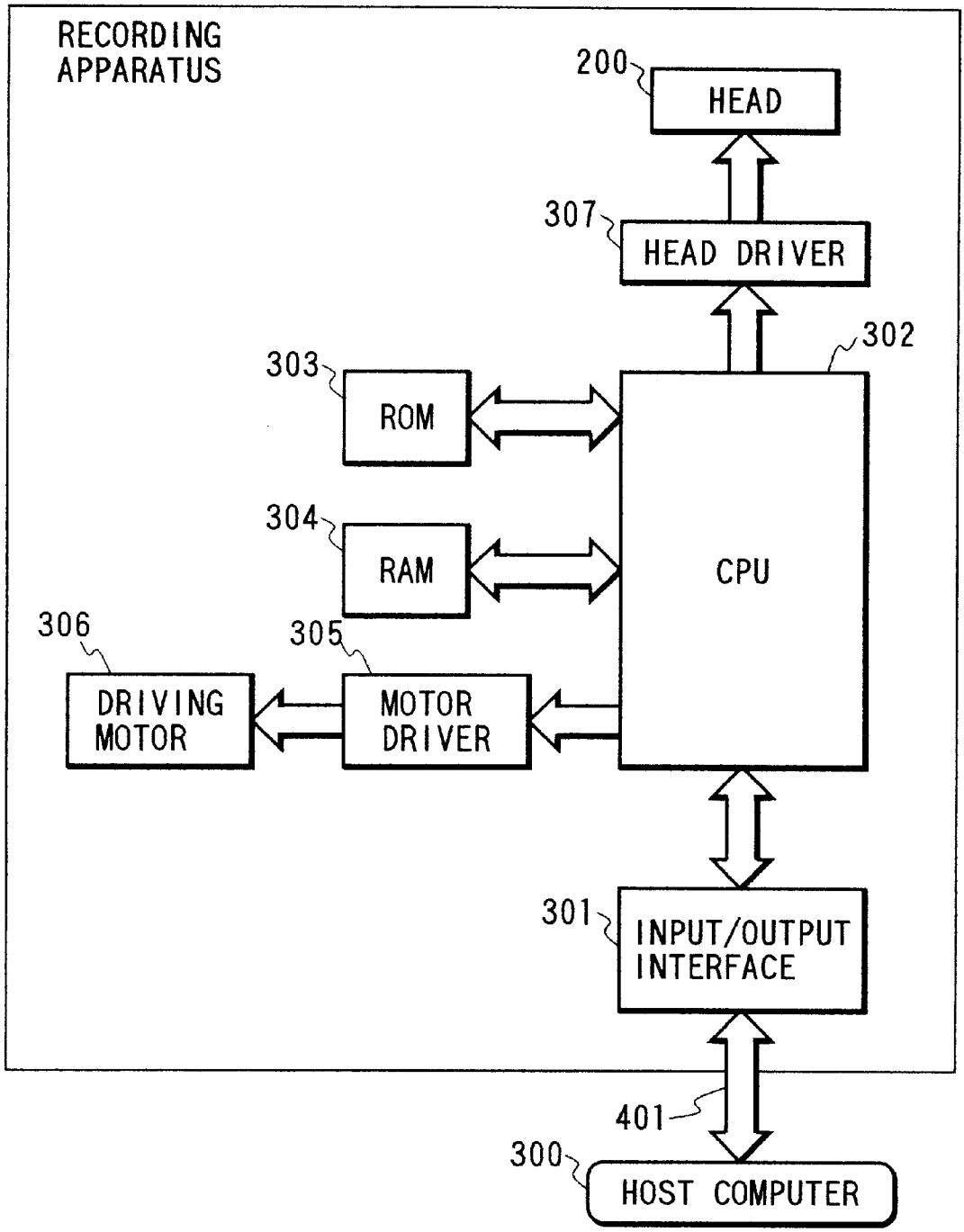
FIG. 40 is a block diagram of the apparatus.

FIG. 40 is a block diagram of the entire of the apparatus for performing the ink discharge recording by using the liquid discharging head of the present invention.

In the recording apparatus, a host computer 300 receives recording information as a control signal.

The recording information is temporarily stored in an input/output interface 301 of the apparatus and, at the same time, is converted into a treatable data in the apparatus. The data is inputted to a CPU 302 also acting as the head drive signal supplying means. The CPU 302 treats the input data on the basis of control program stored in a ROM 303, by utilizing peripheral units such as a RAM 304, to convert the input data into print data (image data).

Further, the CPU 302 produces drive data for driving a drive motor 306 for shifting the recording medium and the head 200 in synchronous with the image data in order to record the image data on a proper position on the recording medium. The image data and the motor drive data are transmitted to the head 200 and the drive motor 306 through a head driver 307 and a motor driver 305, respectively, thereby driving the head and motor at a controlled timing to form an image.

The recording medium applicable to the above-mentioned recording apparatus and capable of receiving the liquid such as ink may be various kinds of paper sheets, an OHP sheet, a plastic plate used in a compact disc or an ornament plate, cloth, a metal sheet made of aluminum, copper or the like, leather, pigskin, synthetic leather, wood, a wood board, a bamboo sheet, a ceramic sheet such as a tile, or three-dimensional articles such as sponge.

Further, the recording apparatus may include a printer for effecting the recording on various kinds of paper sheets or an OHP sheet, a plastic recording apparatus for effecting the recording on plastic material such as a compact disc, a metal recording apparatus for effecting the recording on metal, a leather recording apparatus for effecting the recording on leather, a wood recording apparatus for effecting the recording on wood, a ceramic recording apparatus for effecting the recording on ceramic material, a recording apparatus for effecting the recording on a three-dimensional net article such as sponge, and a print apparatus for effecting the recording on cloth.

Further, the discharge liquid used in these liquid discharging apparatuses may be selected in accordance with the kind of a recording medium and a recording condition.

Figure 41:
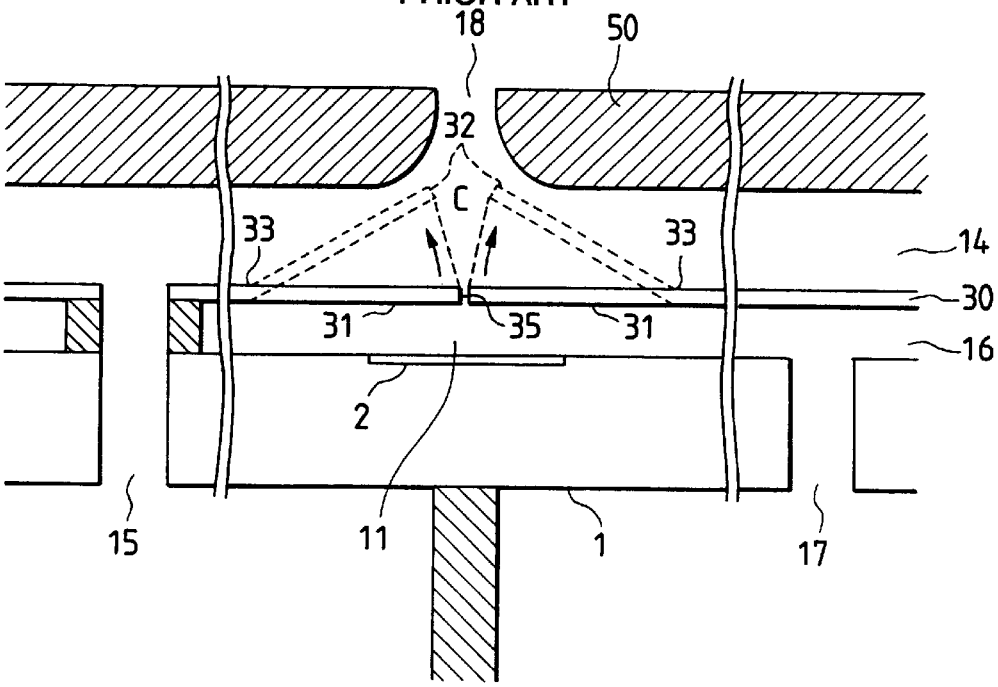
FIG. 41 PRIOR ART
FIG. 41 is a sectional view showing an example of a liquid discharging head of side shoe type to which the present invention is applied.

The present invention is not limited to a head of so-called edge chuter type which a discharge port is disposed at one end of a liquid passage extending along a surface of a heater, but may be applied to, for example, a head of so-called side chuter type in which a discharge port is disposed at a position confronting to a surface of a heater as shown in FIG. 41.

The liquid discharging head of side chuter type shown in FIG. 41 is similar to the liquid discharging head of edge chuter type in the point that second liquid passages 16 for the bubble liquid are formed above an element substrate 1 on which heat generating elements 2 (for respective discharge ports) for generating thermal energy for forming a bubble in the liquid are provided, and first liquid passages 14 (for the discharge liquid) directly communicated with the discharge port provided in a grooved member 50 are formed above the second liquid passages, and the first liquid passages 14 and the second liquid passages 16 are isolated from each other by a separation wall 30 formed from material having elasticity such as metal.

The liquid discharging head of side chuter type is characterized in that the discharge ports 18 are formed in portions (of the grooved member 50 arranged on the first liquid passages 14) disposed directly above the heat generating elements 2. Between each heat generating element 2 and the corresponding discharge port 18, the separation wall 30 has a pair of movable members 31 which can open together on hinges. Both movable members 31 are supported at their fulcrums 33. Each movable member has a free end 32 which is provided at its both lateral edges with side members capable of displacing together with the movable member 31 and adapted to cover both side of a bubble generated. In a non-discharging condition, the free ends 32 of both movable members 31 are closely spaced apart from each other with the interposition of a slit 35 disposed directly above a center of the discharge port 18. Upon liquid-discharge, as shown by the arrows in FIG. 41, both movable members 31 are opened toward the first liquid passage 14 of the discharge port 18 by the bubble generated in the bubble liquid in a bubble generating area 11. When the bubble is contracted, the movable members are closed. The discharge liquid is refilled in a zone C from a discharge liquid tank (described later) to restore the liquid discharge permitting condition, for preparing for next liquid discharging.

The first liquid passages 14 are communicated with a tank (not shown) containing the discharge liquid through a first common liquid chamber 15, and the second liquid passages 16 are communicated with a tank (not shown) containing the bubble liquid through a second common liquid chamber 17.

Substantially similar to the liquid discharging head of edge chuter type, in the liquid discharging head of edge chuter type having the above construction, the growing direction of the bubble can be directed toward the discharge port 18 while improving the refilling ability of the discharge liquid, thereby discharging the liquid with high energy efficiency and high discharging pressure.

Further, regarding the manufacturing method, the head of side chuter type is substantially the same as the head of edge chuter type, for the position of the discharge 18 provided in the grooved member, and position and structure of the common liquid chambers 15, 17. Accordingly, a relation between the separation wall 30 having the movable members 31 and the liquid passage walls defining the second liquid passages 16 are same in both heads.

Recording System

Next, an example of an ink jet recording system in which the recording is effected on the recording medium by using the liquid discharging head of the present invention as a recording head will be explained.

Figure 42:
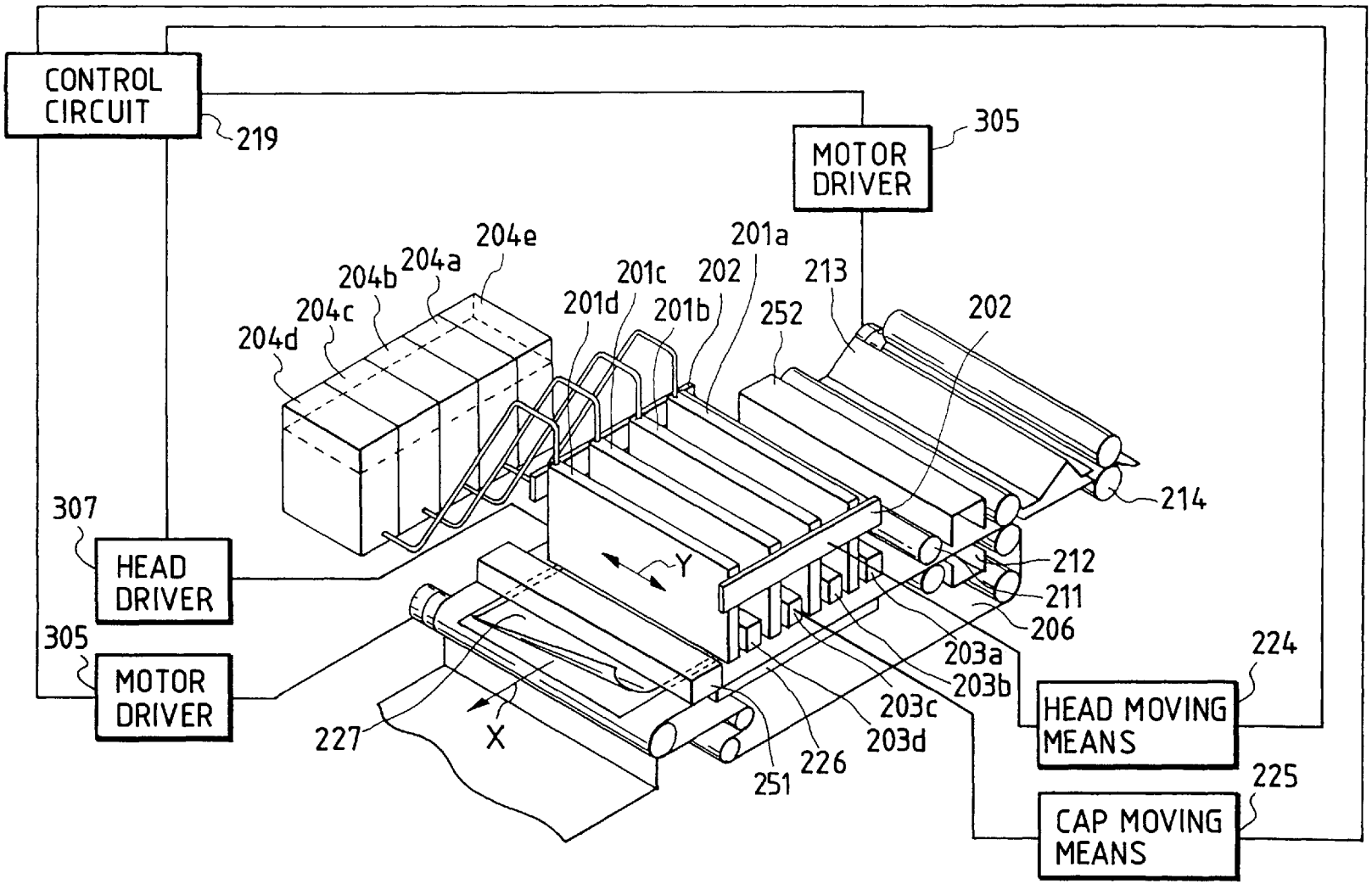
FIG. 42 is a constructural view showing a liquid discharge recording system.
Figure 44A:
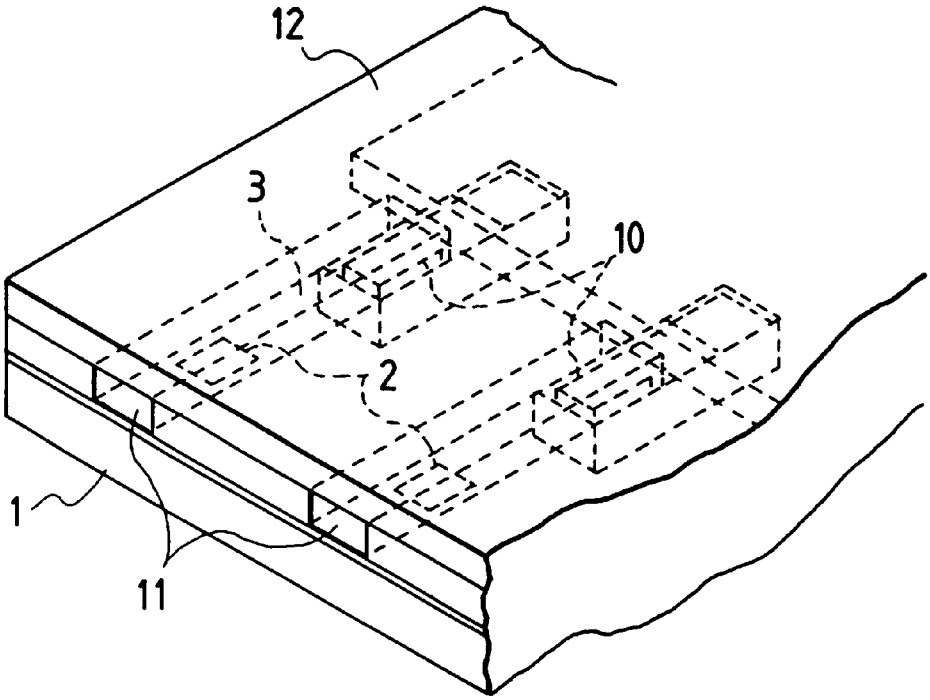
FIG. 44A PRIOR ART
FIGS. 44A and 44B are views for explaining a structure of a liquid passage of a conventional liquid discharging head.
Figure 44B:
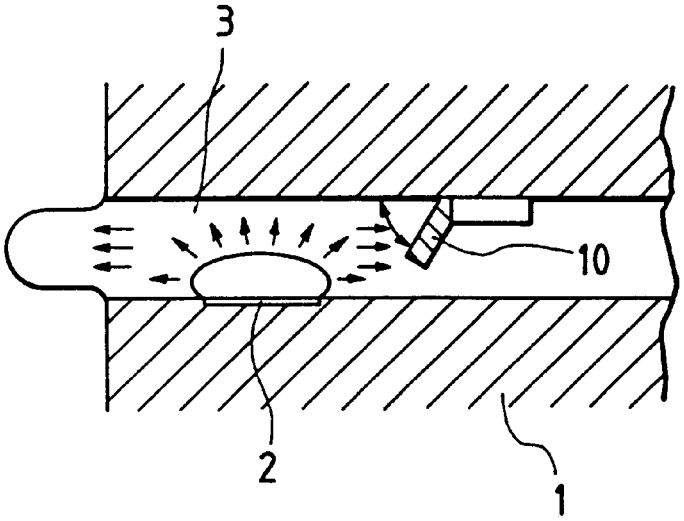
FIG. 44B PRIOR ART

FIG. 42 is a schematic view for explaining a construction of an ink jet recording system using the liquid discharging head of the present invention. The liquid discharging head according to this embodiment is a head of full-line type in which a plurality of discharge ports are disposed at an interval of 360 dpi along the length of a maximum record allowable width of the recording medium 150, and four heads 210*a*–201*d* corresponding to yellow (Y) color, magenta (M) color, cyan (C) color and black (Bk) color, respectively, are fixedly held by a holder 202 at a predetermined interval in an X direction.

A signal is supplied from the head driver (drive signal supplying means) 307 to one of the heads 201*a*–201*d*, so that the head 201*a*–201*d* is driven in response to the signal.

Four color (Y, M, C, Bk) inks are supplied as the discharge liquids from ink containers 204*a*–204*d* to the heads 201*a*–201*d*, respectively. Incidentally, the reference numeral 204*e* denotes a bubble liquid container containing the bubble liquid, and the bubble liquid is supplied from the bubble liquid container 204*e* to the heads 201*a*–201*d*.

Further, head caps 203*a*–203*d* including ink absorbing material such as sponge are disposed below the respective heads 201*a*–201*d* so that, in an inoperative condition, the heads 201*a*–201*d* is protected by covering the discharge ports of the heads 201*a*–201*d* by the head caps 203*a*–203*d*.

The reference numeral 206 denotes a convey belt constituting a convey means for conveying various kinds of recording medium, as mentioned above. The convey belt 206 is mounted on a plurality of rollers and is driven by a drive roller connected to the motor driver 305.

In the ink jet recording system according to the illustrated embodiment, there is provided a pre-treatment device 251 adapted to perform pre-treatment regarding the recording medium before the recording is started and disposed at an upstream side in a recording medium conveying path, and a post-treatment device 252 adapted to perform post-treatment regarding the recording medium after the recording is finished and disposed at a downstream side in the recording medium conveying path.

The pre-treatment and post-treatment are varied in accordance with the kind of the recording medium to be recorded and/or the kind of ink. For example, regarding the recording medium made of metal, plastic or ceramic, as the pre-treatment, ultraviolet ray and ozone are illuminated onto the recording medium to make a surface of the recording medium active, thereby improving the adhering ability of ink to the recording medium. Further, in case of the recording medium (for example, plastic) which easily generates static electricity, dirt is apt to be adhered to the surface of the recording medium due to the static electricity, resulting in prevention of good recording. Thus, such a recording medium, as the pre-treatment, the static electricity is removed from the recording medium by using an ionizer device to remove dirt on the recording medium. Further, when the cloth is used as the recording medium, in a view point of prevention of blot and improvement in coloring ability, as the pre-treatment, material selected among alkaline substance, water-soluble substance, synthetic polymer, water-soluble metal chloride, urea and chiourea may be added to the cloth. The pre-treatment is not limited above-mentioned examples, but, may include treatment for adjusting a temperature of the recording medium to a temperature suitable for the recording.

On the other hand, the post-treatment may include heat treatment of the recorded recording medium, fixing treatment for promoting the fixing of ink by illumination of ultraviolet ray and cleaning treatment for cleaning the residual treatment agent.

Incidentally, in the illustrated embodiment, while an example that the full line heads are used as the heads 201*a*–201*d* was explained, the present invention is not limited to such an example, the recording may be effected by shifting the above-mentioned compact head in the widthwise direction of the recording medium.

Head Kit

Figure 43:
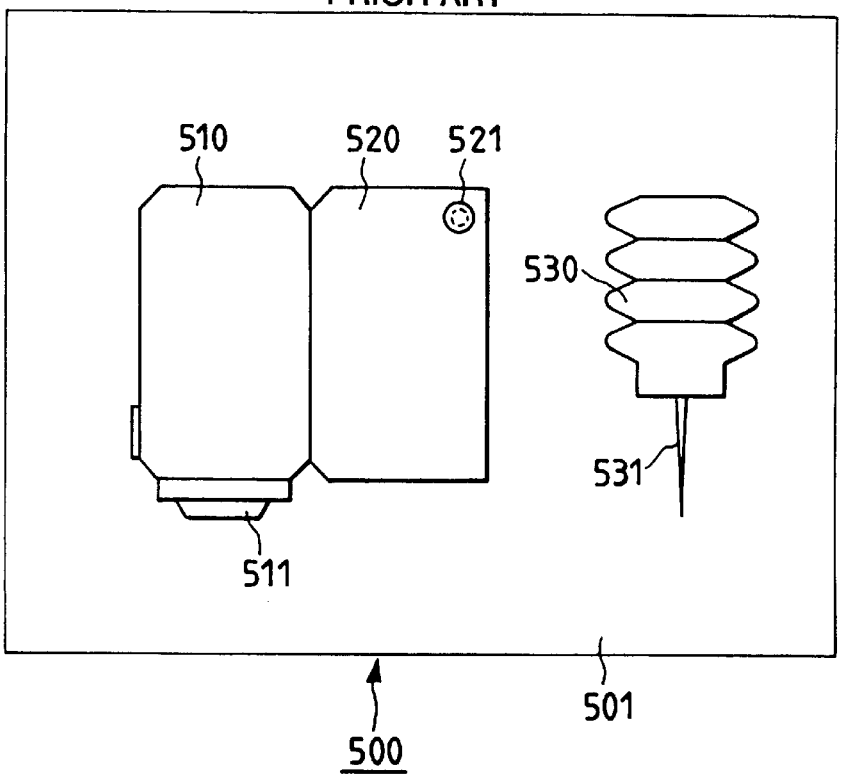
FIG. 43 PRIOR ART
FIG. 43 is a schematic view of a head kit.

Now, a head kit having the liquid discharging head of the present invention will be explained. FIG. 43 schematically shows such a head kit. In the head kit 500, a head 510 of the present invention having ink discharge portion 511 for discharging ink, an ink container 520 integrally attached or removably connected to the head 510, and an ink loading means 530 for holding ink and for loading the ink in the ink container are housed in a kit container 501.

When the ink is consumed, an insert portion (for example, a needle) of the ink loading means 530 is inserted into a vent hole 521 of the ink container 520 or a connection portion between the head 510 and the ink container or a hole formed in a wall of the ink container 520, so that the ink in the ink loading means 530 is loaded in the ink container 520.

By providing the head kit in which the head 510 of the present invention, ink container 520 and ink loading means 530 are housed in the single head kit container 501, even when the ink is consumed, the ink can easily be loaded in the ink container 520 promptly, thereby re-starting the recording quickly.

Incidentally, in the illustrated embodiment, while the head kit 500 including the ink loading means 530 was explained, in a head kit, only a removable ink container containing ink and a head may be housed in a kit container.

Further, in FIG. 43, while only the ink loading means 530 for loading the ink in the ink container 520 was shown, a bubble liquid loading means for loading the bubble liquid in a bubble liquid container may be housed in the kit container, as well as the ink loading means.

According to the liquid discharging head based on the new discharging principle using the movable member having the integral side members, since the both sides of the generated bubble are covered by the side members, the pressure directing transverse to the liquid flow direction can also be oriented toward the discharge port and the growing direction of the bubble itself is also directed toward the downstream side, with the result that the bubble can be grown more greatly at the downstream side than at the upstream side. Consequently, since the liquid near the discharge port can be oriented to the discharge port efficiently, the discharging efficiency can be improved greatly in comparison with the conventional bubble jet discharging heads. Further, in case of the head of two-passage type, one of the liquid passages can surely be isolated from the other by the side member, thereby preventing the mixing between the bubble liquid and the discharge liquid and achieving the good liquid discharging.

Particularly, when the movable member has the flexible thin diaphragm having the expansion/contraction portions corresponding to the side portions of the movable member so that the expansion/contraction portions can act as the side members, since the opening (toward the discharging opening) caused by the displacement of the movable member becomes constant and the bubble pressure acting toward the discharge port also becomes constant, the stable discharging can be achieved.

Further, according to the characteristic arrangement of the present invention, even when the head is placed under a low temperature and/or low humidity condition for a long time, the poor discharging can be suppressed or prevented; and, if the poor discharging occurs, the normal condition can easily be restored by effecting simple preliminary discharge and/or suction recovery. Therefore, the recovery time and loss of liquid due to recovery can be reduced, thereby reducing the running cost greatly.

Further, according to the arrangement of the present invention for improving the refill feature, the response in the continuous discharging, stable growth of the bubble and the stabilizing of liquid droplet can be achieved, thereby permitting the high speed recording due to high speed liquid discharge and the high quality image recording.

In addition, regarding the head of two-passage type, when the liquid in which the bubble can easily be generated or the liquid in which deposit is hard to be accumulated on the heat generating element is used as the bubble liquid, degree of freedom of selection of the discharge liquid is increased, with the result that high viscous liquid in which the bubble is hard to be generated and the liquid in which deposit is apt to be accumulated on the heat generating element (which liquids is hard to be discharged in the conventional bubble jet discharging methods) can be discharged effectively.

Further, the liquid having poor resistance to heat can be discharged without deterioration of the liquid due to the heat.

Further, by using the liquid discharging head of the present invention as a recording liquid discharging head, a high quality image can be obtained. Finally, by using the liquid discharging head of the present invention, a liquid discharging apparatus and recording system in which the liquid discharging efficiency is improved can be provided.

What is claimed is:

1. A liquid discharging head comprising:

a discharge port for discharging liquid;

a liquid passage communicated with said discharge port;

a bubble generating area for generating a bubble in the liquid in said liquid passage, said bubble generating area including heating means for heating the liquid in the liquid passage; and a movable member disposed in a confronting relation to said bubble generating area in said liquid passage and adapted to be shifted by pressure caused by generating the bubble at said bubble generating area to direct the pressure toward said discharge port and to be returned to its initial position by negative pressure due to contraction of the bubble; and wherein said movable member is shaped such that, when said movable member is moved away from said bubble generating area, a liquid resistance against said movable member is less than that when said movable member is moved towards said bubble generating area.

2. A liquid discharging head according to claim 1, wherein a heat generating element is disposed at a position facing to said movable member, and said bubble generating area is defined between said movable member and said heat generating element.

3. A head cartridge comprising:

a liquid discharging head according to claim 1, and a liquid container for containing the liquid to be supplied to said liquid discharging head.

4. A liquid discharging apparatus comprising:

a liquid discharging head according to claim 1, and a drive signal supplying means for supplying a drive signal for discharging the liquid from said liquid discharging head.

5. A liquid discharging head according to claim 1, wherein said movable member has a portion for enclosing the bubble at a surface directly receiving the pressure due to the generation of the bubble.

6. A liquid discharging head according to claim 1, wherein said movable member has a recessed shape at the side faced to said bubble generating area when said movable member is displaced due to the bubble.

7. A liquid discharging head according to claim 1, comprising:

an element substrate on which a plurality of discharge energy generating elements for generating a bubble for discharging liquid are disposed; and a plurality of discharge ports provided in correspondance to said plurlaity of discharge energy generating elements and each directly communicated with a common liquid chamber to which the liquid is supplied.

8. A liquid discharging head according to claim 7, wherein said element substrate has movable wall side walls disposed on both sides of each of said discharge energy generating elements.

9. A liquid discharging head according to claim 8, wherein said movable member is supported by a movable wall support member provided on said element substrate, and said movable wall support member is integrally formed with said movable wall side walls.

10. A liquid discharging head according to claim 8, wherein heights of said movable wall side walls are greater than a maximum displacement distance of said free end of said movable member.

11. A liquid discharging head according to claim 7, wherein said element substrate further includes a groove for receiving a portion of said movable member.

12. A liquid discharging head according to claim 1, wherein said movable member has a flexible thin diaphragm having expansion/contraction portions defining both side portions of said movable member, and said expansion/contraction portions constitute said side members.

13. A liquid discharging head according to claim 12, wherein said thin diaphragm is secured in a cantilever fashion so that an area between said expansion/contraction portions provides said free end near said discharging port.

14. A liquid discharging head according to claim 1, wherein a cross-section of said movable member perpendicular to a flow of the liquid has a substantially inverted U-shape for covering said bubble generating area.

15. A liquid discharging head according to claim 14 or 8, wherein, when said movable member is in said first position, said bubble generating area is substantially closed.

16. A liquid discharging head according to claim 14 or 8, wherein said movable member is supported by a movable wall support member provided on said element substrate.

17. A liquid discharging head comprising:

a discharge port for discharging liquid;

a liquid passage communicated with said discharge port;

a bubble generating area for generating a bubble in the liquid in said liquid passage, said bubble generating area including heating means for heating the liquid within liquid passage; and a movable member disposed in a confronting relation to said bubble generating area in said liquid passage and adapted to be shifted by pressure caused by generating the bubble at said bubble generating area to direct the pressure toward said discharge port and to be returned to its initial position by negative pressure due to contraction of the bubble, wherein a cross-sectional shape of the movable member taken in a direction across an extending direction of the movable member has a recess on the side of the bubble generating area, and wherein said movable member is shaped such that, when said movable member is moved away from said bubble generating area, a liquid resistance against said movable member is less than that when said movable member is moved towards said bubble generating area.

18. A liquid discharging head comprising:

a discharge port for discharging liquid;

a liquid passage communicated with said discharge port;

a bubble generating area for generating a bubble in the liquid in said liquid passage, said bubble generating area including heating means for heating the liquid within liquid passage;

a movable member disposed in a confronting relation to said bubble generating area in said liquid passage and adapted to be shifted by pressure caused by generating the bubble at said bubble generating area to direct the pressure toward said discharge port and to be returned to its initial position by negative pressure due to contraction of the bubble, wherein a cross-sectional shape of the movable member taken in a direction across an extending direction of the movable member has a projection on an opposite side of the bubble generating area, and wherein said movable member is shaped such that, when said movable member is moved away from said bubble generating area, a liquid resistance against said movable member is less than that when said movable member is moved towards said bubble generating area.

* * * * *